US009568159B2

(12) United States Patent
Tsai et al.

(10) Patent No.: US 9,568,159 B2
(45) Date of Patent: Feb. 14, 2017

(54) VEHICLE ILLUMINATION APPARATUS

(71) Applicants: Han-Wen Tsai, Hsin-Chu (TW); Ming-Feng Kuo, Hsin-Chu (TW); Kuo-Sheng Huang, Hsin-Chu (TW)

(72) Inventors: Han-Wen Tsai, Hsin-Chu (TW); Ming-Feng Kuo, Hsin-Chu (TW); Kuo-Sheng Huang, Hsin-Chu (TW)

(73) Assignee: CORETRONIC CORPORATION, Hsin-Chu (TW)

( * ) Notice: Subject to any disclaimer, the term of this patent is extended or adjusted under 35 U.S.C. 154(b) by 570 days.

(21) Appl. No.: 14/018,429

(22) Filed: Sep. 5, 2013

(65) Prior Publication Data

US 2014/0085919 A1 Mar. 27, 2014

(30) Foreign Application Priority Data

Sep. 26, 2012 (TW) ..... 101135356 A
May 3, 2013 (TW) ..... 102115919 A

(51) Int. Cl.
*F21S 8/10* (2006.01)
*F21V 5/08* (2006.01)
*F21Y 101/00* (2016.01)

(52) U.S. Cl.
CPC ..... *F21S 48/1225* (2013.01); *F21S 48/1154* (2013.01); *F21S 48/137* (2013.01);
(Continued)

(58) Field of Classification Search
CPC F21S 48/1225; F21S 48/1154; F21S 48/1241; F21S 48/1329; F21S 48/137; B60Q 1/04; F21V 13/02; F21V 5/002; F21V 5/045; F21V 5/08; F21V 5/091; F21V 5/048; F21V 5/09
(Continued)

(56) References Cited

U.S. PATENT DOCUMENTS 5,757,557 A 5/1998 Medvedev et al.
6,755,556 B2 * 6/2004 Gasquet ..... F21S 48/2212 362/328
(Continued)

FOREIGN PATENT DOCUMENTS

CN 2823805 10/2006
CN 101285560 10/2008
(Continued)

OTHER PUBLICATIONS

Machine Translation of FR 2 867 257.*
(Continued)

*Primary Examiner* — Robert May
*Assistant Examiner* — Leah S Macchiarolo
(74) *Attorney, Agent, or Firm* — Jianq Chyun IP Office

(57) ABSTRACT

A vehicle illumination apparatus includes at least one illumination light source and at least one light guiding lens. The illumination light source is capable of providing an illumination beam. The light guiding lens includes a first light transmissive surface, a second light transmissive surface opposite to and smaller than the first light transmissive surface, an inner surrounding surface, and an outer surrounding surface. The first light transmissive surface is capable of projecting the illumination beam out of the light guiding lens. The inner surrounding surface and the second light transmissive surface are connected to each other and define a containing space configured to accommodate the illumination light source. The outer surrounding surface is connected to the inner surrounding surface and the first light transmissive surface. Besides, the outer surrounding surface has at least one light condensing region and at least one light diverging region.

41 Claims, 52 Drawing Sheets

(52) U.S. Cl.
CPC ..... *F21S 48/1329* (2013.01); *F21V 5/08* (2013.01); *F21Y 2101/00* (2013.01)

(58) Field of Classification Search
USPC ..... 362/307–309, 296.5, 296.8, 311.01, 362/311.06, 522
See application file for complete search history.

(56) References Cited

U.S. PATENT DOCUMENTS

| | | | | |
|---|---|---|---|---|
| 6,882,110 | B2 | 4/2005 | Ishida et al. | |
| 7,128,453 | B2 | 10/2006 | Tatsukawa et al. | |
| 7,131,758 | B2 | 11/2006 | Ishida | |
| 7,470,042 | B2 | 12/2008 | Ayabe et al. | |
| 8,109,664 | B2 * | 2/2012 | Nakada | F21S 48/215 362/311.02 |
| 8,591,083 | B2 * | 11/2013 | Koizumi | B60Q 1/302 362/520 |
| 2005/0152153 | A1 * | 7/2005 | Amano | F21S 48/215 362/520 |
| 2007/0114551 | A1 | 5/2007 | Kawaguchi et al. | |
| 2007/0268694 | A1 | 11/2007 | Bailey et al. | |
| 2009/0225440 | A1 | 9/2009 | Ho | |
| 2010/0135036 | A1 | 6/2010 | Matsuba et al. | |
| 2010/0259153 | A1 * | 10/2010 | Futami | F21S 48/215 313/114 |
| 2011/0280039 | A1 | 11/2011 | Kishimoto | |
| 2012/0057362 | A1 | 3/2012 | Fritz et al. | |
| 2013/0058103 | A1 * | 3/2013 | Jiang | F21V 5/04 362/296.05 |
| 2014/0056021 | A1 | 2/2014 | Takahira et al. | |
| 2016/0153640 | A1 * | 6/2016 | Iatan | B29D 11/0048 362/311.02 |

FOREIGN PATENT DOCUMENTS

| | | | | |
|---|---|---|---|---|
| CN | 101384944 | | 3/2009 | |
| CN | 101725896 | | 6/2010 | |
| CN | 102109141 | | 6/2011 | |
| CN | 103572664 | | 2/2014 | |
| FR | 2867257 | A1 * | 9/2005 | F21S 48/215 |
| JP | 2005129354 | | 5/2005 | |
| JP | 2006147347 | | 6/2006 | |
| JP | 2007317952 | | 12/2007 | |
| JP | 2010107844 | | 5/2010 | |
| JP | 2010135124 | | 6/2010 | |
| JP | 2012119267 | | 6/2012 | |
| TW | 200711167 | | 3/2007 | |
| TW | M310992 | | 5/2007 | |
| TW | 200842480 | | 11/2008 | |
| TW | I307174 | | 3/2009 | |
| TW | I338637 | | 3/2011 | |
| TW | 201124662 | | 7/2011 | |
| TW | 201128109 | | 8/2011 | |
| TW | M410863 | | 9/2011 | |
| TW | 201139935 | | 11/2011 | |
| TW | M434898 | | 8/2012 | |
| TW | I418744 | | 12/2013 | |
| TW | 201425815 | | 7/2014 | |
| TW | 201441073 | | 11/2014 | |
| WO | 9857199 | | 12/1998 | |

OTHER PUBLICATIONS

"Office Action of Japan Counterpart Application", issued on Jul. 15, 2014, p. 1-p. 4, in which the listed references were cited.
"Office Action of Taiwan Counterpart Application" , issued on Sep. 25, 2014, p. 1-p. 18, in which the listed U.S., Japan and China references were cited.
"Office Action of Taiwan Counterpart Application" , issued on Sep. 26, 2014, p. 1-p. 12, in which the listed Taiwan references were cited.
"Office Action of Korea Counterpart Application" , issued on Jan. 20, 2015, p. 1-p. 5, in which the listed reference was cited.
"Office Action of Chinese Counterpart Application", issued on May 5, 2015, p. 1-p. 13, in which the listed references were cited.
"Office Action of Taiwan Counterpart Application", issued on Sep. 26, 2014, p. 1-p. 12, in which the listed reference was cited.
"Office Action of China Counterpart Application", issued on Nov. 6, 2015, p. 1-p. 13, in which the listed reference was cited.

* cited by examiner

VEHICLE ILLUMINATION APPARATUS

CROSS-REFERENCE TO RELATED APPLICATION

This application claims the priority benefits of Taiwan application serial no. 101135356, filed on Sep. 26, 2012, and Taiwan application serial no. 102115919, filed on May 3, 2013. The entirety of each of the above-mentioned patent applications is hereby incorporated by reference herein and made a part of specification.

BACKGROUND OF THE INVENTION

Field of the Invention

The invention relates to an illumination apparatus. Particularly, the invention relates to a vehicle illumination apparatus.

Description of Related Art

Light-emitting diode (LED) headlights have been gradually applied in compliance with requirements for light-emitting efficiency, energy saving, and environmental protection. At present, the cost of the LED headlight remains high due to the needs of high-wattage LEDs and large heat sinks. Generally, in the existing LED low beam, a shielding plate is often required to form a clear cut-off line through the imaging of the lens, so as to prevent glare to the on-coming vehicle. However, the shielding plate also leads to reduction of utilization efficiency (e.g., at most 60% of the total efficiency) of the light source of the LED low beam.

U.S. Pat. No. 5,757,557 discloses an illumination apparatus that includes a lens body, and the lens body has a front surface, a curved sidewall expanding forward, and a rear cylindrical cavity. A light beam transmitted to the back is reflected by the curved sidewall to form a collimating beam. According to the patent, the cavity has a curved surface capable of performing a collimating function. U.S. Pat. No. 7,470,042 discloses a light source structure of which a light source has a light guiding portion with a high refractive index. A central portion on a front side of the light guiding portion is a round direct-emitting region, an outer side of the light guiding portion is a total reflection region, and a back surface of the light guiding portion has a semi-spherical recess portion. U.S. Pat. No. 7,128,453 discloses a light source structure of which a light-shielding member is shaped as a plate and shields parts of the light source in front of the vehicle, so as to define a bright-dark boundary of a light beam incident on the lens. U.S. Pat. No. 7,131,758 discloses a headlight structure, in which the required cut-off line is formed by adjusting angles of light sources and a light transmissive mask. U.S. Pat. No. 6,882,110 discloses a headlight structure, in which plural lamp units are employed to define different regions, so as to obtain a desired light intensity distribution.

Moreover, different types of optical lenses have also been disclosed in U.S. Patent Application Publication no. 2012057362, Taiwan R.O.C. Patent no. M434898, Japan Patent Publication no. 2006-147347, Japan Patent Publication no. 2010-135124, Taiwan R.O.C. Patent Publication no. 201139935, Taiwan R.O.C. Patent no. M310992, and Taiwan R.O.C. Patent no. 1307174.

SUMMARY OF THE INVENTION

The invention is directed to an illumination apparatus used in vehicle, and the illumination apparatus is capable of simultaneously providing strong forward light output and wide-range illumination.

Additional aspects and/or advantages of the invention will be set forth in part in the description which follows and, in part, will be obvious from the description, or may be learned by practice of the invention.

To achieve one of, parts of, or all of the above objectives or other objectives, an embodiment of the invention provides a vehicle illumination apparatus that includes at least one illumination light source and at least one light guiding lens. The light guiding lens is a condensing and diverging lens, for instance. The illumination light source is capable of providing an illumination beam. The condensing and diverging lens includes a first light transmissive surface, a second light transmissive surface opposite to the first light transmissive surface, an inner surrounding surface, and an outer surrounding surface. The first light transmissive surface is capable of projecting the illumination beam out of the condensing and expanding lens. The second light transmissive surface is smaller than the first light transmissive surface. The inner surrounding surface and the second light transmissive surface are connected to each other and define a containing space configured to accommodate the illumination light source. The first outer surrounding surface is connected to the first inner surrounding surface and the first light transmissive surface. Besides, the first outer surrounding surface expands toward the first light transmissive surface from a location where the first inner surrounding surface is connected to the first outer surrounding surface. The outer surrounding surface includes a plurality of reflection regions, and each of the reflection regions includes at least one light condensing region and at least one light diverging region. A first sub-beam of the illumination beam sequentially passes the first inner surrounding surface, is reflected by the first light condensing region, and passes the first light transmissive surface. A second sub-beam of the illumination beam sequentially passes the first inner surrounding surface, is reflected by the first light diverging region, and passes the first light transmissive surface. A divergence angle of the second sub-beam passing the first light transmissive surface is greater than a divergence angle of the first sub-beam passing the first light transmissive surface.

According to an embodiment of the invention, an irradiation range of the second sub-beam passing the first light transmissive surface covers an irradiation range of the first sub-beam passing the first light transmissive surface.

According to an embodiment of the invention, an irradiation range of the first sub-beam passing the first light transmissive surface is substantially located at a center of an irradiation range of the second sub-beam passing the first light transmissive surface.

According to an embodiment of the invention, the outer surrounding surface has at least one step between each of the reflection regions.

According to an embodiment of the invention, a width of the step is increased progressively along a direction perpendicular to an optical axis of the illumination light source.

According to an embodiment of the invention, a curvature of the light condensing region is increased then decreased progressively along a direction perpendicular to an optical axis of the illumination light source.

According to an embodiment of the invention, the first light transmissive surface has a protruding sub-surface located on an optical axis of the illumination light source.

According to an embodiment of the invention, the first light transmissive surface further has a ring-shaped concave surface that surrounds the protruding sub-surface.

According to an embodiment of the invention, the ring-shaped concave surface and the protruding sub-surface are smoothly connected to form a continuous curved surface.

According to an embodiment of the invention, a depth of the ring-shaped concave surface in a direction parallel to the optical axis of the illumination light source is greater than a height of the protruding sub-surface in the direction parallel to the optical axis of the illumination light source.

According to an embodiment of the invention, the first light transmissive surface is a protruding curved surface.

According to an embodiment of the invention, the first light transmissive surface is a plane.

According to an embodiment of the invention, the light guiding lens is a collimating lens, for instance. The first light transmissive surface is capable of projecting the illumination beam out of the collimating lens. Here, a light pattern of the illumination beam projected out of the collimating lens is measured on a first reference plane intersecting an optical axis of the second illumination light source at a point, and the measured light pattern is substantially distributed over one side of a reference line on the first reference plane. The second light transmissive surface is opposite to and smaller than the first light transmissive surface, and the second light transmissive surface is mirror-asymmetrical relative to a second reference plane parallel to the optical axis of the second illumination light source. The outer surrounding surface includes a plurality of reflection regions, each of the reflection regions is a continuous curved surface.

According to an embodiment of the invention, a light pattern of a portion of the illumination beam functioned by the light diverging region and projected out of the collimating lens is measured on the first reference plane, the measured light pattern is distributed under the reference line, an angle is included between the optical axis of the illumination light source and a connection line between a center point of the first light transmissive surface and an endpoint of the light pattern at a maximum width in a direction parallel to the reference line, and the included angle is greater than a critical angle range.

According to an embodiment of the invention, the light diverging regions include a plurality of sub light diverging regions, a light pattern of a portion of the illumination beam functioned by the sub light diverging regions and projected out of the collimating lens is measured on the first reference plane, the measured light pattern is distributed under the reference line, an angle is included between the optical axis of the illumination light source and a connection line between a center point of the first light transmissive surface and an endpoint of the light pattern at a maximum width in a direction parallel to the reference line, and the included angle is greater than a critical angle range.

According to an embodiment of the invention, each of the sub light diverging regions is a continuous curved surface, and at least one step is between each of the sub light diverging regions and the adjacent reflection regions.

According to an embodiment of the invention, the sub light diverging regions include a first sub light diverging region and a second sub light diverging region, a light pattern of a portion of the illumination beam functioned by the first sub light diverging region and projected out of the collimating lens is measured on the first reference plane, the measured light pattern is distributed under the reference line, an included angle between the optical axis of the second illumination light source and the connection line between the center point of the first light transmissive surface and an endpoint of said light pattern at a maximum width in the direction parallel to the reference line is within a first angle range, a light pattern of a portion of the illumination beam functioned by the second sub light diverging region and projected out of the collimating lens is measured on the first reference plane, the measured light pattern of is distributed under the reference line, an included angle between the optical axis of the illumination light source and the connection line between the center point of the first light transmissive surface and an endpoint of said light pattern at a maximum width in the direction parallel to the reference line is within a second angle range, the second angle range is greater than the first angle range, and the first angle range is greater than the critical angle range.

According to an embodiment of the invention, a light pattern of a portion of the illumination beam functioned by the light condensing region and projected out of the collimating lens is measured on the first reference plane, the measured light pattern is distributed under the reference line, an angle is included between the optical axis of the illumination light source and a connection line between a center point of the first light transmissive surface and an endpoint of the light pattern at a maximum width in a direction parallel to the reference line, and the included angle is smaller than or equal to a critical angle range.

According to an embodiment of the invention, the light condensing regions include a plurality of sub light condensing regions, each of the sub light condensing regions is a continuous curved surface, and at least one step is between each of the sub light condensing regions and the adjacent reflection regions.

According to an embodiment of the invention, the sub light condensing regions are arranged on two sides of the light diverging region.

According to an embodiment of the invention, the reflection regions further include at least one specific angle-forming region, a light pattern of the illumination beam functioned by the specific angle-forming region and projected out of the collimating lens is measured on the first reference plane, the measured light pattern is distributed under the reference line, the reference line is a polyline and includes two straight lines, the two straight lines intersect each other, and a specific angle is included between the two straight lines.

According to an embodiment of the invention, each of the specific angle-forming regions is a continuous curved surface, and at least one step is between each of the at least one specific angle-forming region and one of the reflection regions adjacent to the each of the specific angle-forming regions.

According to an embodiment of the invention, the specific angle-forming regions are arranged on two sides of the light diverging region and on two sides of the second reference plane.

According to an embodiment of the invention, a light pattern of a portion of the illumination beam functioned by the second light transmissive surface and projected out of the collimating lens is measured on the first reference plane, the measured light pattern is distributed under the reference line, an angle is included between the optical axis of the illumination light source and a connection line between a center point of the first light transmissive surface and an endpoint of said light pattern at a maximum width in a direction parallel to the reference line, and the included angle is at least greater than a critical angle range.

According to an embodiment of the invention, the included angle between the optical axis of the illumination light source and the connection line between the center point of the first light transmissive surface and the endpoint of said measured light pattern (of the portion of the illumination beam functioned by the second light transmissive surface and projected out of the collimating lens) at the maximum width in the direction parallel to the reference line is within a third angle range greater than the critical angle range.

According to an embodiment of the invention, the second light transmissive surface is mirror-symmetrical relative to a third reference plane parallel to the optical axis of the illumination light source, and the second reference plane is substantially perpendicular to the third reference plane.

According to an embodiment of the invention, the second light transmissive surface is a continuous curved surface.

According to an embodiment of the invention, the number of the at least one illumination light source is 2 or more than 2, the number of the light guiding lenses is the same as the number of the illumination light sources, materials of the light guiding lenses are the same, the light guiding lenses are integrally formed and collectively have a lens structure, and the illumination light sources are correspondingly located in the containing spaces of light guiding lenses.

According to an embodiment of the invention, the light guiding lenses are connected with each other and integrally formed.

According to an embodiment of the invention, the optical axis of the illumination light source is substantially parallel to the optical axis of the illumination light source.

According to an embodiment of the invention, the first light transmissive surface further has a ring-shaped concave surface and a protruding sub-surface. The protruding sub-surface is located on the optical axis of the illumination light source. The ring-shaped concave surface surrounds the protruding sub-surface. Here, a depth of the ring-shaped concave surface in a direction parallel to the optical axis of the illumination light source is greater than a height of the protruding sub-surface in the direction parallel to the optical axis of the illumination light source.

According to an embodiment of the invention, the first light transmissive surface is a protruding curved surface.

According to an embodiment of the invention, a third sub-beam of the illumination beam sequentially passes the second light transmissive surface and the first light transmissive surface, and the divergence angle of the second sub-beam passing the first light transmissive surface is greater than a divergence angle of the third sub-beam passing the first light transmissive surface.

As discussed above, in the vehicle illumination apparatus described in an embodiment of the invention, the condensing and diverging lens has the light condensing region that may condense the first sub-beam, such that the resultant vehicle illumination apparatus is able to provide the strong forward light output. In addition, the condensing and diverging lens also has the light diverging region, and therefore the resultant vehicle illumination apparatus is also capable of providing the wide-range illumination. Moreover, based on total reflection and refraction principles, different regions on the outer surrounding surface of the collimating lens of the vehicle illumination apparatus described herein are designed to have different curved surfaces, and the neighboring regions have steps therebetween, so as to form divergent light patterns at different angles. Thereby, the light pattern of the illumination beam projected out of the collimating lens in the vehicle illumination apparatus has a substantially clear cut-off line, a specific converging region, and a high light utilization rate.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1A:
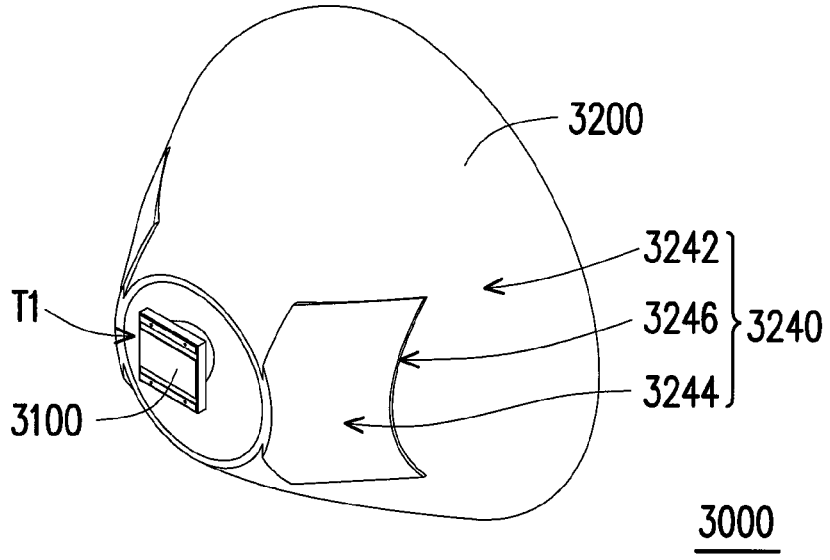
FIG. 1A is a schematic three-dimensional view briefly illustrating a vehicle illumination apparatus according to an embodiment of the invention.
Figure 1B:
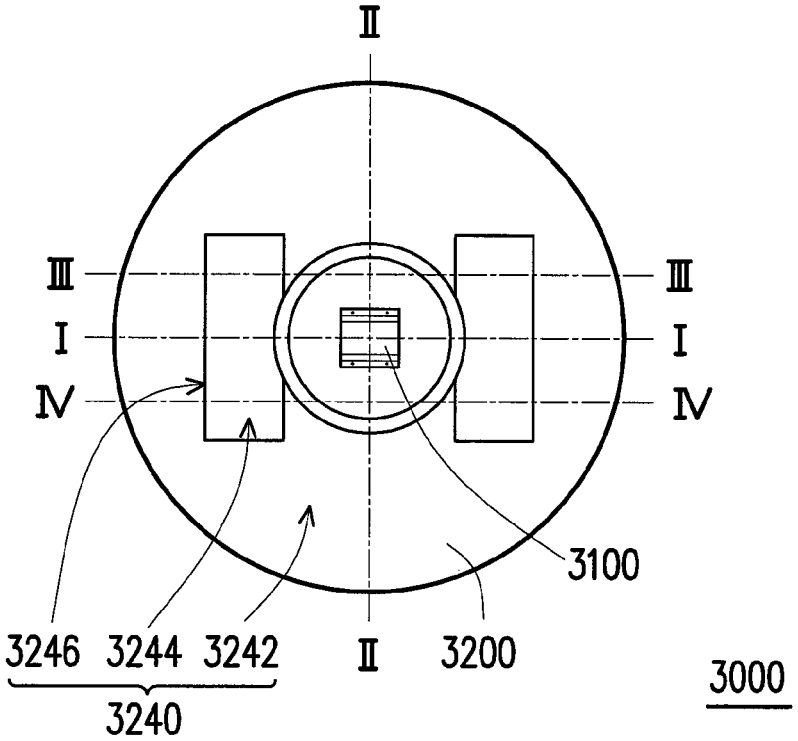
FIG. 1B is a rear view illustrating the vehicle illumination apparatus depicted in FIG. 1A.
Figure 1C:
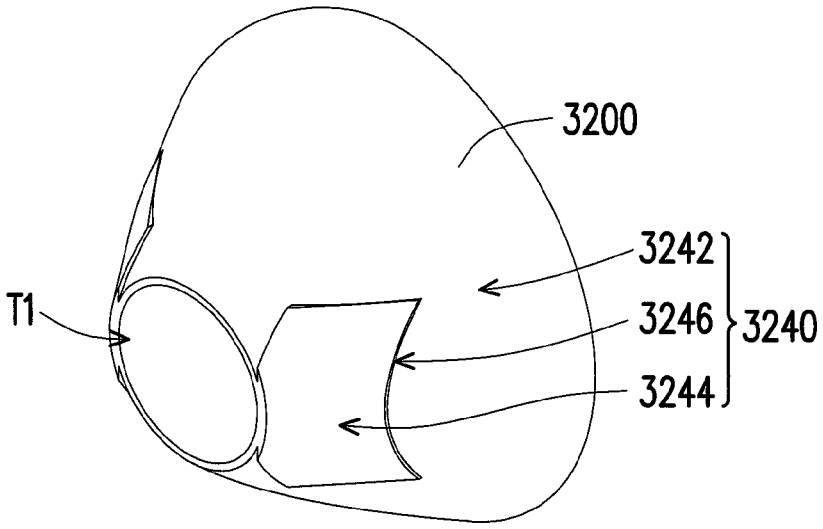
FIG. 1C is a schematic three-dimensional view briefly illustrating a first light guiding lens in the vehicle illumination apparatus depicted in FIG. 1A.
Figure 1D:
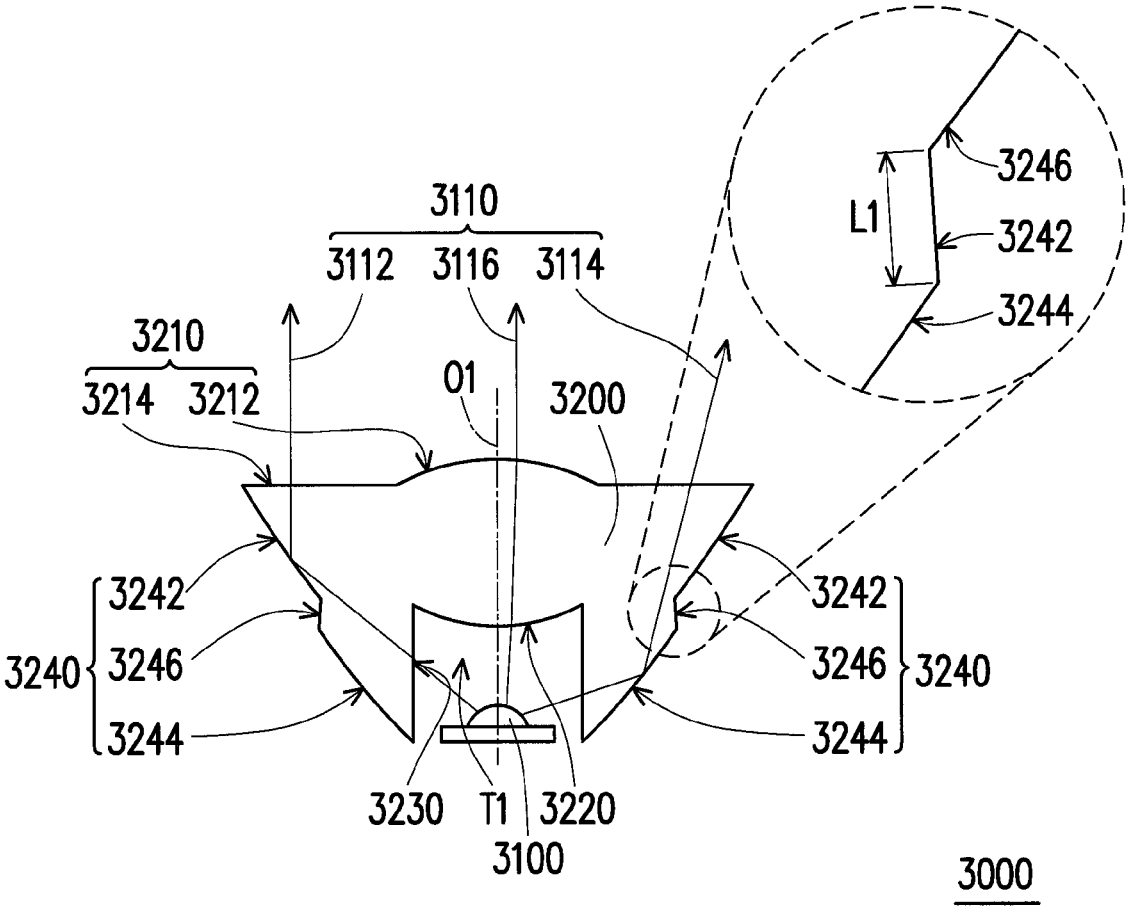
FIG. 1D is a schematic cross-sectional view of the vehicle illumination apparatus depicted in FIG. 1B along a line I-I.
Figure 1E:
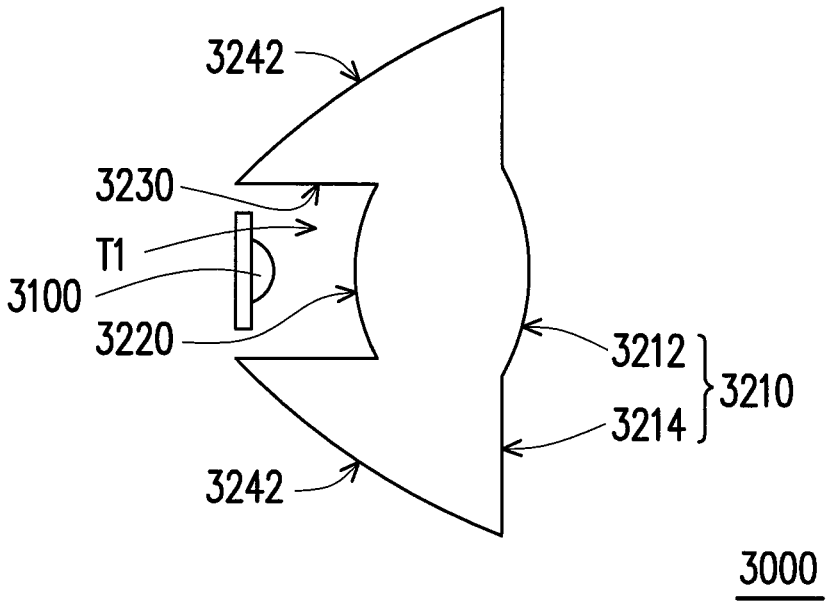
FIG. 1E is a schematic cross-sectional view of the vehicle illumination apparatus depicted in FIG. 1B along a line II-II.

FIG. 1A is a schematic three-dimensional view briefly illustrating a vehicle illumination apparatus according to an embodiment of the invention. FIG. 1B is a rear view illustrating the vehicle illumination apparatus depicted in FIG. 1A. FIG. 1C is a schematic three-dimensional view briefly illustrating a first light guiding lens in the vehicle illumination apparatus depicted in FIG. 1A. FIG. 1D is a schematic cross-sectional view of the vehicle illumination apparatus depicted in FIG. 1B along a line I-I. FIG. 1E is a schematic cross-sectional view of the vehicle illumination apparatus depicted in FIG. 1B along a line II-II. With reference to FIG. 1A to FIG. 1E, the vehicle illumination apparatus 3000 described in the present embodiment includes at least one first illumination light source 3100 and at least one first light guiding lens, and the first light guiding lens is a condensing and diverging lens 3200, for instance. In FIG. 1A to FIG. 1E, one first illumination light source 3100 and one condensing and diverging lens 3200 are exemplarily shown. The first illumination light source 3100 is capable of providing an illumination beam 3110. In the present embodiment, the first illumination light source 3100 is a light-emitting diode (LED), for instance. In other embodiments, however, the first illumination light source 3100 may be a halogen lamp or any other appropriate light emitting device. The condensing and diverging lens 3200 includes a first light transmissive surface 3210, a second light transmissive surface 3220 opposite to the first light transmissive surface 3210, an inner surrounding surface 3230, and an outer surrounding surface 3240. The first light transmissive surface 3210 is capable of projecting the first illumination beam 3110 out of the condensing and expanding lens 3200. The second light transmissive surface 3220 is smaller than the first light transmissive surface 3210. The inner surrounding surface 3230 and the second light transmissive surface 3220 are connected to each other and define a containing space T1 configured to accommodate the first illumination light source 3100. The outer surrounding surface 3240 is connected to the inner surrounding surface 3230 and the first light transmissive surface 3210. Besides, the outer surrounding surface 3240 expands toward the first light transmissive surface 3210 from a location where the inner surrounding surface 3230 is connected to the outer surrounding surface 3240. The expansion of the outer surrounding surface 3240 means the expansion from an opening of the containing space T1 to the first light transmissive surface 3210, and a projection area of the opening on the first light transmissive surface 3210 is smaller than the area of the first light transmissive surface 3210. The outer surrounding surface 3240 includes a reflection region that includes a light condensing region 3242 and at least one light diverging region 3244. In FIG. 1B, two light diverging regions 3244 are illustrated. A first sub-beam 3112 of the first illumination beam 3110 sequentially passes the inner surrounding surface 3230, is reflected by the light condensing region 3242, and passes the first light transmissive surface 3210. A second sub-beam 3114 of the first illumination beam 3110 sequentially passes the inner surrounding surface 3230, is reflected by the light diverging regions 3244, and passes the first light transmissive surface 3210. A divergence angle of the second sub-beam 3114 passing the first light transmissive surface 3210 is greater than a divergence angle of the first sub-beam 3112 passing the first light transmissive surface 3210.

Figure 2C:
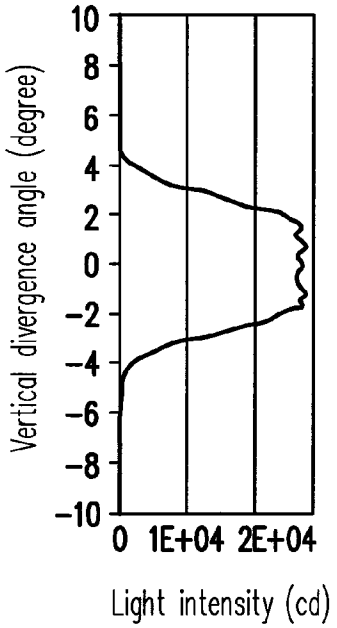
FIG. 2C is a curve diagram illustrating light intensity distribution on a vertical axis if the horizontal divergence angle shown in FIG. 2A is 0.
Figure 2A:
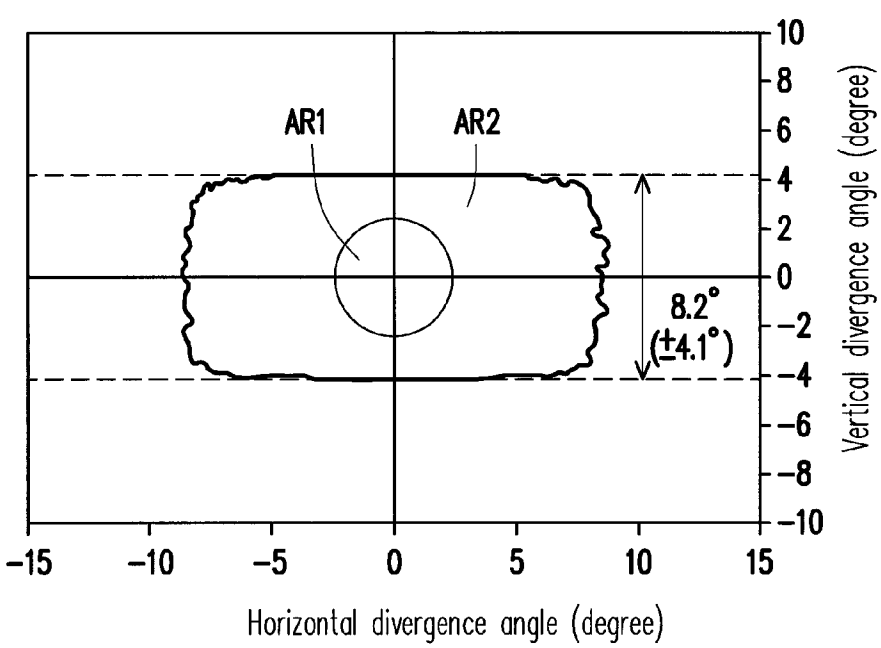
FIG. 2A is a schematic view illustrating an illumination angle range of the vehicle illumination apparatus depicted in FIG. 1A.
Figure 2B:
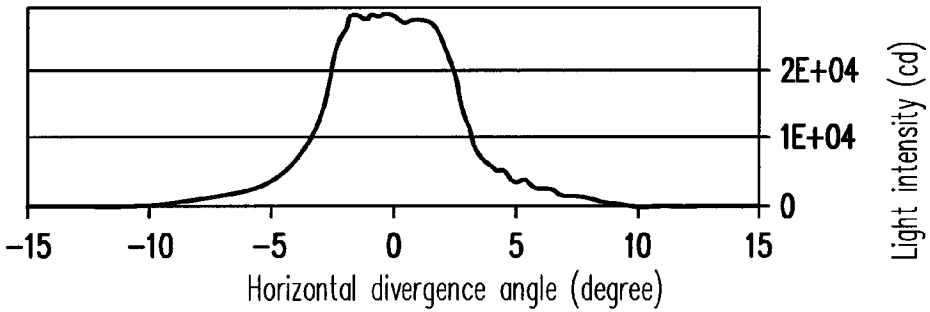
FIG. 2B is a curve diagram illustrating light intensity distribution on a horizontal axis if the vertical divergence angle shown in FIG. 2A is 0.

FIG. 2A is a schematic view illustrating an illumination angle range of the vehicle illumination apparatus depicted in FIG. 1A. FIG. 2B is a curve diagram illustrating light intensity distribution on a horizontal axis if the vertical divergence angle shown in FIG. 2A is 0. FIG. 2C is a curve diagram illustrating light intensity distribution on a vertical axis if the horizontal divergence angle shown in FIG. 2A is 0. With reference to FIG. 1D and FIG. 2A to FIG. 2C, the illumination angle range of the illumination beam 3110 projected from the vehicle illumination apparatus 3000 described in the present embodiment is shown in FIG. 2A. Here, the direction indicating that the horizontal angle and the vertical angle are both 0 is the direction of an optical axis O1 of the illumination light source 3100. The region AR1 denotes the illumination angle range of the first sub-beam 3112, and the region AR2 denotes the illumination angle range of the second sub-beam 3114. Here, the region AR2 covers the region AR1; that is, in the present embodiment, an irradiation range of the second sub-beam 3114 passing the first light transmissive surface 3210 covers an irradiation range of the first sub-beam 3112 passing the first light transmissive surface 3210. It can then be learned that the divergence angle of the second sub-beam 3114 is greater than the divergence angle of the first sub-beam 3112.

Besides, according to the present embodiment, a third sub-beam 3116 of the illumination beam 3110 sequentially passes the second light transmissive surface 3220 and the first light transmissive surface 3210, and the divergence angle of the second sub-beam 3114 passing the first light transmissive surface 3210 is greater than a divergence angle of the third sub-beam 3116 passing the first light transmissive surface 3210. The irradiation range of the third sub-beam 3116 may also fall within the region AR1, and hence it can be observed from FIG. 2A that the divergence angle of the second sub-beam 3114 is greater than the divergence angle of the third sub-beam 3116.

The vehicle illumination apparatus 3000 described in the present embodiment may serve as the high beam used in vehicle (e.g., automobiles or motorcycles). The reflection region of the condensing and diverging lens 3200 has the light condensing region 3242 that may condense the first sub-beam 3112 (e.g., by allowing the first sub-beam 3112 to be collimated), such that the vehicle illumination apparatus 3000 is able to provide strong forward light output and comply with the UN Economic Commission of Europe (ECE) regulations issued by the ECE on the high beam used in vehicle. In addition, the condensing and diverging lens 3200 also has the light diverging regions 3244, and therefore the vehicle illumination apparatus 3000 is also capable of providing the wide-range illumination.

According to the present embodiment, the irradiation range of the first sub-beam 3112 passing the first light transmissive surface 3210 is substantially located at a center of the irradiation range of the second sub-beam 3114 passing the first light transmissive surface 3210, as shown in FIG. 2A, such that the illumination region close to the optical axis O1 may have greater brightness. In addition, as illustrated in FIG. 2A to FIG. 2C, the divergence angle of the illumination beam 3110 emitted by the vehicle illumination apparatus 3000 is convergent in the vertical direction (the divergence angle is 8.2 degrees, for instance), such that the light intensity in the regions AR2 and AR1 may be enhanced, and that the illumination performance of the vehicle illumination apparatus 3000 can be ameliorated. Namely, in case that the electric power input of the illumination light source 3100 remains unchanged, the use of the condensing and diverging lens 3200 described herein may lead to an increase in the forward light output. Alternatively, if the forward light output stays unchanged, the use of the condensing and diverging lens 3200 described herein may ensure the low electric power input of the illumination light source 3100 without sacrificing the required forward light output. Thereby, energy may be saved, and the heat generated by the illumination light source 3100 can also be reduced.

Figure 3A:
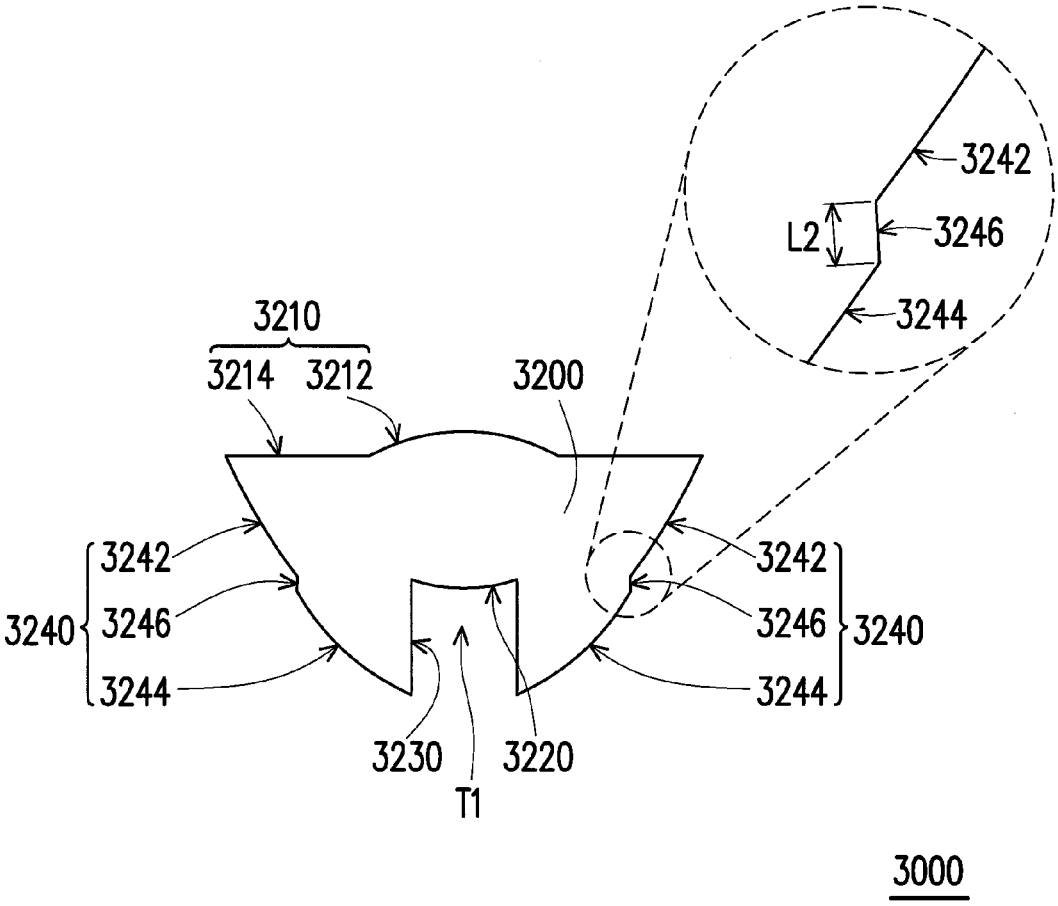
FIG. 3A is a schematic cross-sectional view of the vehicle illumination apparatus depicted in FIG. 1B along a line III-III.
Figure 3B:
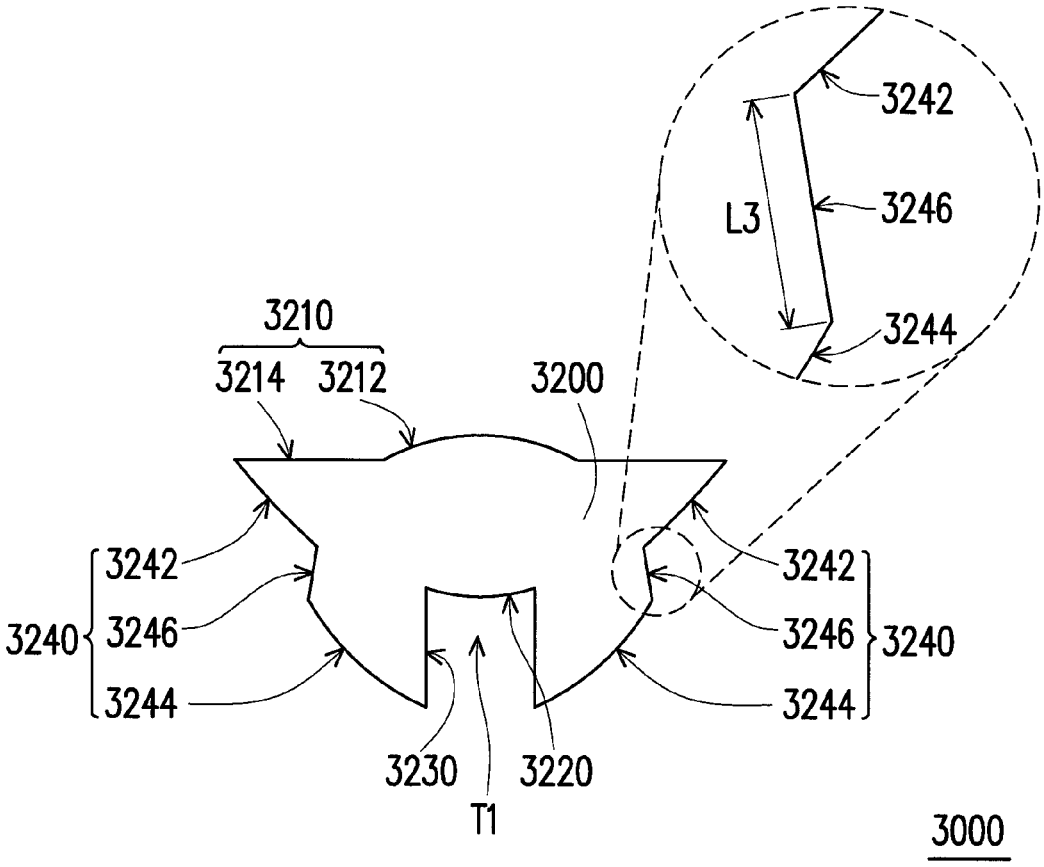
FIG. 3B is a schematic cross-sectional view of the vehicle illumination apparatus depicted in FIG. 1B along a line IV-IV.

FIG. 3A is a schematic cross-sectional view of the vehicle illumination apparatus depicted in FIG. 1B along a line FIG. 3B is a schematic cross-sectional view of the vehicle illumination apparatus depicted in FIG. 1B along a line IV-IV. With reference to FIG. 1B, FIG. 1D, FIG. 3A, and FIG. 3B, the outer surrounding surface 3240 has at least one step 3246 between the light condensing region 3242 and the light diverging regions 3244. According to the present embodiment, a width of the step 3246 is increased progressively along a direction perpendicular to the optical axis O1 of the illumination light source 3100, e.g., the vertical direction facing downward as shown in FIG. 1B. Besides, in the present embodiment, a curvature of the light diverging regions 3244 is increased progressively and then decreased progressively along the direction perpendicular to the optical axis O1 of the illumination light source 3100, e.g., the vertical direction facing downward as shown in FIG. 1B. For instance, the width L3 of the step 3246 on the IV-IV cross-section is greater than the width L1 of the step 3246 on the I-I cross-section, and the width L1 of the step 3246 on the I-I cross-section is greater than the width L2 of the step 3246 on the cross-section. Additionally, the curvature of the light diverging regions 3244 on the I-I cross-section is greater than the curvature of the light diverging regions 3244 on the cross-section and greater than the curvature of the light diverging regions 3244 on the IV-IV cross-section.

In the present embodiment, the first light transmissive surface 3210 has a protruding sub-surface 3212 located on the optical axis O1 of the illumination light source 3100. The first light transmissive surface 3210 may further have a sub-plane 3214 that surrounds the protruding sub-surface 3212 and is connected to the protruding sub-surface 3212. According to the present embodiment, the first sub-beam 3112 from the light condensing region 3242 may be transmitted to the external surroundings through the sub-plane 3214, the second sub-beam 3114 from the first light diverging regions 3244 may be transmitted to the external surroundings through the sub-plane 3214, and the third sub-beam 3116 from the second light transmissive surface 3220 may be transmitted to the external surroundings through the protruding sub-surface 3212. In the present embodiment, the second light transmissive surface 3220 is a protruding curved surface; therefore, after the third sub-beam 3116 described herein is condensed by the second light transmissive surface 3220 and the first light transmissive surface 3210, the collimated third sub-beam 3116 is generated and leaves the condensing and diverging lens 3200. In the vehicle illumination apparatus 3000 described herein, the first light transmissive surface 3210 has the protruding sub-surface 3212, and therefore the condensing and diverging lens 3200 can have a vivid look. Besides, the protruding sub-surface 3212 increases the thickness of the lens close to the optical axis O1, and thus the thickness of the condensing and diverging lens 3200 in a direction substantially parallel to the optical axis O1 is rather even. Thereby, when the condensing and diverging lens 3200 is formed by injection molding, the surface of the lens is less likely to be deformed, and the manufacturing yield of the condensing and diverging lens 3200 can be improved.

Figure 4:
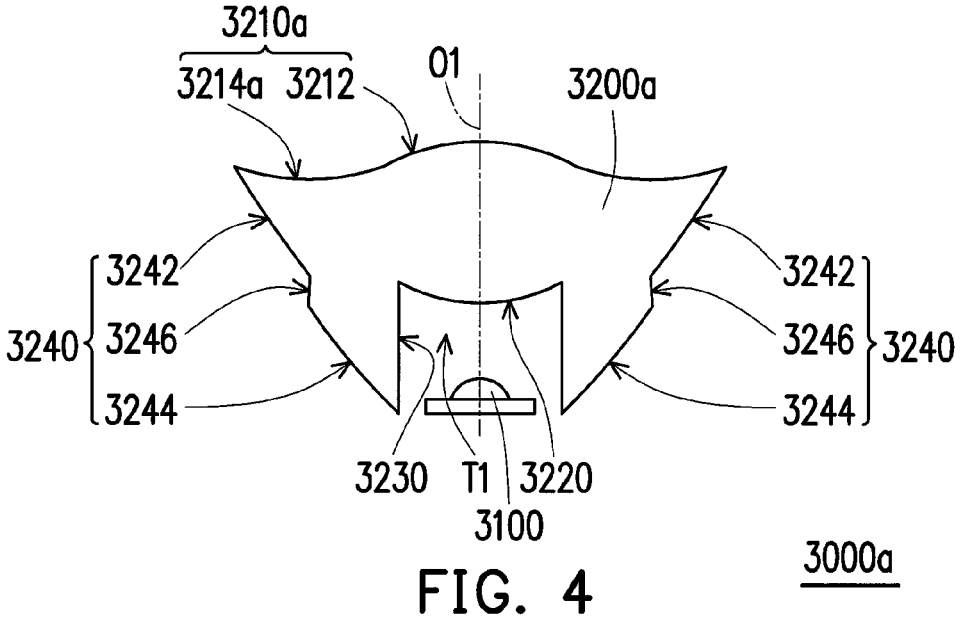
FIG. 4 is a schematic cross-sectional view illustrating a vehicle illumination apparatus according to another embodiment of the invention.

FIG. 4 is a schematic cross-sectional view illustrating a vehicle illumination apparatus according to another embodiment of the invention. With reference to FIG. 4 and FIG. 1D, the vehicle illumination apparatus 3000*a* described in the present embodiment is similar to the vehicle illumination apparatus 3000 depicted in FIG. 1D, and the difference therebetween is described below. In the vehicle illumination apparatus 3000*a*, the first light transmissive surface 3210*a* of the condensing and diverging lens 3200*a* has a ring-shaped concave surface 3214*a* that surrounds the protruding sub-surface 3212. Besides, in the present embodiment, the ring-shaped concave surface 3214*a* and the protruding sub-surface 3212 are smoothly connected to form a continuous curved surface.

According to the present embodiment, the first sub-beam 3112 from the light condensing region 3242 may be transmitted to the external surroundings through the ring-shaped concave surface 3214*a*, the second sub-beam 3114 from the light diverging regions 3244 may be transmitted to the external surroundings through the ring-shaped concave surface 3214*a*, and the third sub-beam 3116 from the second light transmissive surface 3220 may be transmitted to the external surroundings through the protruding sub-surface 3212.

Figure 5C:
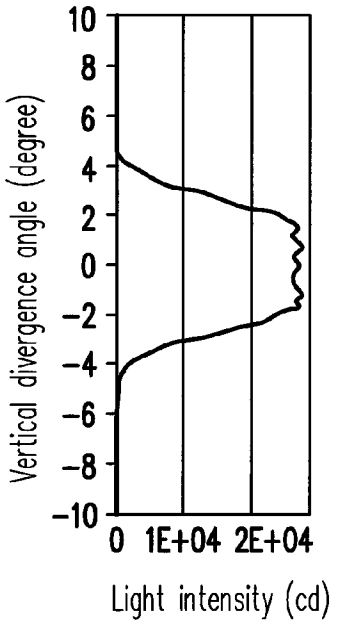
FIG. 5C is a curve diagram illustrating light intensity distribution on a vertical axis if the horizontal divergence angle shown in FIG. 5A is 0.
Figure 5A:
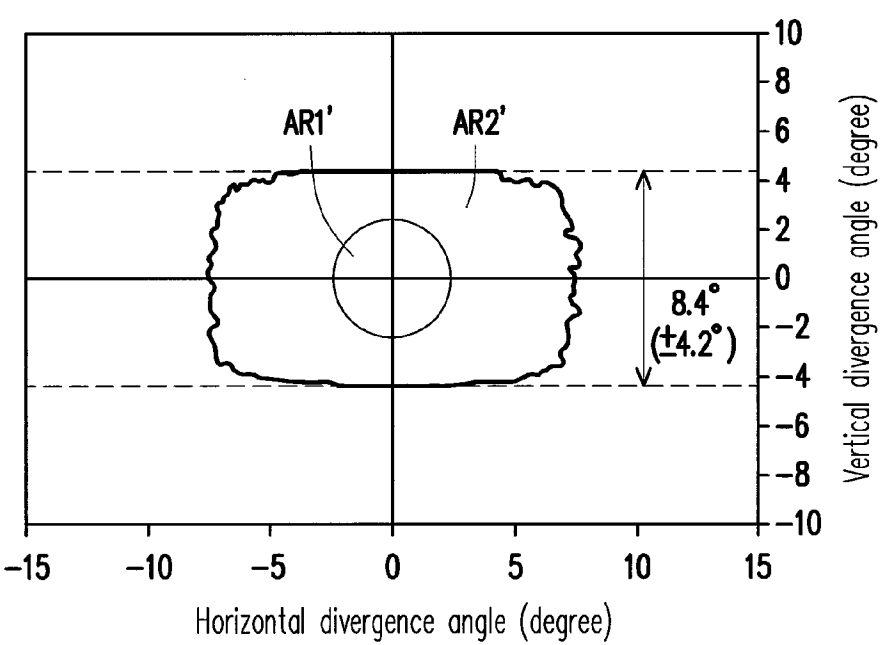
FIG. 5A is a schematic view illustrating an illumination angle range of the vehicle illumination apparatus depicted in FIG. 4.
Figure 5B:
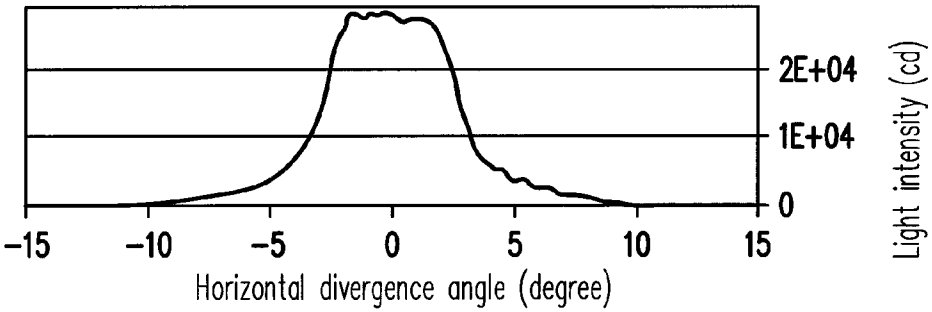
FIG. 5B is a curve diagram illustrating light intensity distribution on a horizontal axis if the vertical divergence angle shown in FIG. 5A is 0.

FIG. 5A is a schematic view illustrating an illumination angle range of the vehicle illumination apparatus depicted in FIG. 4. FIG. 5B is a curve diagram illustrating light intensity distribution on a horizontal axis if the vertical divergence angle shown in FIG. 5A is 0. FIG. 5C is a curve diagram illustrating light intensity distribution on a vertical axis if the horizontal divergence angle shown in FIG. 5A is 0. Here, the direction indicating that the horizontal angle and the vertical angle are both 0 is the direction of the optical axis O1 of the illumination light source 3100. As illustrated in FIG. 4 and FIG. 5A to FIG. 5C, the divergence angle of the illumination beam 3110 emitted by the vehicle illumination apparatus 3000*a* is convergent in the vertical direction (the divergence angle is 8.4 degrees, for instance), such that the light intensity in the regions AR2' and AR1' may be enhanced, and that the illumination performance of the vehicle illumination apparatus 3000*a* can be ameliorated.

Figure 6:
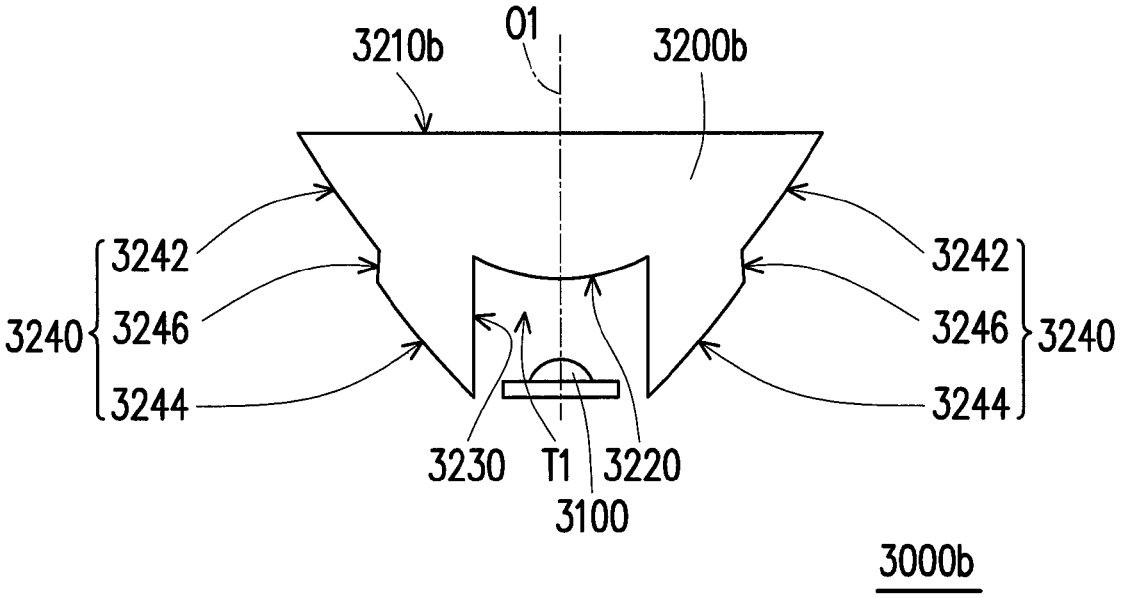
FIG. 6 is a schematic cross-sectional view illustrating a vehicle illumination apparatus according to yet another embodiment of the invention.

FIG. 6 is a schematic cross-sectional view illustrating a vehicle illumination apparatus according to yet another embodiment of the invention. With reference to FIG. 6 and FIG. 1D, the vehicle illumination apparatus 3000*b* described in the present embodiment is similar to the vehicle illumination apparatus 3000 depicted in FIG. 1D, and the difference therebetween is described below. In the vehicle illumination apparatus 3000*b*, the first light transmissive surface 3210*b* of the condensing and diverging lens 3200*b* is a plane.

Figure 7:
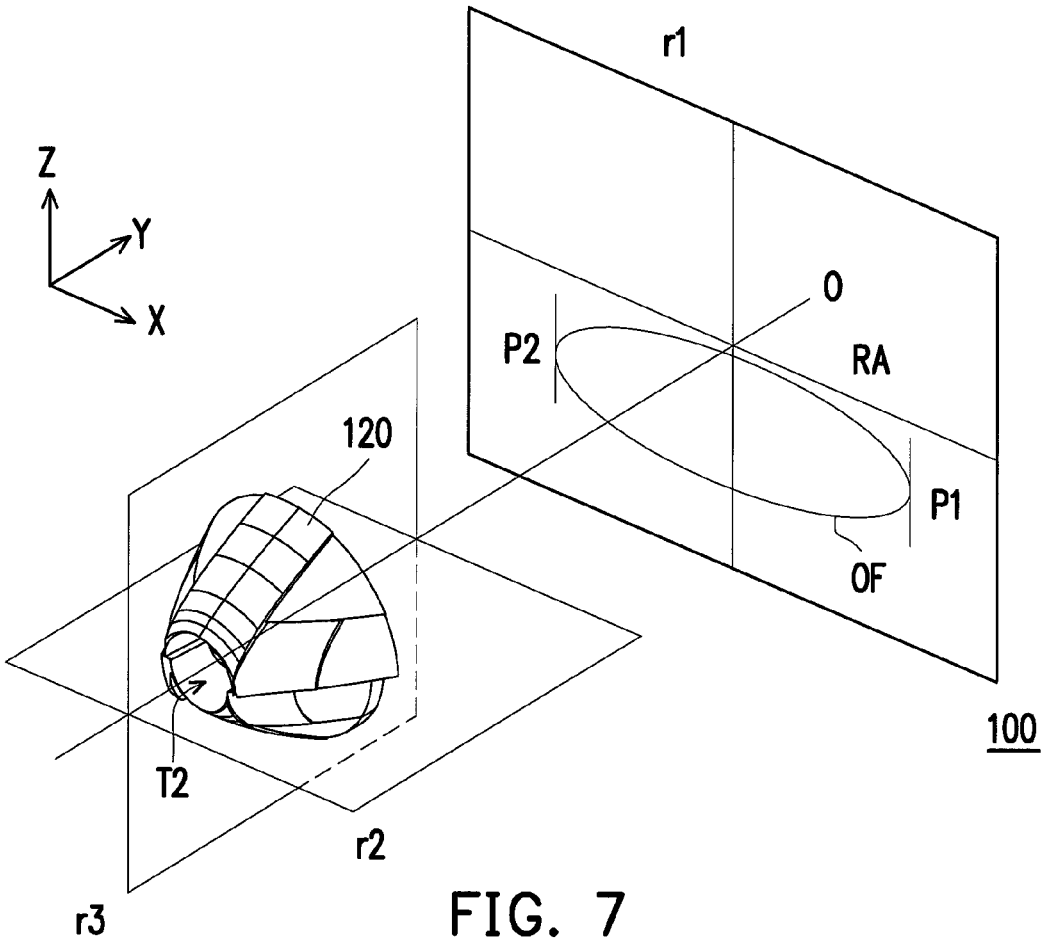
FIG. 7 is a schematic three-dimensional view briefly illustrating a vehicle illumination apparatus according to another embodiment of the invention.
Figure 8A:
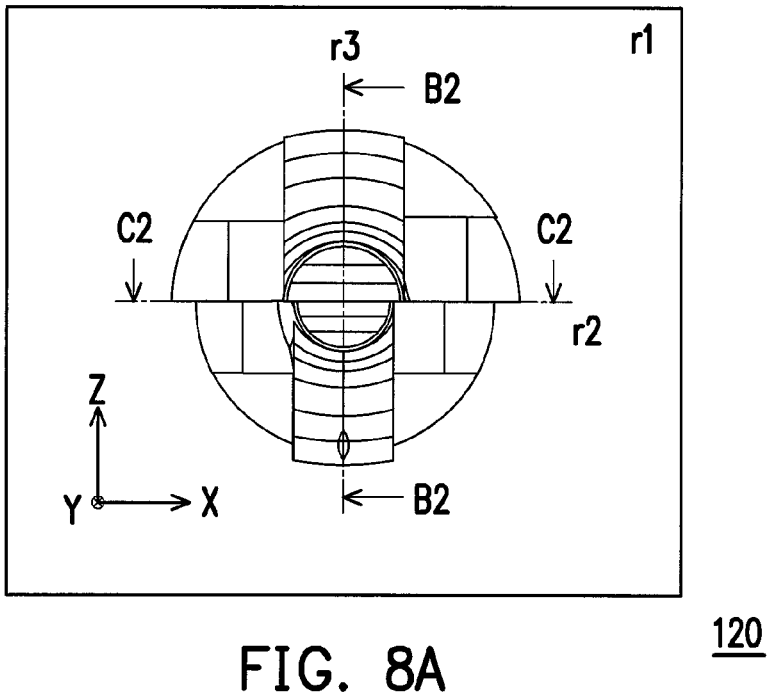
FIG. 8A is a schematic rear view illustrating the vehicle illumination apparatus depicted in FIG. 7.
Figure 8B:
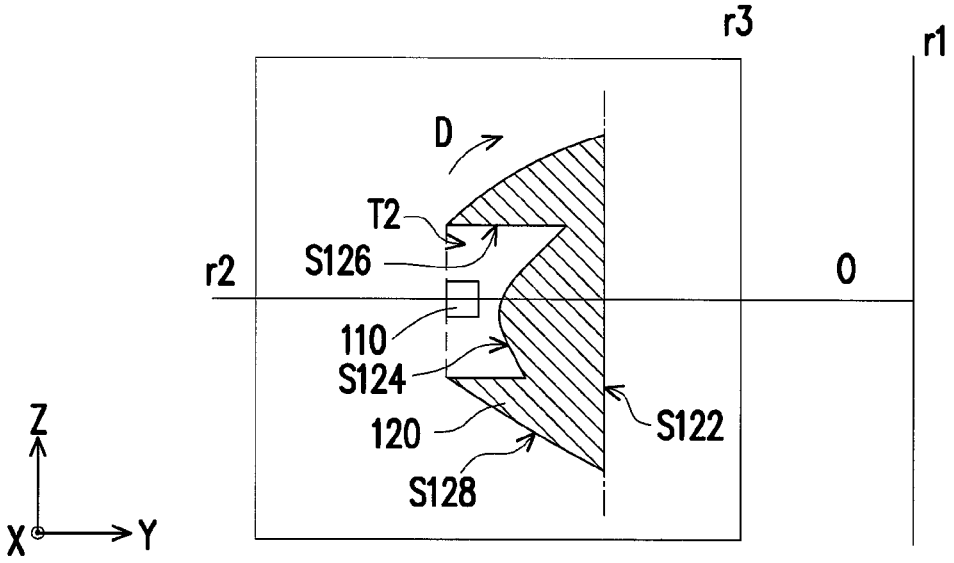
FIG. 8B is a schematic cross-sectional view of the vehicle illumination apparatus depicted in FIG. 8A along a section line B2-B2.
Figure 8C:
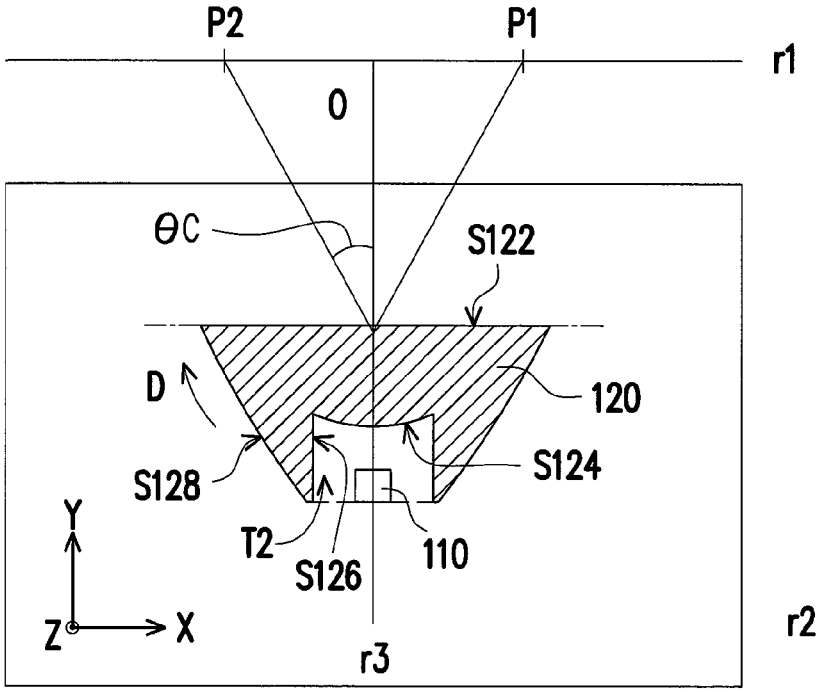
FIG. 8C is a schematic cross-sectional view of the vehicle illumination apparatus depicted in FIG. 8A along a section line C2-C2.

FIG. 7 is a schematic three-dimensional view briefly illustrating a vehicle illumination apparatus according to another embodiment of the invention. FIG. 8A is a schematic rear view illustrating the vehicle illumination apparatus depicted in FIG. 7. FIG. 8B and FIG. 8C are schematic cross-sectional views of the vehicle illumination apparatus depicted in FIG. 8A along section lines B2-B2 and C2-C2. With reference to FIG. 7 to FIG. 8C, the vehicle illumination apparatus 100 described in the present embodiment includes an illumination light source 110 and a second light guiding lens, and the second light guiding lens is a collimating lens 120, for instance. It should be mentioned that in order to clearly illustrate the collimating lens 120, a situation that the illumination light source 110 is placed in the second containing space T2 of the collimating lens 120 is not illustrated in FIG. 7 and FIG. 8A. Besides, the illumination light source 3100 and the illumination light source 110 are not required to be turned on at the same time, and it is likely to selectively turn on the illumination light source 3100 or the illumination light source 110.

In the present embodiment, the collimating lens 120 serves to project the second illumination beam provided by the illumination light source 110 out of the collimating lens 120 through a first light transmissive surface S122 of the collimating lens 120. Specifically, the collimating lens 120 includes the first light transmissive surface S122, a second light transmissive surface S124, an inner surrounding surface S126, and an outer surrounding surface S128. The first light transmissive surface S122, the second light transmissive surface S124, the inner surrounding surface S126, and the outer surrounding surface S128 together define the profile of the collimating lens 120, and the second light transmissive surface S124 is smaller than the first light transmissive surface S122. In the present embodiment, the first light transmissive surface S122 is capable of projecting the second illumination beam out of the collimating lens 120. The second light transmissive surface S124 is opposite to the first light transmissive surface S122. The second light transmissive surface S124 is mirror-asymmetrical relative to a second reference plane r2 parallel to an optical axis O of the second illumination light source 110, i.e., up-down asymmetry; the second light transmissive surface S124 is mirror-symmetrical relative to a third reference plane r3 parallel to the optical axis O of the illumination light source 110, i.e., left-right symmetry. In the present embodiment, the optical axis O of the illumination light source 110 is extended along a Y direction, the third reference plane r3 is parallel to a Z direction, and the second reference plane r2 is parallel to an X direction.

In the present embodiment, the inner surrounding surface S126 and the second light transmissive surface S124 collectively define the second containing space T2 configured to accommodate the illumination light source 110. The outer surrounding surface S128 is connected to the inner surrounding surface S126 and the first light transmissive surface S122. Besides, the outer surrounding surface S128 expands toward the first light transmissive surface S122 from a location where the inner surrounding surface S126 is connected to the outer surrounding surface S128. The expansion of the outer surrounding surface S128 means the expansion from an opening of the containing space T2 to the first light transmissive surface S122, and a projection area of the opening on the first light transmissive surface S122 is smaller than the area of the first light transmissive surface S122. That is, the outer surrounding surface S128 expands to the first light transmissive surface S122 from the opening of the containing space T2 along a direction D.

Hence, based on total reflection and refraction principles, the illumination beam emitted from the illumination light source 110 is transmitted within the collimating lens 120.

Specifically, the illumination beam enters the collimating lens 120 through the second light transmissive surface S124 and the inner surrounding surface S126 and is then projected out of the collimating lens 120 along the optical axis O of the illumination light source 110 through the first light transmissive surface S122. When the illumination beam is transmitted within the collimating lens 120, parts of (or all) the illumination beam may be reflected (or totally reflected) by the outer surrounding surface S128.

A light pattern OF of the illumination beam projected out of the collimating lens 120 is measured on a first reference plane r1 intersecting the optical axis O of the illumination light source 110 at a point, and the measured light pattern OF is substantially distributed over one side of a reference line RA on the first reference plane r1. In FIG. 7, the first reference plane r1 is perpendicular to the optical axis O of the illumination light source 110, the reference line RA is a horizontal line, and the light pattern OF is located below the reference line RA, which should however not be construed as a limitation to the invention. In other embodiments, the first reference plane r1 can be non-perpendicular to the optical axis O of the illumination light source 110, the reference line RA is a plumb line or any other polyline or curved line, and the light pattern OF is distributed over one side of the reference line RA.

According to the structural configuration of the collimating lens 120, in the present embodiment, different regions of the outer surrounding surface S128 are designed to have different curved surfaces, so as to obtain the divergent light patterns at different angles.

Figure 9:
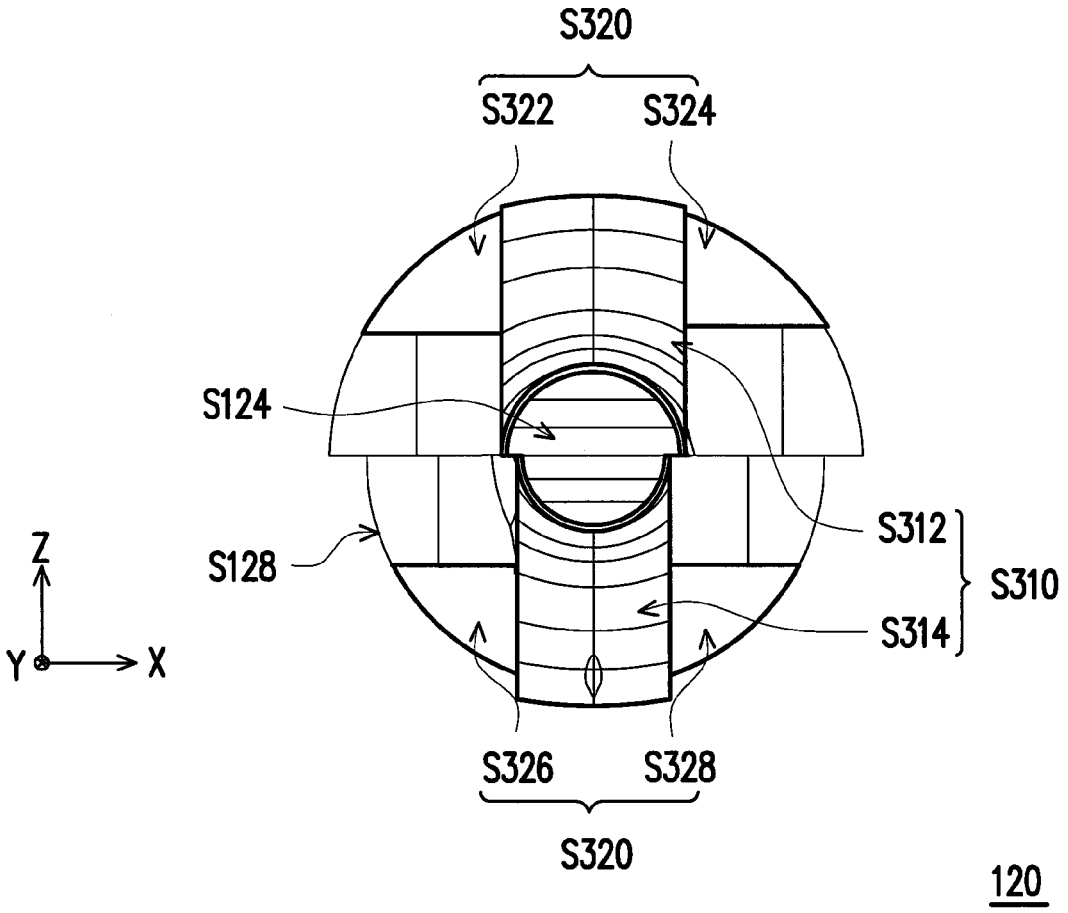
FIG. 9 is a schematic view briefly illustrating the outer surrounding surface S128 according to the present embodiment.

FIG. 9 is a schematic view briefly illustrating the outer surrounding surface S128 according to the present embodiment. With reference to FIG. 9, the second outer surrounding surface S128 described in the present embodiment includes a plurality of reflection regions. Each of the reflection regions is a continuous curved surface, and the neighboring reflection regions have a step therebetween to adaptively adjust the light pattern of the illumination beam. Based on different influences by the reflection regions on the light pattern of the illumination beam projected out of the collimating lens 120, the reflection regions may be divided into a light diverging region S310 and a light condensing region S320, which are respectively described below.

Figure 10A:
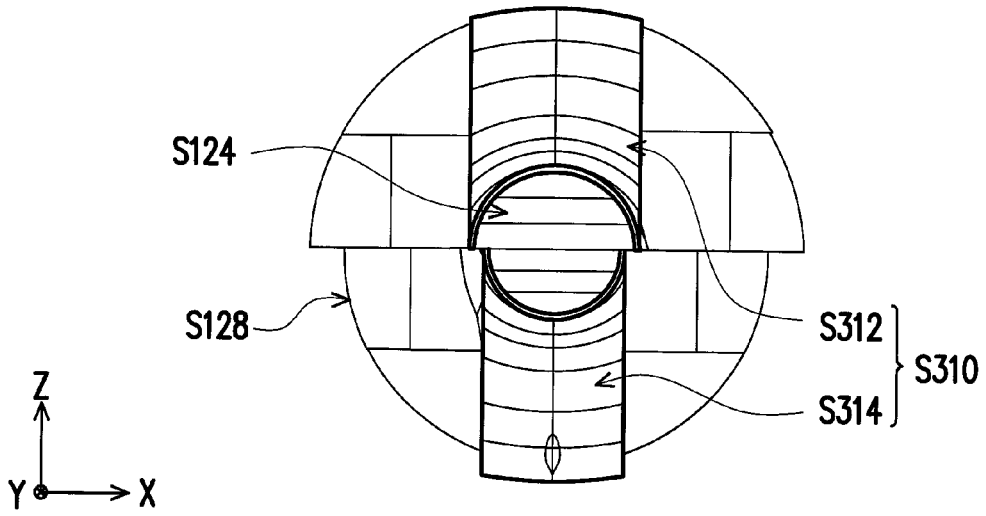
FIG. 10A is a schematic view briefly illustrating the light diverging region S310 according to the present embodiment.
Figure 10B:
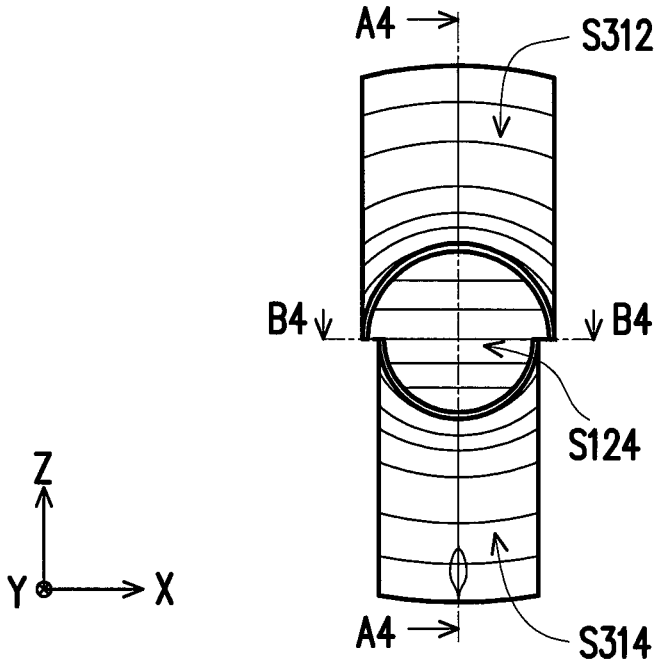
FIG. 10B is a schematic rear view illustrating the light diverging region S310 according to the present embodiment.
Figure 10C:
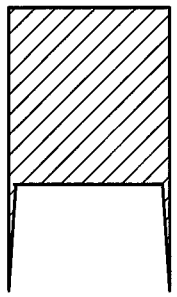
FIG. 10C is a schematic cross-sectional view of the light diverging region depicted in FIG. 10B along a section line B4-B4.
Figure 10D:
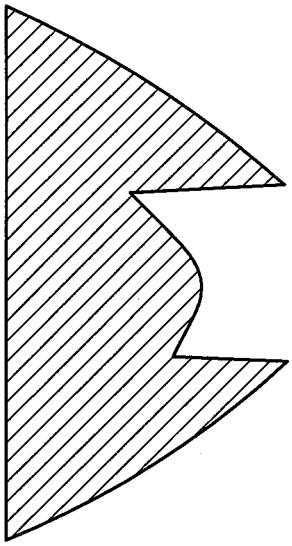
FIG. 10D is a schematic cross-sectional view of the light diverging region depicted in FIG. 10B along a section line A4-A4.
Figure 10E:
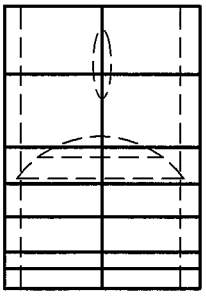
FIG. 10E is a schematic top view illustrating the light diverging region depicted in FIG. 10B.
Figure 10F:
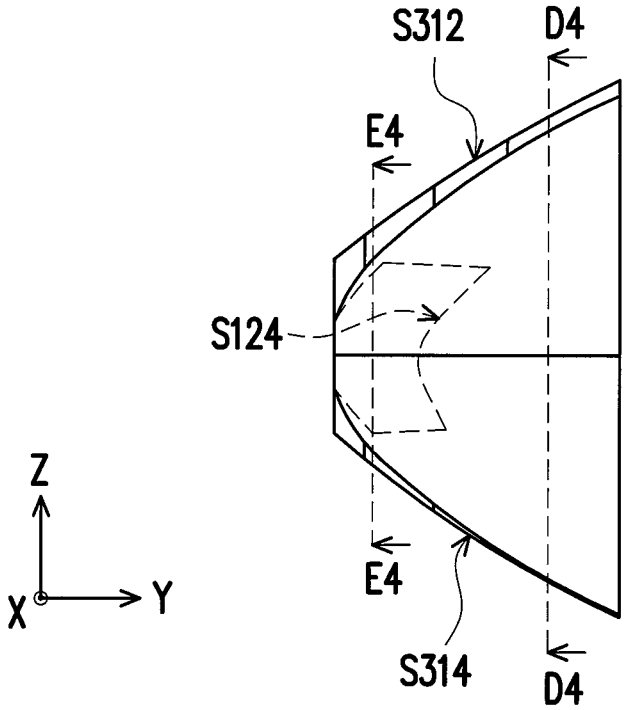
FIG. 10F is a schematic side view illustrating the light diverging region depicted in FIG. 10B.
Figure 10G:
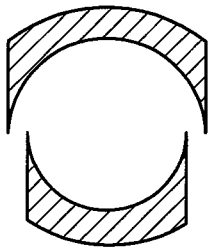
FIG. 10G is a schematic cross-sectional view of the light diverging region depicted in FIG. 10F along a section line E4-E4.
Figure 10H:
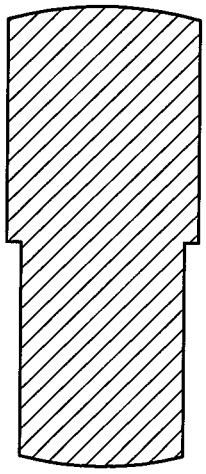
FIG. 10H is a schematic cross-sectional view of the light diverging region depicted in FIG. 10F along a section line D4-D4.

FIG. 10A is a schematic view briefly illustrating the light diverging region S310 according to the present embodiment. FIG. 10B is a schematic rear view illustrating the light diverging region S310 according to the present embodiment. FIG. 10C is a schematic cross-sectional view of the light diverging region depicted in FIG. 10B along a section line B4-B4. FIG. 10D is a schematic cross-sectional view of the light diverging region depicted in FIG. 10B along a section line A4-A4. FIG. 10E is a schematic top view illustrating the light diverging region depicted in FIG. 10B. FIG. 10F is a schematic side view illustrating the light diverging region depicted in FIG. 10B. FIG. 10G is a schematic cross-sectional view of the light diverging region depicted in FIG. 10F along a section line E4-E4. FIG. 10H is a schematic cross-sectional view of the light diverging region depicted in FIG. 10F along a section line D4-D4. With reference to FIG. 10A to FIG. 10H, the light diverging region S310 described herein includes a plurality of sub light diverging regions, e.g., a first sub light diverging region S312 and a second sub light diverging region S314. Each of the first sub light diverging region S312 and the second sub light diverging region S314 is a continuous curved surface, and there are steps between the first/second sub light diverging region S312/S314 and the neighboring reflection regions. For instance, as shown in FIG. 9, a step exists between the first sub light diverging region S312 and the sub light condensing region S322 of the second light condensing region S320, and a step exists between the first sub light diverging region S312 and the sub light condensing region S324 of the light condensing region S320 as well. Similarly, a step exists between the second sub light diverging region S314 and the neighboring reflection regions. How the sub light diverging regions pose an impact on the light pattern of the illumination beam projected out of the collimating lens 120 is described below.

Figure 17:
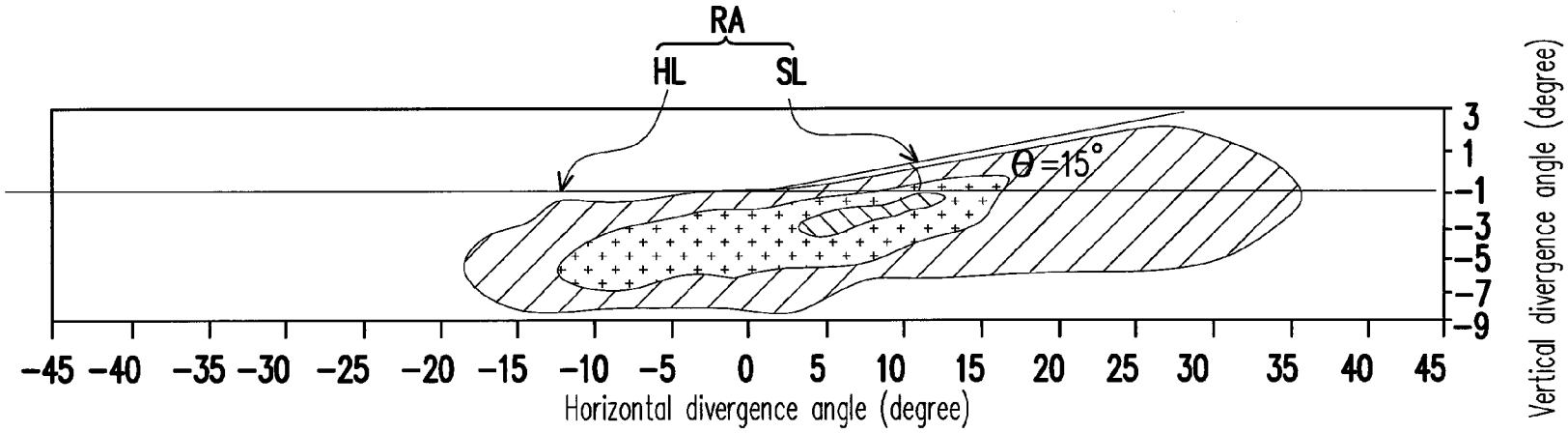
FIG. 17 is a schematic view illustrating a light pattern of the second illumination beam functioned by the specific angle-forming regions S830 and S840 and projected out of the collimating lens.

With reference to FIG. 7 and FIG. 8C, a light pattern OF of a portion of the illumination beam projected out of the collimating lens 120 is measured on the first reference plane r1, the measured light pattern OF is distributed under the reference line RA. An angle θC is included between the optical axis O of the illumination light source 110 and a connection line between a center point of the first light transmissive surface S122 and an endpoint P1 or P2 of the light pattern OF at the maximum width in a direction parallel to the reference line RA, and the included angle θC is defined as a horizontal divergence angle. As shown in FIG. 17, the horizontal divergence angle θC at the intersection between the optical axis O of the illumination light source 110 and the first reference plane r1 and the reference line RA is equal to 0 degree, positive angles are at the right side of the intersection, and negative angles are at the left side of the intersection.

After the illumination beam described in the present embodiment is functioned by the first sub light diverging region S312, the light pattern of the illumination beam projected out of the collimating lens 120 is distributed under the horizontal reference line RA, and the horizontal divergence angle θC is within a first angle range between +15 degrees. By contrast, after the illumination beam is functioned by the second sub light diverging region S314, the light pattern of the illumination beam projected out of the collimating lens 120 is distributed under the horizontal reference line RA, and the horizontal divergence angle θC is within a second angle range between ±20 degrees. Although the exemplary first angle range and the exemplary second angle range described herein are +15 degrees and ±20 degrees, respectively, the values and the "±" sign should not be construed as limitations to the invention. In other words, after the illumination beam is functioned by each sub light diverging region, the measured light pattern of the second illumination beam on the first reference plane r1 is distributed under the reference line RA and within the range of the corresponding horizontal divergence angle θC.

Figure 11:
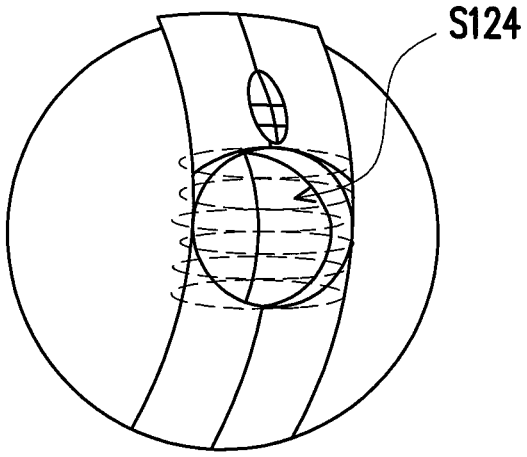
FIG. 11 is a schematic view briefly illustrating the second light transmissive surface observed from another view angle according to the present embodiment.
Figure 12:
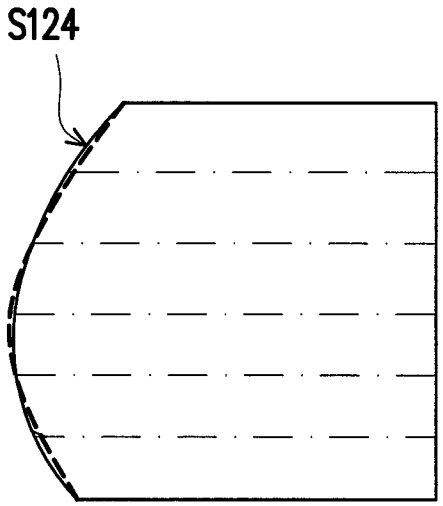
FIG. 12 is a schematic cross-sectional view of the second light transmissive surface correspondingly depicted in FIG. 11.

In the present embodiment, as the illumination beam is functioned by the second light transmissive surface S124, the light pattern of the second illumination beam is also diverged and distributed within the third angle range of the horizontal divergence angle θC. FIG. 11 is a schematic view briefly illustrating the second light transmissive surface observed from another view angle according to the present embodiment. FIG. 12 is a schematic cross-sectional view of the second light transmissive surface correspondingly depicted in FIG. 11. With reference to FIG. 11 and FIG. 12, the second light transmissive surface S124 is approximately divided into a plurality of curved surfaces having different curvatures. For instance, 6 curved surfaces are shown in FIG. 11. In FIG. 12, dotted lines show the profiles of the curved surfaces of the second light transmissive surface S124 along a center section line of the second light transmissive surface S124 (i.e. the third reference plane), and solid lines show the profiles of the curved surfaces of the second light transmissive surface S124 along two side section lines of the second light transmissive surface S124. Although the second light transmissive surface S124 can be divided into a plurality of curved surfaces having different curvatures, the second light transmissive surface S124 constituted by the curved surfaces with different curvatures is a continuous surface, and the curved surfaces with different curvatures have no step therebetween. Moreover, in order to clearly demonstrate the second light transmissive surface S124, the steps existing between the other surfaces are not illustrated in FIG. 11.

According to the design of the curved surfaces of the second light transmissive surface S124, the curvatures of the curved surfaces constituting the second light transmissive surface S124 may be respectively adjusted. Thereby, in the present embodiment, the light pattern of the illumination beam functioned by the second light transmissive surface S124 and projected out of the collimating lens 120 is distributed under the horizontal reference line RA, and the horizontal divergence angle θC is within the third angle range between ±40 degrees. Although the exemplary third angle range described herein is ±40 degrees, the value and the "±" sign should not be construed as limitations to the invention.

In an embodiment of the invention, the illumination beam is functioned by the first sub light diverging region S312, the second sub light diverging region S314, and the second light transmissive surface S124, and thus the light pattern of the illumination beam is diverged (i.e., all belonging to the light diverging region), and the so-called light divergence provided in the present embodiment is mainly defined by the horizontal divergence angle θC. When the illumination beam is functioned by the reflection regions of the collimating lens 120, and the horizontal divergence angle θC of the light pattern distribution of the illumination beam on the first reference plane r1 is greater than ±5 degrees, each second reflection region is defined as the light diverging region, and the angle range between ±5 degrees is defined as a critical angle range. However, the value of the critical angle range should not be construed as a limitation to the invention. In the present embodiment, when the light pattern of the illumination beam projected out of the collimating lens 120 is adjusted to be under the horizontal reference line RA by each light diverging region, the light intensity above the horizontal reference line RA is weakened, so as to form a clear cut-off line.

Figure 13:
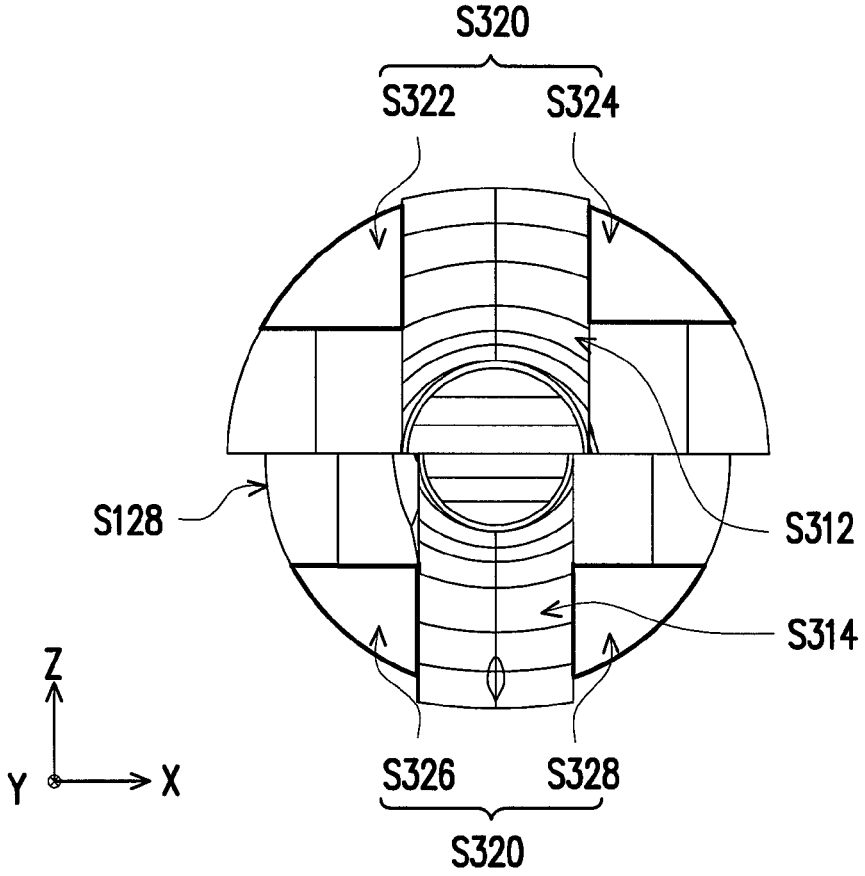
FIG. 13 is a schematic view briefly illustrating the light condensing region S320 according to the present embodiment.
Figure 14:
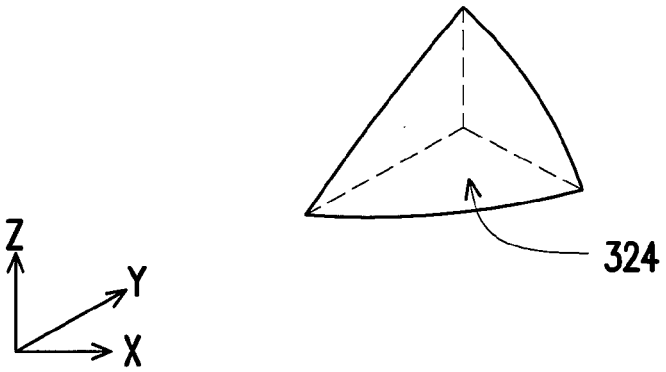
FIG. 14 a schematic three-dimensional view illustrating a sub light condensing region S324.

On the other hand, in addition to the light diverging region, the outer surrounding surface S128 described in the present embodiment also includes a light condensing region S320. FIG. 13 is a schematic view briefly illustrating the light condensing region S320 according to the present embodiment. FIG. 14 a schematic three-dimensional view illustrating a sub light condensing region S324. With reference to FIG. 13 and FIG. 14, the light condensing region S320 described in the present embodiment includes a plurality of sub light condensing regions S322, S324, S326, and S328. In the present embodiment, the sub light condensing regions S322 and S324 are arranged at two sides of the first sub light diverging region S312, and the sub light condensing regions S326 and S328 are arranged at two sides of the second sub light diverging region S314. According to the present embodiment of the invention, each of the sub light condensing regions is a continuous curved surface, and a step is between each of the sub light condensing regions and the adjacent reflection regions. For instance, as shown in FIG. 9, a step exists between the first sub light diverging region S312 and the sub light condensing region S322, and a step exists between the first sub light diverging region S312 and the sub light condensing region S324 as well. Similarly, a step exists between the second sub light diverging region S314 and the sub light condensing region S326, and a step exists between the second sub light diverging region S314 and the sub light condensing region S328 as well. How the sub light condensing regions pose an impact on the light pattern of the second illumination beam projected out of the collimating lens 120 is described below.

The sub light condensing region S324 is taken for example. With reference to FIG. 14, after the illumination beam described in the present embodiment is functioned by the sub light condensing region S324, a light pattern of the illumination beam projected out of the collimating lens 120 is distributed under the horizontal reference line RA, and the horizontal divergence angle θC is within a critical angle range between ±5 degrees. Although the exemplary threshold angle range described herein is ±5 degrees, the value and the "±" sign should not be construed as limitations to the invention. In other words, after the illumination beam described in the present embodiment is functioned by each sub light condensing region, the light pattern of the illumination beam is distributed under the horizontal reference line RA, and the horizontal divergence angle θC is smaller than or equal to the critical angle range, which is a definition of "light condensation" in the present embodiment. Namely, after the illumination beam described in the present embodiment is functioned by each sub light condensing region, the light pattern of the illumination beam is distributed under the horizontal reference line RA, and the horizontal divergence angle θC is smaller than or equal to the critical angle range. Here, each reflection region refers to the light condensing region.

In conclusion, according to the present embodiment, after the illumination beam is functioned by the reflection regions of the outer surrounding surface and the second light transmissive surface, the light pattern of the illumination beam is substantially distributed under the reference line RA. Said light pattern distribution ensures the illumination apparatus described herein to comply with the UN ECE regulations issued by the ECE when the illumination apparatus is applied to vehicle. Specifically, according to the UN ECE regulations, a low beam of a vehicle illumination apparatus has to comply with a standard that a main light pattern of the illumination beam is distributed under the horizontal cut-off line. Here, a clarity coefficient of the cut-off line is defined as G, and the clarity coefficient G is determined by vertically scanning a horizontal section of the cut-off line from a V-V line to a 2.5-degree location:

$$G=(\log E\beta-\log E(\beta+0.1°))$$

Here, E is a measured value of the actual illumination, a unit thereof is lx, β is a position along a vertical direction, and a unit thereof is angle. G is not less than 0.13 (the minimum clarity coefficient) and is not greater than 0.40 (the maximum clarity coefficient). Other test details are introduced in the UN ECE regulations and will not be described hereinafter.

Moreover, the UN ECE regulations further specify that an included angle between the horizontal cut-off line and a boundary of the part of the light pattern of the illumination beam of the vehicle illumination apparatus which exceeds the cut-off line cannot be greater than 15 degrees, which is described in detail below.

Figure 15A:
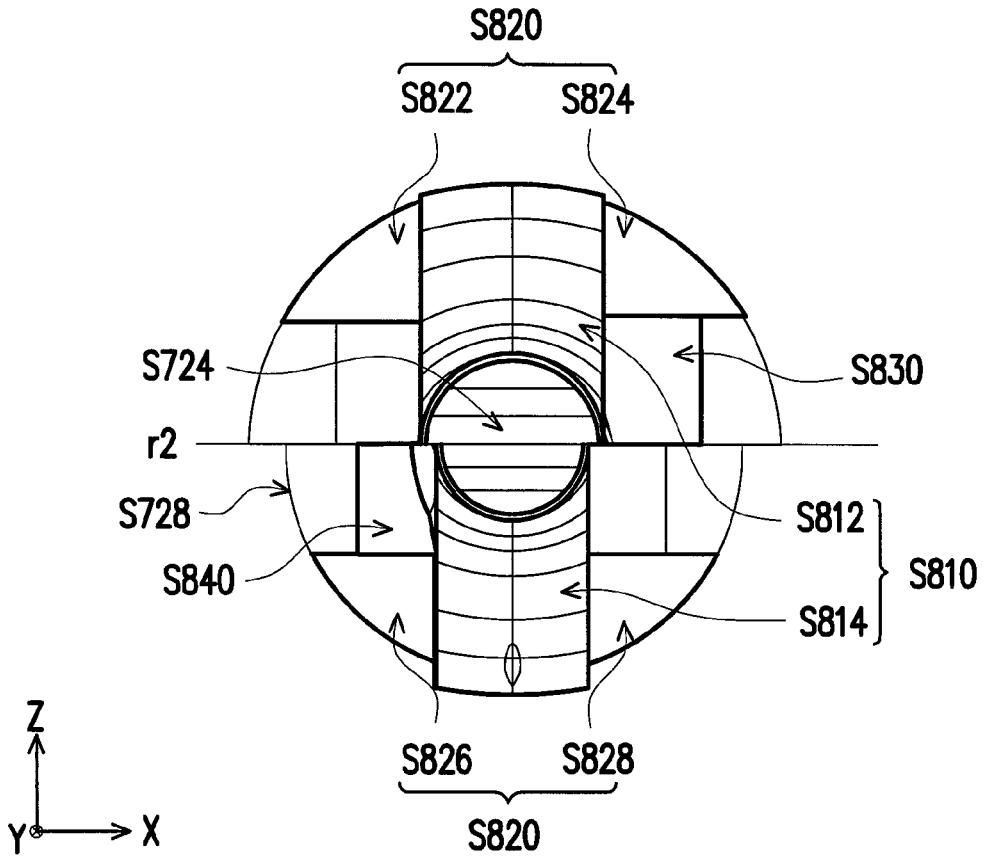
FIG. 15A is a schematic view briefly illustrating an outer surrounding surface S728 according to another embodiment of the invention.
Figure 15B:
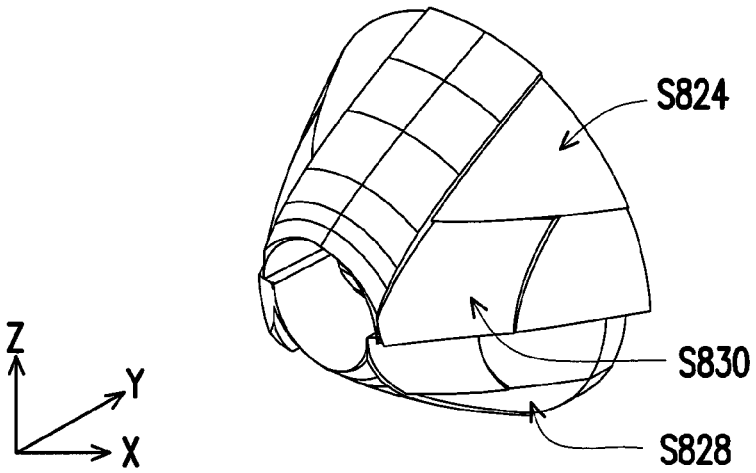
FIG. 15B is a schematic view briefly illustrating the outer surrounding surface S728 depicted in FIG. 15A from another view angle.
Figure 16:
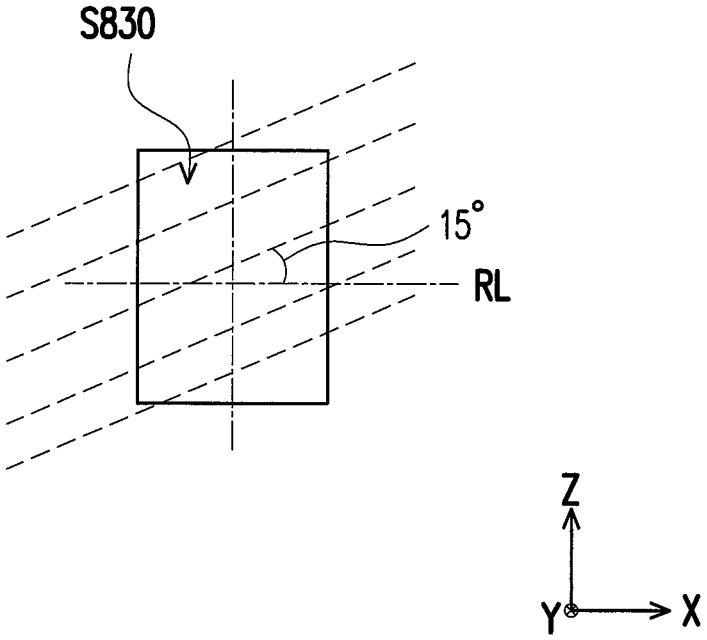
FIG. 16 is a schematic rear view illustrating a specific angle-forming region S830.

FIG. 15A is a schematic view briefly illustrating an outer surrounding surface S728 according to another embodiment of the invention. FIG. 15B is a schematic view briefly illustrating the outer surrounding surface depicted in FIG. 15A from another view angle. FIG. 16 is a schematic rear view illustrating a specific angle-forming region S830.

With reference to FIG. 15 and FIG. 16, the outer surrounding surface S728 described in the present embodiment includes specific angle-forming regions S830 and S840. According to the present embodiment, the specific angle-forming regions S830 and S840 are arranged on two sides of the light diverging region S810 and on two sides of the second reference plane r2. In the present embodiment, each of the specific angle-forming regions S830 and S840 is a continuous curved surface, and a step is between each of the specific angle-forming regions S830 and S840 and the adjacent second reflection regions. For instance, a step exists between the specific angle-forming region S830 and the first sub light diverging region S812, and a step exists between the specific angle-forming region S830 and the sub light condensing region S824. Similarly, a step exists between the specific angle-forming region S840 and the second sub light diverging region S814, and a step exists between the specific angle-forming region S840 and the sub light condensing region S826. That is, a step is between each of the specific angle-forming regions S830 and S840 and the adjacent reflection regions. How the specific angle-forming regions pose an impact on the light pattern of the illumination beam is described below.

FIG. 17 is a schematic view illustrating a light pattern of the illumination beam functioned by the specific angle-forming regions S830 and S840, projected out of the collimating lens 120, and measured on the first reference plane r1. With reference to FIG. 15A to FIG. 17, in the present embodiment, the light pattern of the illumination beam functioned by the specific angle-forming regions S830 and S840 and projected out of the collimating lens 120 is distributed under the reference line RA, the reference line RA is a polyline and includes two straight lines HL and SL, the two straight lines HL and SL intersect each other, and a specific angle θ is included between the two straight lines HL and SL. Here, the straight line HL is the horizontal cut-of line, and the straight line SL is an oblique cut-off line with the light pattern exceeding the horizontal cut-of line HL. As shown in FIG. 17, in order to comply with the UN ECE regulations, the specific angle θ is 15 degrees. That is, after the illumination beam described in the present embodiment is functioned by the specific angle-forming regions S830 and S840, an included angle between the horizontal cut-off line HL and a boundary of the part of the light pattern of the illumination beam that exceeds the horizontal cut-off line HL does not exceed 15 degrees. In the present embodiment, the light pattern generated by the specific angle-forming regions S830 and S840 is a diverging light pattern, and the 15-degree light pattern distributed above the horizontal cut-off line HL is also generated. With reference to FIG. 16, the specific angle-forming region S830 is taken for example, and the curved surface of the specific angle-forming region S830 is latitudinally asymmetrical (left-right asymmetry). When the curved surface is adjusted, the adjusting method depicted in FIG. 11 and FIG. 12 may be applied to divide the specific angle-forming region S830 into a plurality of curved surfaces with different curvatures (e.g., 6 curved surfaces shown in FIG. 16). The dotted lines are rotated relative to a reference axis RL by 15 degrees, and then the light divergence adjustment may be performed on each of the curved surfaces of the specific angle-forming region S830. Although the exemplary specific angle described herein is 15 degrees, the value of the specific angle should not be construed as a limitation to the invention.

Figure 18:
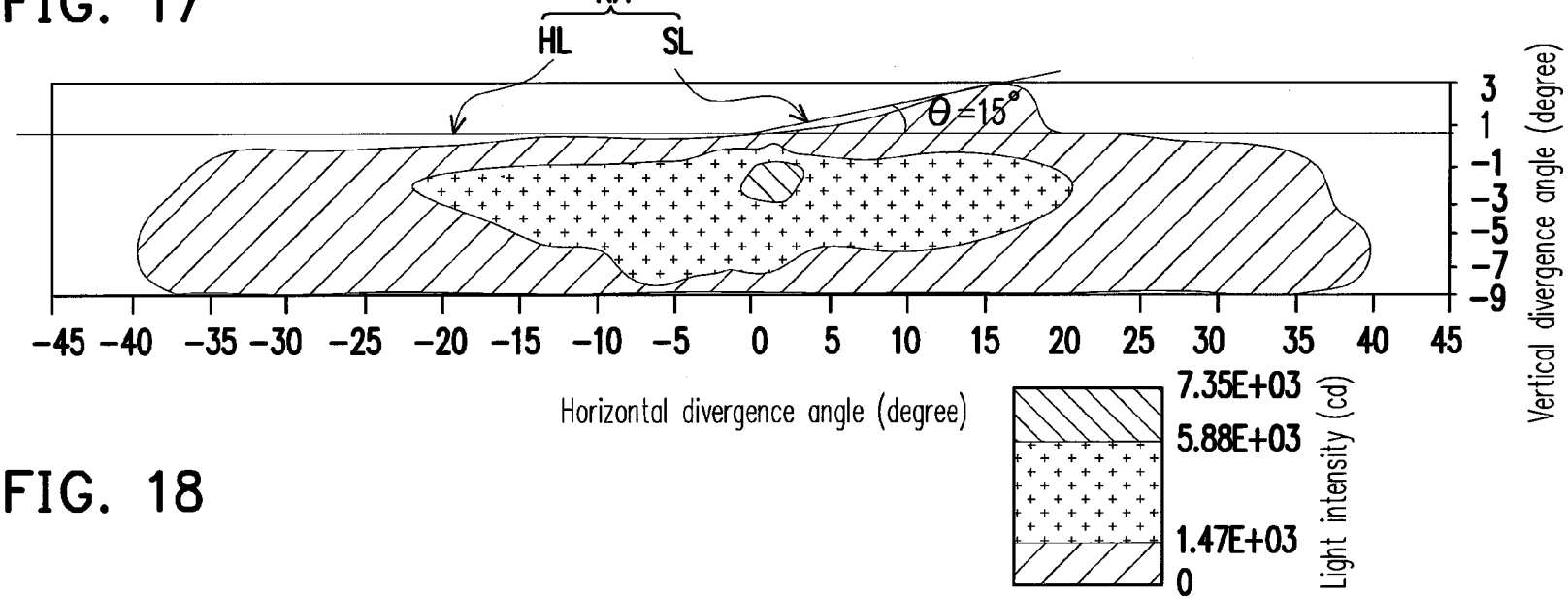
FIG. 18 is a schematic view illustrating a light pattern of the illumination beam functioned by the outer surrounding surface S728 and projected out of the collimating lens.

FIG. 18 is a schematic view illustrating a light pattern of the illumination beam functioned by the outer surrounding surface S728 and projected out of the collimating lens 120. As shown in FIG. 18, after the illumination beam is functioned by the reflection regions of the outer surrounding surface S728 and the second light transmissive surface S724, a light pattern of the illumination beam on the first reference plane r1 is substantially distributed under the reference line RA, where the reference line RA includes the horizontal cut-off line HL and the oblique cut-off line SL, and an included angle between the horizontal cut-off line HL and the oblique cut-off line SL does not exceed 15 degrees. Therefore, such light pattern distribution allows the illumination apparatus described herein to comply with the UN ECE regulations issued by the ECE when the illumination apparatus is applied to vehicle illumination. Particularly, in a measurement standard specified by the UN ECE regulations, the light pattern of the illumination beam projected out of the collimating lens 120 is located above the reference line RA, i.e., the light intensity of the light pattern above the horizontal cut-off line HL and the oblique cut-off line SL is almost zero. Note that the measurement method of the horizontal divergence angle mentioned in one of the embodiments complies with the UN ECE regulations.

In order to provide the exemplary illumination light pattern described in the aforementioned embodiments, each of the reflection regions of the outer surrounding surface of the invention has a step therebetween, which is described in detail below.

Figure 19:
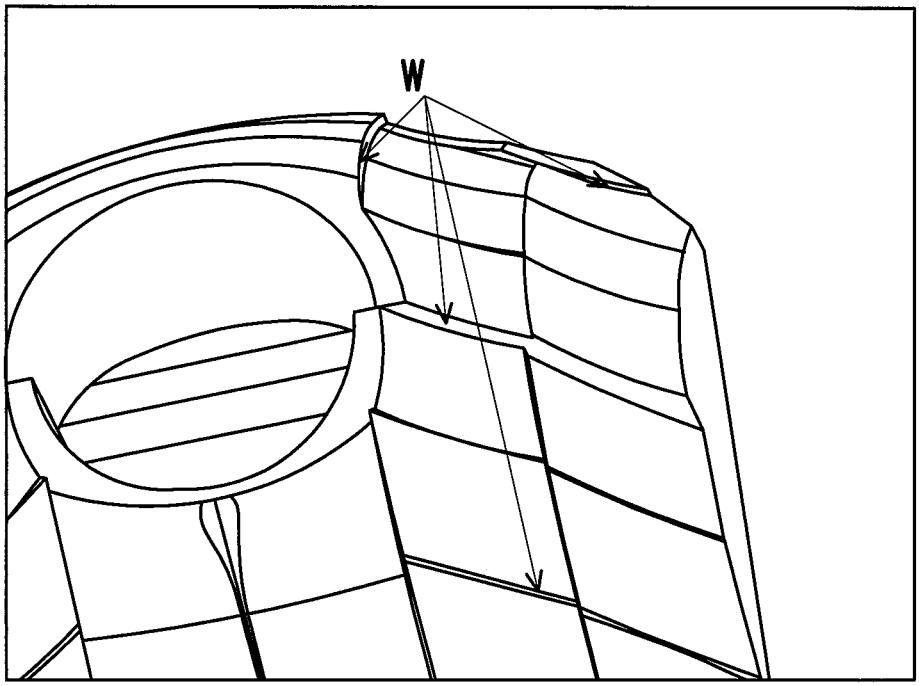
FIG. 19 is a schematic partial enlarged view illustrating an outer surrounding surface according to an embodiment of the invention.

FIG. 19 is a schematic partial enlarged view illustrating an outer surrounding surface according to an embodiment of the invention. With reference to FIG. 9 and FIG. 19, taking the outer surrounding surface S128 depicted in FIG. 9 as an example, each of the reflection regions of the outer surrounding surface S128 is a continuous curved surface, and the neighboring reflection regions have steps therebetween. A step W shown in FIG. 19 indicates that the curved surfaces of the two neighboring reflection regions are discontinuous and have a height difference therebetween.

Figure 20A:
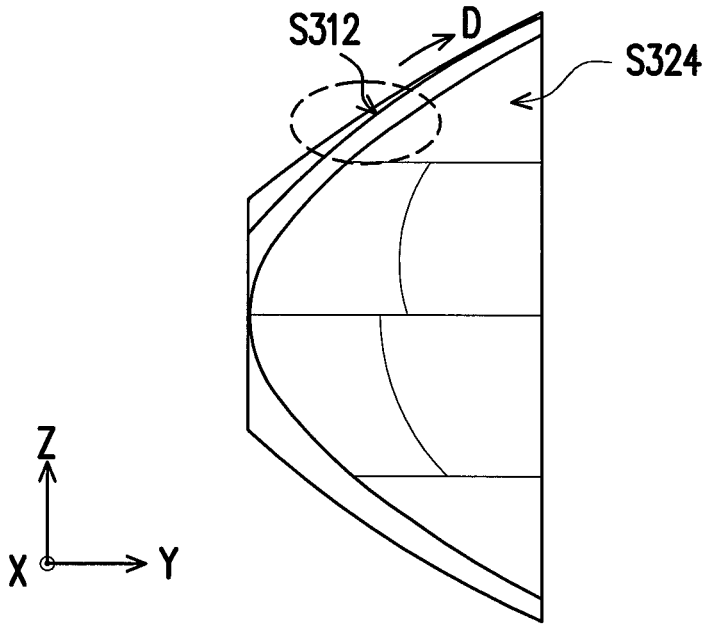
FIG. 20A is a schematic view illustrating a step between the sub light diverging region S312 depicted in FIG. 9 and the neighboring reflection region.
Figure 20B:
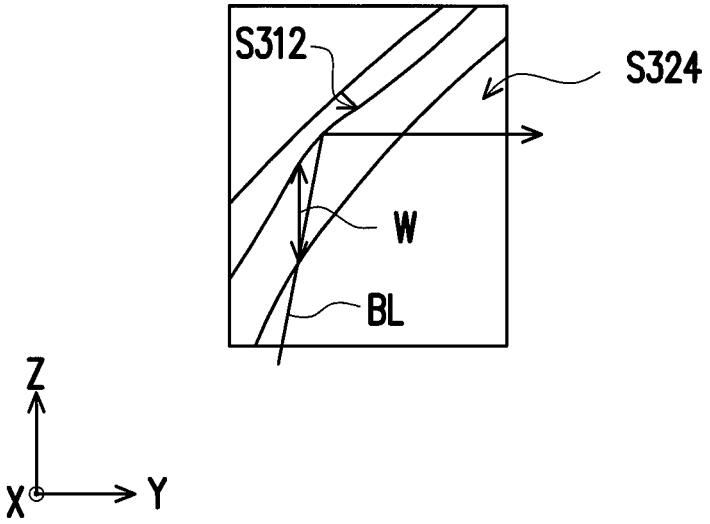
FIG. 20B is a schematic partial enlarged view illustrating an area encircled by dotted lines in FIG. 20A.

From another perspective, FIG. 20A is a schematic view illustrating a step between the sub light diverging region S312 depicted in FIG. 9 and the neighboring reflection region. FIG. 20B is a schematic partial enlarged view illustrating an area encircled by dotted lines in FIG. 20A. With reference to FIG. 9, FIG. 20A, and FIG. 20B, in the present embodiment, the sub light diverging region S312 depicted in FIG. 9 is taken for example. A step exists between the sub light condensing regions S322 and S324 and the neighboring second reflection regions. For instance, the step W exists between the sub light diverging region S312 and the sub light condensing region S324, as shown in FIG. 20A and FIG. 20B. Optical effects of the respective reflection regions are adjusted to generate the steps between the reflection regions, and according to the adjustment result, the illumination beam BL shown in FIG. 20B is reflected by the sub light diverging region S312 and projected out of the collimating lens 120 along a Y direction.

Figure 21A:
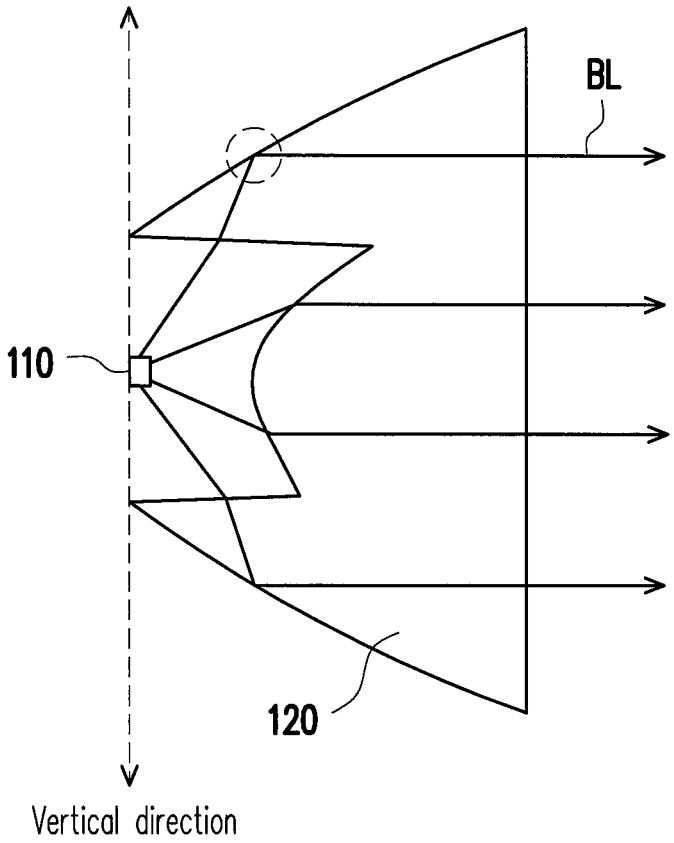
FIG. 21A is a schematic cross-sectional view illustrating the collimating lens depicted in FIG. 8A along a section line B2-B2.
Figure 21B:
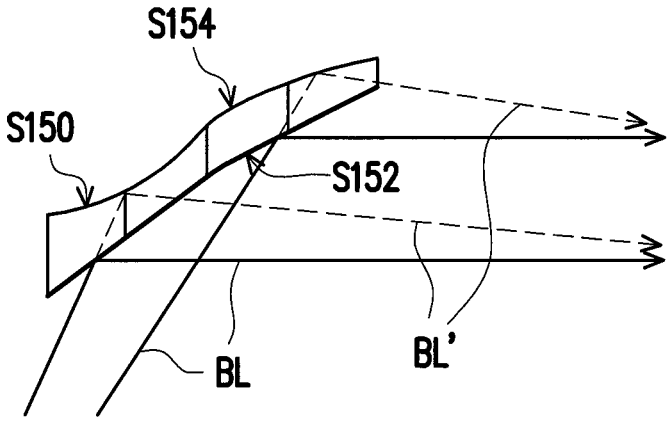
FIG. 21B is a schematic partial enlarged side view illustrating an area encircled by dotted lines in FIG. 21A corresponding to the collimating lens.
Figure 22A:
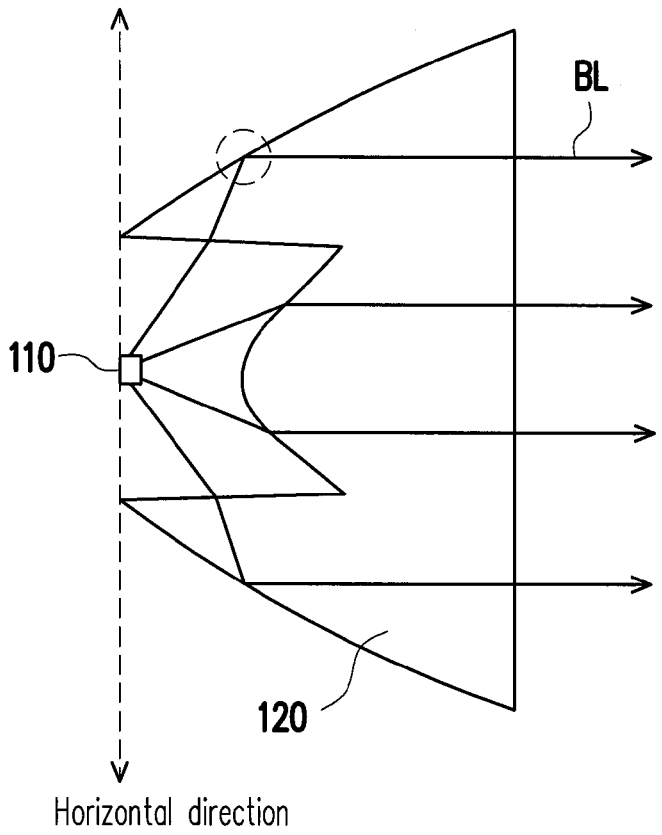
FIG. 22A is a schematic cross-sectional view illustrating the collimating lens depicted in FIG. 8A along a section line C2-C2.
Figure 22B:
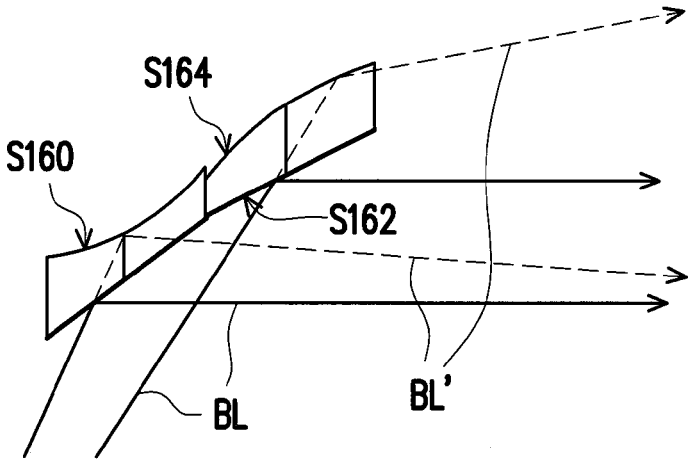
FIG. 22B is a schematic partial enlarged side view illustrating an area encircled by dotted lines in FIG. 22A corresponding to the collimating lens.

FIG. 21A is a schematic cross-sectional view illustrating the collimating lens 120 depicted in FIG. 8A along a section line B2-B2. FIG. 21B is a schematic partial enlarged side view illustrating an area encircled by dotted lines in FIG. 21A corresponding to the collimating lens 120. FIG. 22A is a schematic cross-sectional view illustrating the collimating lens 120 depicted in FIG. 8A along a section line C2-C2. FIG. 22B is a schematic partial enlarged side view illustrating an area encircled by dotted lines in FIG. 22A corresponding to the collimating lens 120.

With reference to FIG. 8A and FIG. 21A to FIG. 22B, when it is observed from a vertical direction, a second reflection area S152 indicates a surface that is not yet adjusted in response to a light pattern requirement; at this time, the light pattern of the second illumination beam BL projected out of the collimating lens is not able to be distributed under the horizontal reference line. The reflection region S152 is divided into a plurality of curved surfaces according to the requirement for adjustment, and the reflection regions S150 and S154 are taken for example. Curvatures of the reflection regions S150 and S154 are adjusted according to the light pattern requirement, so as to control a transmission direction of the illumination beam BL to face upward or downward. By adjusting the reflection regions S150 and S154 in segments, the illumination beam BL can be collimated to be a second illumination beam BL', and a light pattern of the illumination beam BL' projected out of the collimating lens is distributed under the horizontal reference line. Similarly, when it is observed from a horizontal direction, a reflection area S162 indicates a surface that is not yet adjusted in response to a light pattern requirement; at this time, the light pattern distribution of the second illumination beam BL projected out of the collimating lens cannot satisfy the requirement for a desired horizontal divergence angle. The reflection region S162 is divided into a plurality of curved surfaces according to the requirement for adjustment, and the reflection regions S160 and S164 are taken for example. Curvatures of the reflection regions S160 and S164 are adjusted according to the light pattern requirement, so as to control the illumination beam BL to be transmitted in a direction approaching or away from the optical axis O of the second illumination light source. By adjusting the reflection regions S160 and S164 in segments, the illumination beam BL can be collimated to be an illumination beam BL', and a light pattern of the illumination beam BL' projected out of the collimating lens can be distributed in a desired manner to obtain the required horizontal divergence angle.

In conclusion, in the vehicle illumination apparatus described in the invention, the collimating lens does not need to be coated with a film layer with high reflectivity. Besides, according to the total reflection and refraction principles, the outer surrounding surface is designed to have regions with different curved surfaces, and the step exists between the regions, so as to satisfy the requirement for different divergence angles. Moreover, the light patterns of the illumination beam functioned by different regions and projected out of the collimating lens have been described above, and as a result, the vehicle illumination apparatus described in the invention at least complies with a light pattern standard of the low beam of vehicle.

Figure 23A:
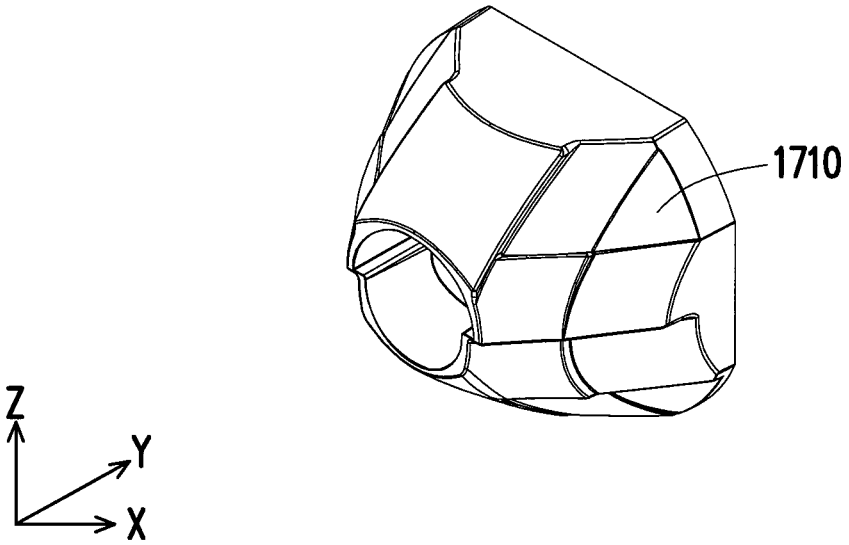
FIG. 23A is a schematic three-dimensional view briefly illustrating a collimating lens in a vehicle illumination apparatus according to another embodiment of the invention.
Figure 23B:
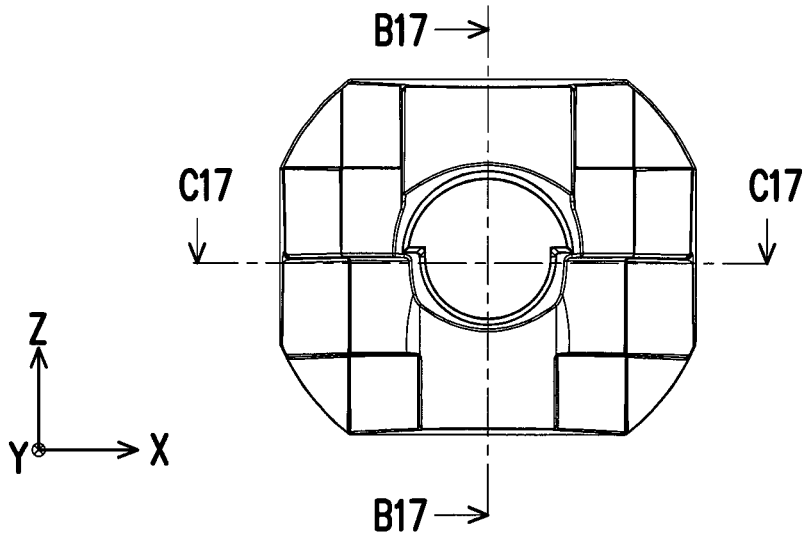
FIG. 23B is a schematic rear view illustrating the collimating lens depicted in FIG. 23A.
Figure 23C:
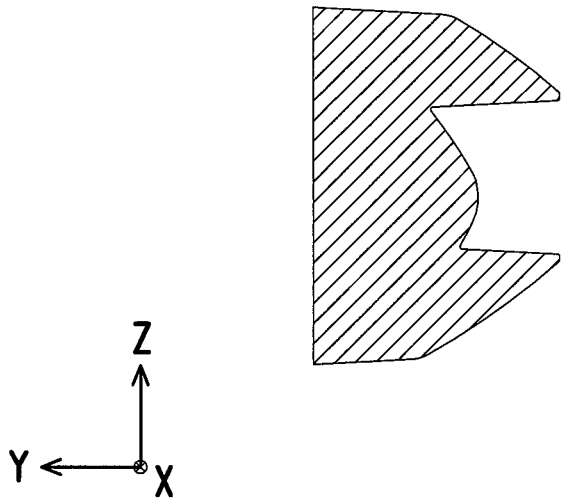
FIG. 23C is a schematic cross-sectional view illustrating the collimating lens depicted in FIG. 23B along a section line B17-B17.
Figure 23D:
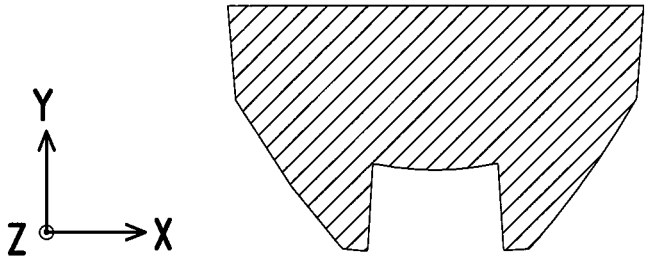
FIG. 23D is a schematic cross-sectional view illustrating the collimating lens depicted in FIG. 23B along a section line C17-C17.

According to the embodiments shown in FIG. 9 and FIG. 15A, when it is observed from a rear view of the vehicle illumination apparatus, i.e., from a −Y direction to a +Y direction, the profile of the collimating lens is a curve substantially similar to a circle, which should however not be construed as a limitation to the invention. FIG. 23A is a schematic three-dimensional view briefly illustrating a vehicle illumination apparatus according to another embodiment of the invention. FIG. 23B is a schematic rear view illustrating the collimating lens depicted in FIG. 23A. FIG. 23C is a schematic cross-sectional view illustrating the collimating lens depicted in FIG. 23B along a section line B17-B17. FIG. 23D is a schematic cross-sectional view illustrating the collimating lens depicted in FIG. 23B along a section line C17-C17. When the vehicle illumination apparatus is observed from the rear view, the profile of the collimating lens 1710 described in the present embodiment is a curve substantially similar to a quadrilateral. Note that such structural design can also be applied to the motorcycle illumination apparatus. In this case, the motorcycle illumination apparatus may not include the specific angle-forming regions S830 and S840. That is, in the vehicle illumination apparatus described in the invention, whether the outer surrounding surface includes the specific angle-forming regions or locations where the specific angle-forming regions may be configured can be selectively designed according to different applications. For example, when the vehicle illumination apparatus described herein is applied to motorcycles, the vehicle illumination apparatus may not include the specific angle-forming regions. In a left-hand drive automobile, the design of the specific angle-forming regions in the vehicle illumination apparatus may be the same as that depicted in FIG. 15A. In a right-hand drive automobile, the design of the specific angle-forming regions in the vehicle illumination apparatus may be adaptively adjusted to comply with standards prescribed by other regulations.

Figure 24A:
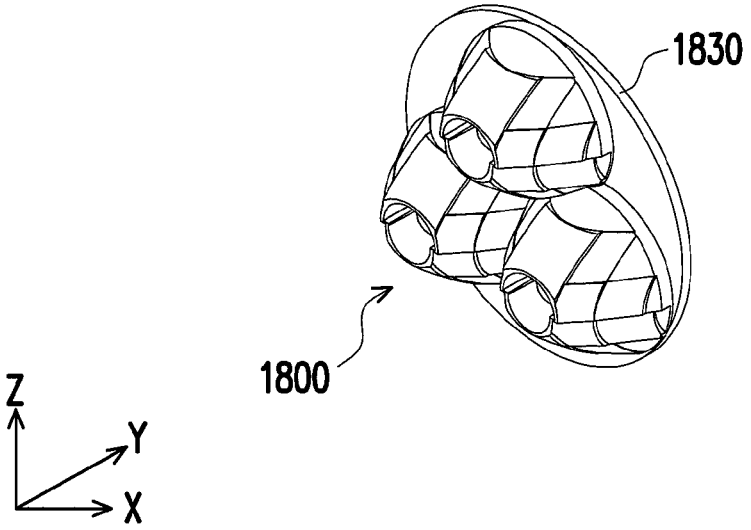
FIG. 24A is a schematic three-dimensional view briefly illustrating a vehicle illumination apparatus according to another embodiment of the invention.
Figure 24B:
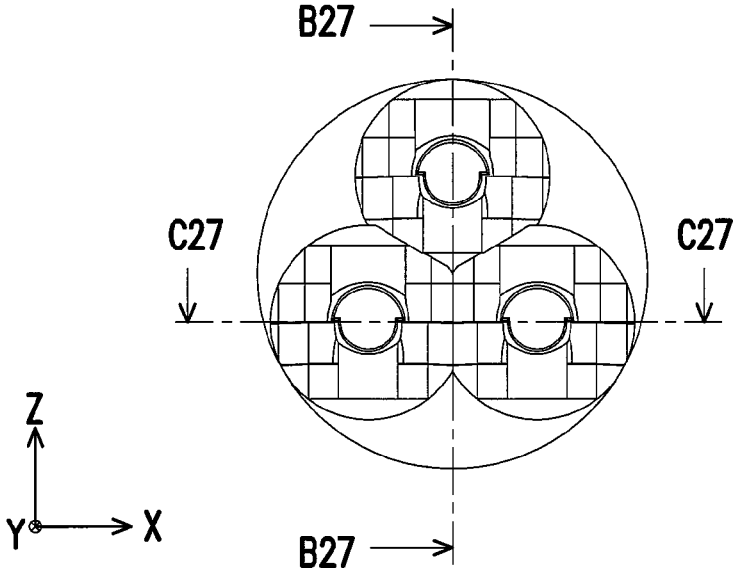
FIG. 24B is a schematic rear view illustrating the collimating lens depicted in FIG. 24A.
Figure 24C:
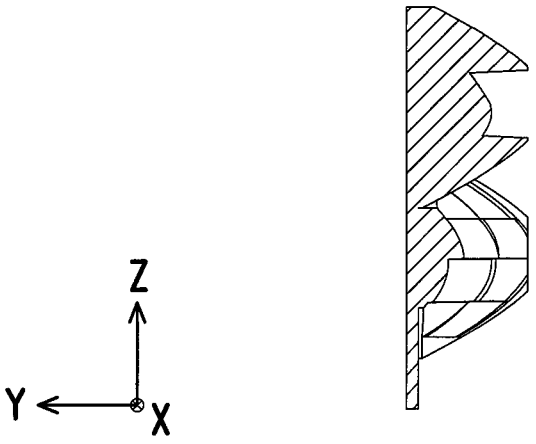
FIG. 24C is a schematic cross-sectional view illustrating the collimating lens depicted in FIG. 24B along a section line B27-B27.
Figure 24D:
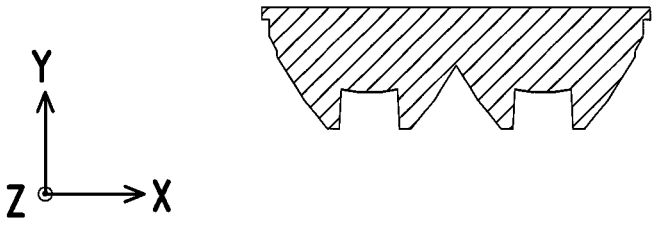
FIG. 24D is a schematic cross-sectional view illustrating the collimating lens depicted in FIG. 24B along a section line C27-C27.
Figure 25A:
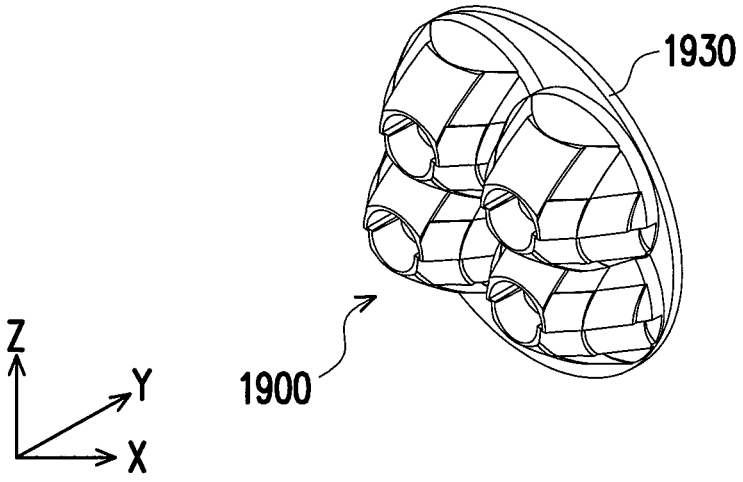
FIG. 25A is a schematic three-dimensional view briefly illustrating a vehicle illumination apparatus according to another embodiment of the invention.
Figure 25B:
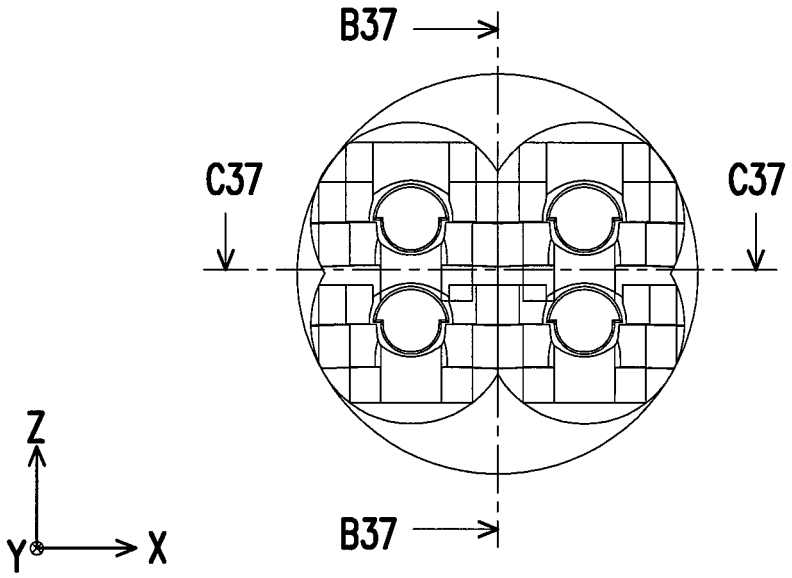
FIG. 25B is a schematic rear view illustrating the collimating lens depicted in FIG. 25A.
Figure 25C:
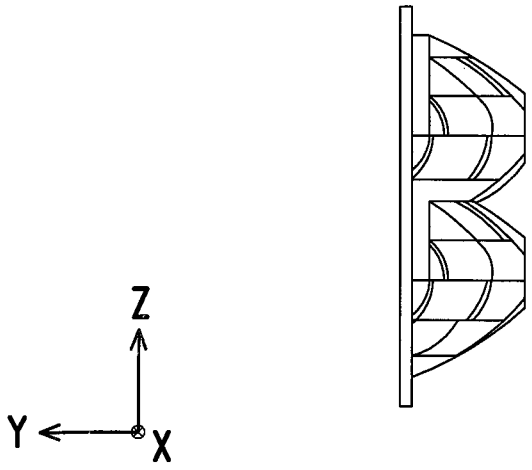
FIG. 25C is a schematic cross-sectional view illustrating the collimating lens depicted in FIG. 25B along a section line B37-B37.
Figure 25D:
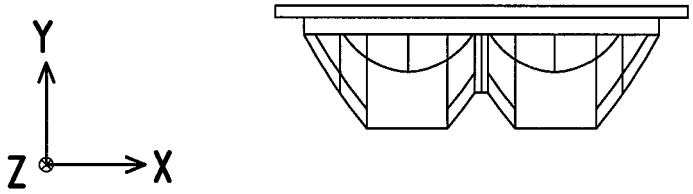
FIG. 25D is a schematic cross-sectional view illustrating the collimating lens depicted in FIG. 25B along a section line C37-C37.
Figure 26A:
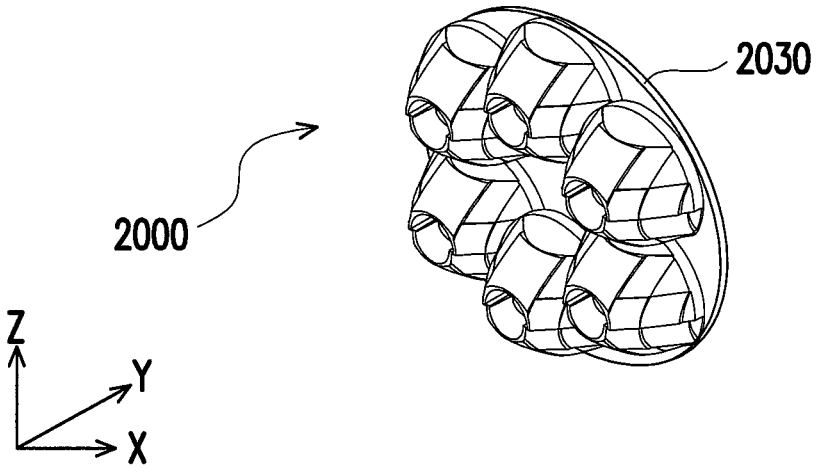
FIG. 26A is a schematic three-dimensional view briefly illustrating a vehicle illumination apparatus according to another embodiment of the invention.
Figure 26B:
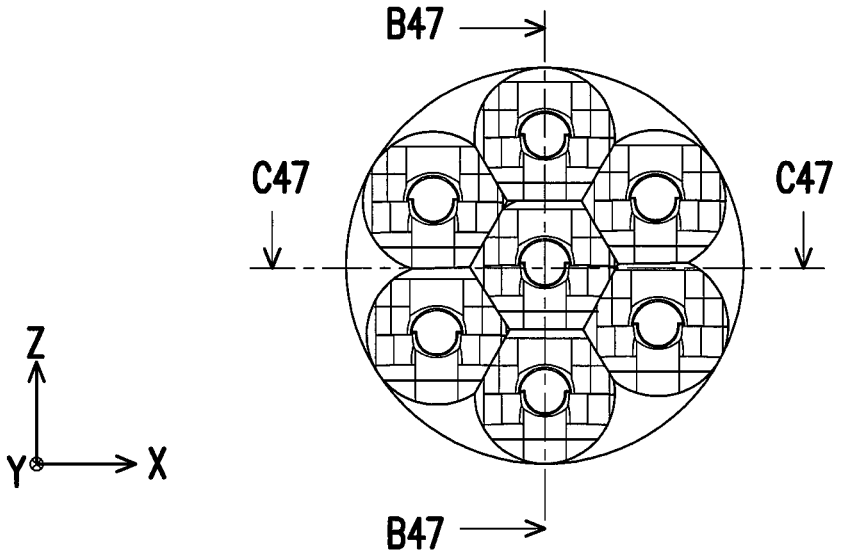
FIG. 26B is a schematic rear view illustrating the collimating lens depicted in FIG. 26A.
Figure 26C:
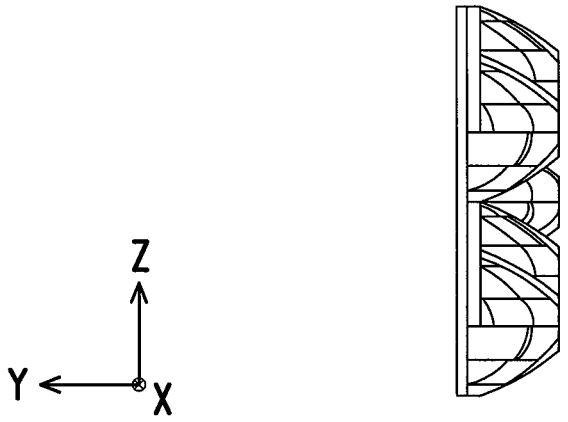
FIG. 26C is a schematic cross-sectional view illustrating the collimating lens depicted in FIG. 26B along a section line B47-B47.
Figure 26D:
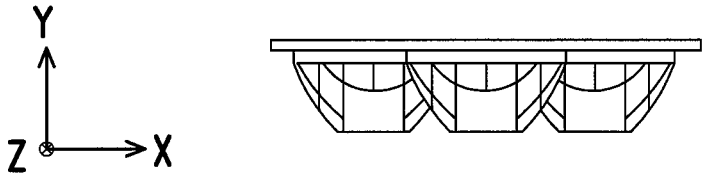
FIG. 26D is a schematic cross-sectional view illustrating the collimating lens depicted in FIG. 26B along a section line C47-C47.

According to different applications, the vehicle illumination apparatus described in an embodiment of the invention may also include a plurality of illumination light sources and a plurality of collimating lenses, and the collimating lenses are made of the same material and are formed integrally to collectively have a lens structure. FIG. 24A to FIG. 26D respectively illustrate that the vehicle illumination apparatuses respectively have different number of illumination light sources and collimating lenses. FIG. 24A is a schematic three-dimensional view briefly illustrating a vehicle illumination apparatus according to another embodiment of the invention. FIG. 24B is a schematic rear view illustrating the collimating lens depicted in FIG. 24A. FIG. 24C is a schematic cross-sectional view illustrating the collimating lens depicted in FIG. 24B along a section line B27-B27. FIG. 24D is a schematic cross-sectional view illustrating the collimating lens depicted in FIG. 24B along a section line C27-C27. FIG. 25A is a schematic three-dimensional view briefly illustrating a vehicle illumination apparatus according to another embodiment of the invention. FIG. 25B is a schematic rear view illustrating the collimating lens depicted in FIG. 25A. FIG. 25C is a schematic cross-sectional view illustrating the collimating lens depicted in FIG. 25B along a section line B37-B37. FIG. 25D is a schematic cross-sectional view illustrating the collimating lens depicted in FIG. 25B along a section line C37-C37. FIG. 26A is a schematic three-dimensional view briefly illustrating a vehicle illumination apparatus according to another embodiment of the invention. FIG. 26B is a schematic rear view illustrating the collimating lens depicted in FIG. 26A. FIG. 26C is a schematic cross-sectional view illustrating the collimating lens depicted in FIG. 26B along a section line B47-B47. FIG. 26D is a schematic cross-sectional view illustrating the collimating lens depicted in FIG. 26B along a section line C47-C47. The illumination light sources are configured in the containing spaces of the collimating lenses, and in order to clearly illustrate such implementations, the situation of configuring the illumination light sources in the containing spaces of the collimating lenses is not illustrated in FIG. 23 to FIG. 26. Besides, the vehicle illumination apparatus having the collimating lenses may further include a substrate for accommodating the collimating lenses. For instance, the vehicle illumination apparatuses 1800, 1900, and 2000 respectively include a substrate 1830, a substrate 1930, and a substrate 2030 for accommodating the collimating lenses. Each of the reflection regions on the integrally formed lens structure is a continuous curved surface, and at least one step exists between each of the reflection regions and the neighboring reflection regions. After the illumination beams of the illumination light sources are reflected by the reflection regions, the illumination beams projected out of the lens structure may still comply with the UN ECE regulations.

Figure 27A:
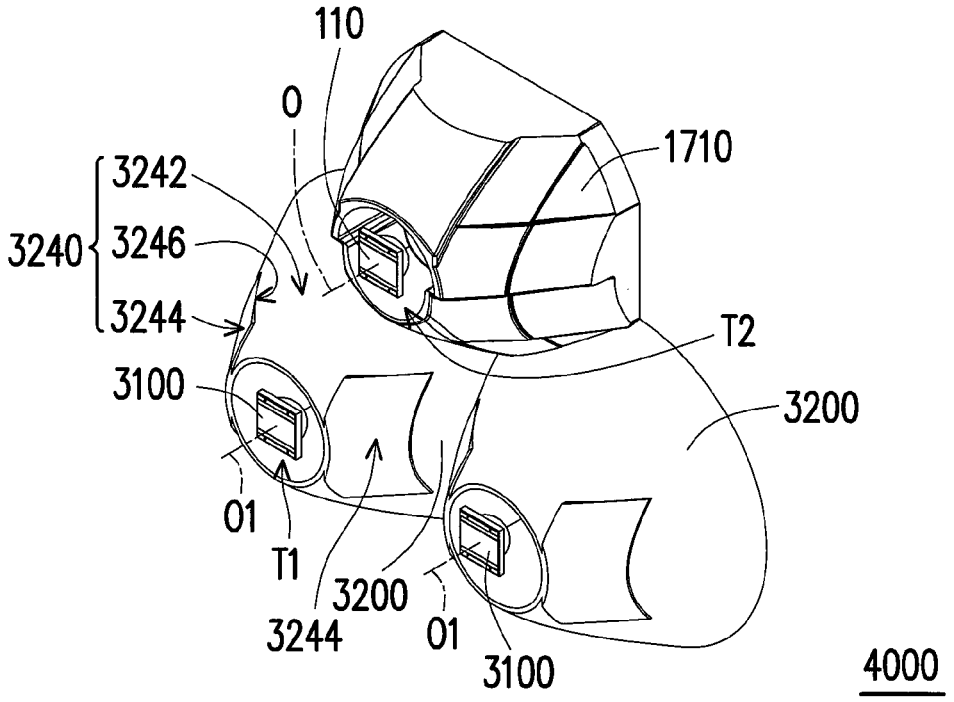
FIG. 27A is a schematic three-dimensional view briefly illustrating a vehicle illumination apparatus according to yet another embodiment of the invention.
Figure 27B:
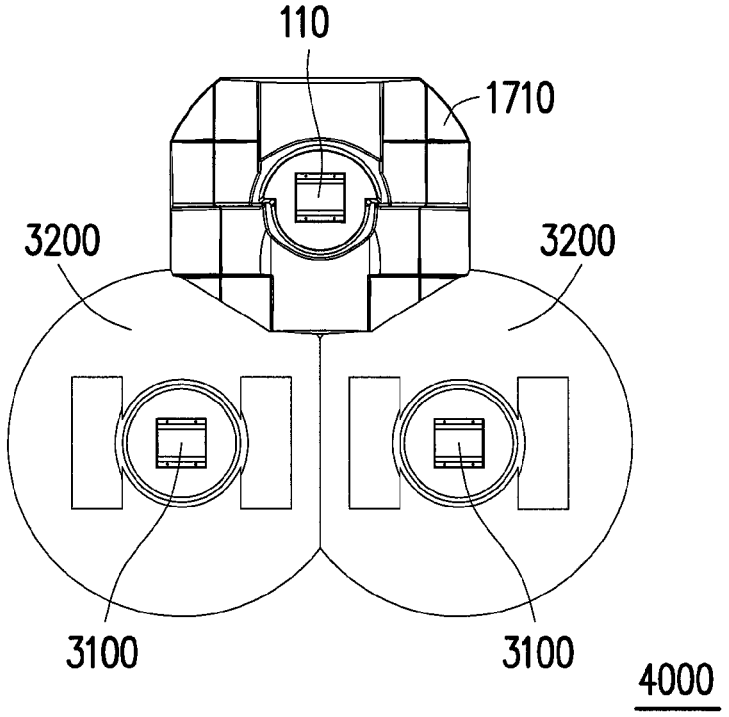
FIG. 27B is a schematic rear view illustrating the vehicle illumination apparatus depicted in FIG. 27A.

FIG. 27A is a schematic three-dimensional view briefly illustrating a vehicle illumination apparatus according to yet another embodiment of the invention. FIG. 27B is a schematic rear view illustrating the vehicle illumination apparatus depicted in FIG. 27A. With reference to FIG. 27A and FIG. 27B, the vehicle illumination apparatus 4000 described in the present embodiment includes a plurality of the illumination light sources 3100 shown in FIG. 1A (two illumination light sources 3100 are exemplarily shown in FIG. 27A and FIG. 27B), a plurality of the condensing and diverging lenses 3200 shown in FIG. 1A (two condensing and diverging lenses 3200 are exemplarily shown in FIG. 27A and FIG. 27B), the illumination light source 110 shown in FIG. 8B, and the collimating lens 1710 shown in FIG. 23A. In the present embodiment, the condensing and diverging lenses 3200 are made of the same material, are integrally formed, and collectively have a lens structure, and the illumination light sources 3100 are correspondingly located in the containing spaces T1 of the condensing and diverging lenses 3200. Besides, the collimating lens 1710 and the condensing and diverging lenses 3200 described herein are connected and integrally formed, and the illumination light source 110 is corresponding arranged in the containing space T2 of the collimating lens 1710. Moreover, according to the present embodiment, the optical axes O1 of the illumination light sources 3100 are substantially parallel to the optical axis O of the illumination light source 110. Thereby, the lens (e.g., the collimating lens 1710) of the low beam and the lenses (e.g., the condensing and diverging lenses 3200) of the high beam may be combined as a whole, and the low beam and the high beam are thus integrated into one module for easy installation. However, in other embodiments of the invention, the collimating lens 1710 and the condensing and diverging lenses 3200 may be combined by means of mechanical members, fixing structures on the surfaces of the lenses, or adhesives. In addition, the collimating lens 1710 depicted in FIG. 27A and FIG. 27B may be replaced by the collimating lens 120 depicted in FIG. 7 or any other collimating lens described in the previous embodiments. Alternatively, the vehicle illumination apparatus may be equipped with plural collimating lenses and plural condensing and diverging lenses that are integrated as a whole.

Figure 28A:
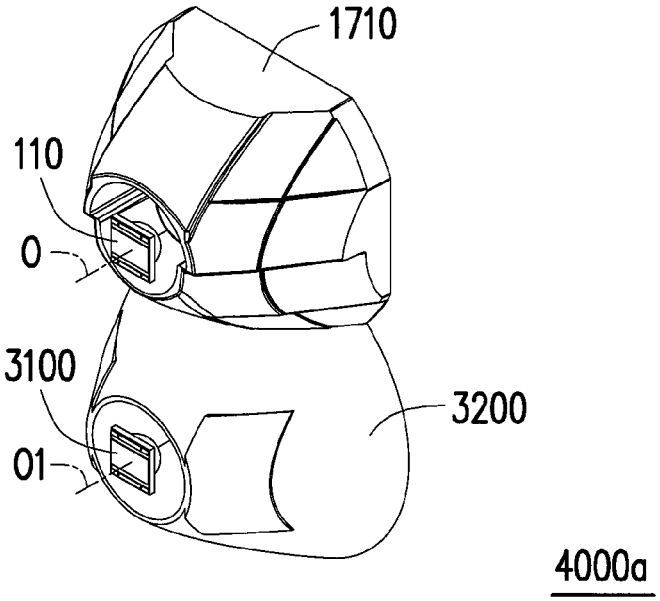
FIG. 28A is a schematic three-dimensional view briefly illustrating a vehicle illumination apparatus according to yet another embodiment of the invention.
Figure 28B:
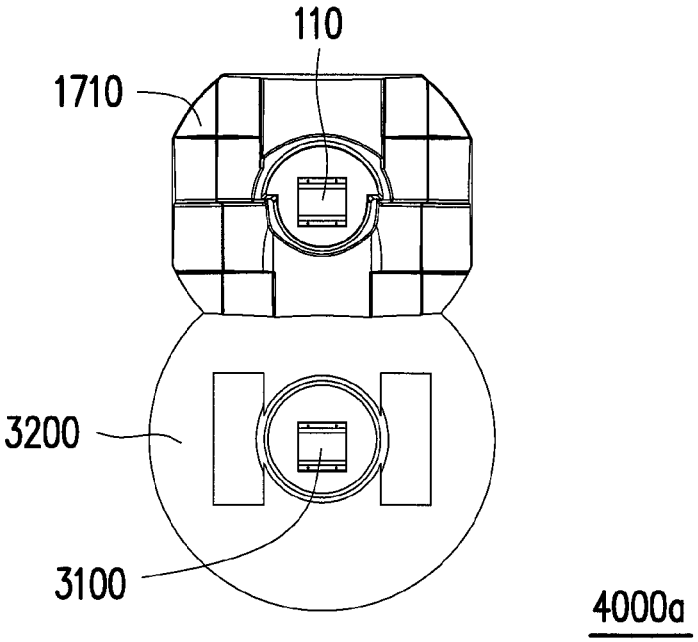
FIG. 28B is a schematic rear view illustrating the vehicle illumination apparatus depicted in FIG. 28A.

FIG. 28A is a schematic three-dimensional view briefly illustrating a vehicle illumination apparatus according to yet another embodiment of the invention. FIG. 28B is a schematic rear view illustrating the vehicle illumination apparatus depicted in FIG. 28A. With reference to FIG. 28A and FIG. 28B, the vehicle illumination apparatus 4000*a* described in the present embodiment is similar to the vehicle illumination apparatus 4000 depicted in FIG. 27A, while one of the differences therebetween lies in that the vehicle illumination apparatus 4000*a* described herein has one condensing and diverging lens 3200, one collimating lens 1710, one illumination light source 3100, and one illumination light source 110. In the present embodiment, the condensing and diverging lens 3200 and the collimating lens 1710 are integrally formed.

Figure 29A:
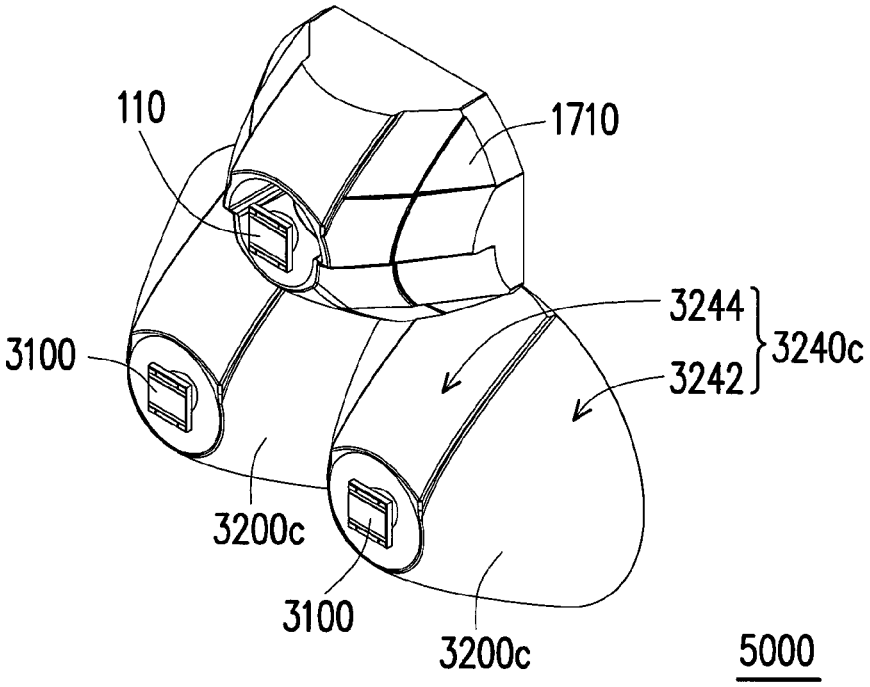
FIG. 29A is a schematic three-dimensional view briefly illustrating a vehicle illumination apparatus according to another embodiment of the invention.
Figure 29B:
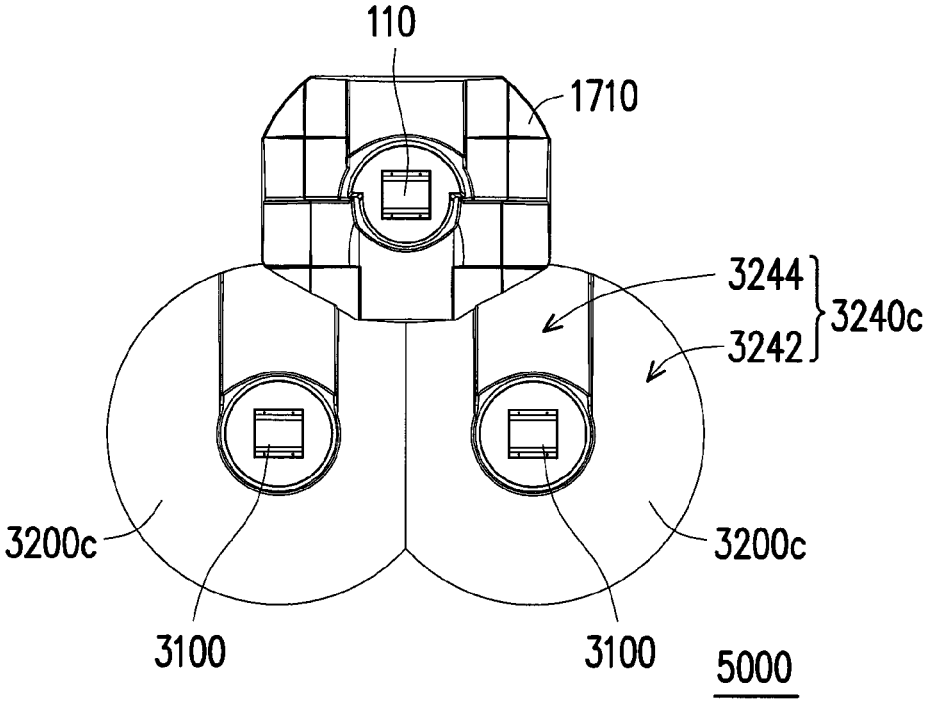
FIG. 29B is a schematic rear view illustrating the vehicle illumination apparatus depicted in FIG. 29A.

FIG. 29A is a schematic three-dimensional view briefly illustrating a vehicle illumination apparatus according to another embodiment of the invention, and FIG. 29B is a schematic rear view illustrating the vehicle illumination apparatus depicted in FIG. 29A. With reference to FIG. 29A and FIG. 29B, the vehicle illumination apparatus 5000 described in the present embodiment is similar to the vehicle illumination apparatus 4000 depicted in FIG. 27A, and the difference therebetween is described below. In the vehicle illumination apparatus 5000, the number of the light diverging region 3244 of the outer surrounding surface 3240*c* in each condensing and diverging lens 3200*c* is 1, while the number of the light diverging region 3244 of the outer surrounding surface 3240 in each condensing and diverging lens 3200 is 2. In other embodiments of the invention, the number of the light diverging regions 3244 in the condensing and diverging lens 3200 or 3200*c* and the ratio of the area occupied by the light diverging regions 3244 to the area occupied by the light condensing regions 3242 may be properly adjusted according to actual requirements, such that the ratio of the light intensity in the region AR1 shown in FIG. 2A to the light intensity obtained by subtracting the light intensity in the region AR1 from the light intensity in the region AR2 can be well monitored.

Figure 30A:
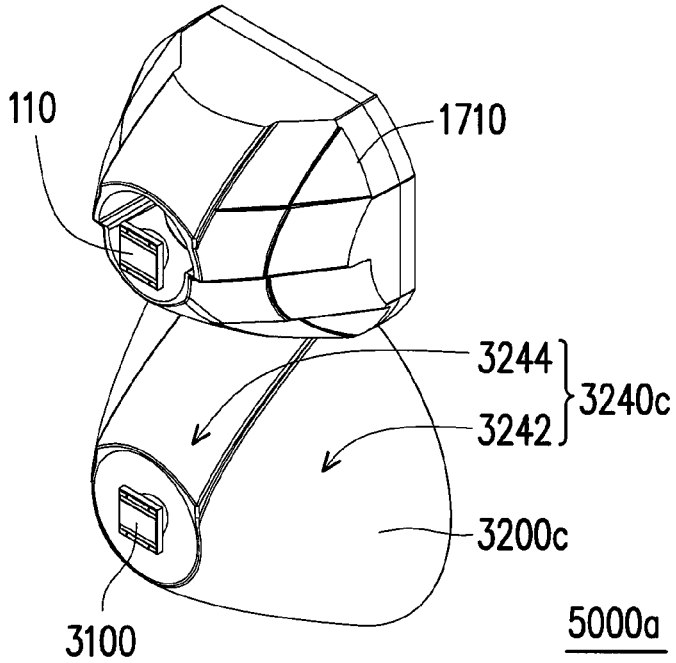
FIG. 30A is a schematic three-dimensional view briefly illustrating a vehicle illumination apparatus according to yet another embodiment of the invention.
Figure 30B:
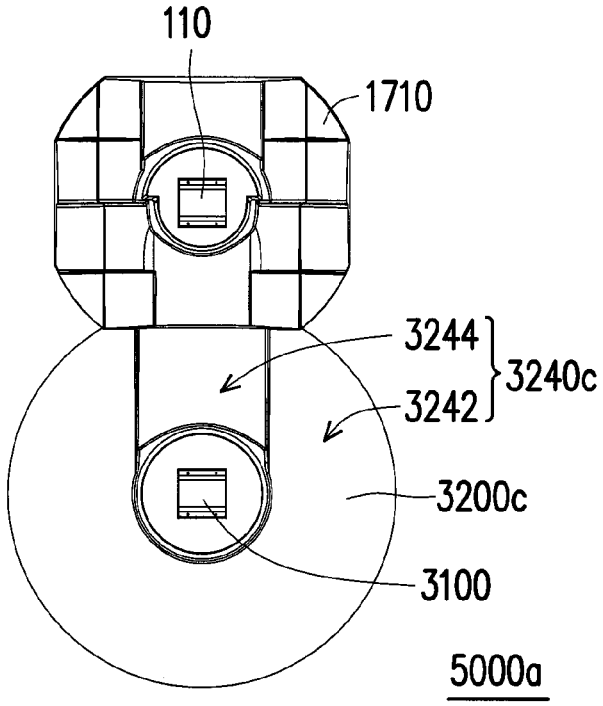
FIG. 30B is a schematic rear view illustrating the vehicle illumination apparatus depicted in FIG. 30A.

FIG. 30A is a schematic three-dimensional view briefly illustrating a vehicle illumination apparatus according to yet another embodiment of the invention. FIG. 30B is a schematic rear view illustrating the vehicle illumination apparatus depicted in FIG. 30A. With reference to FIG. 30A and FIG. 30B, the vehicle illumination apparatus 5000*a* described in the present embodiment is similar to the vehicle illumination apparatus 5000 depicted in FIG. 29A, while one of the differences therebetween lies in that the vehicle illumination apparatus 5000*a* described herein has one condensing and diverging lens 3200*c*, one collimating lens 1710, one illumination light source 3100, and one illumination light source 110. In the present embodiment, the condensing and diverging lens 3200*c* and the collimating lens 1710 are integrally formed.

Figure 31A:
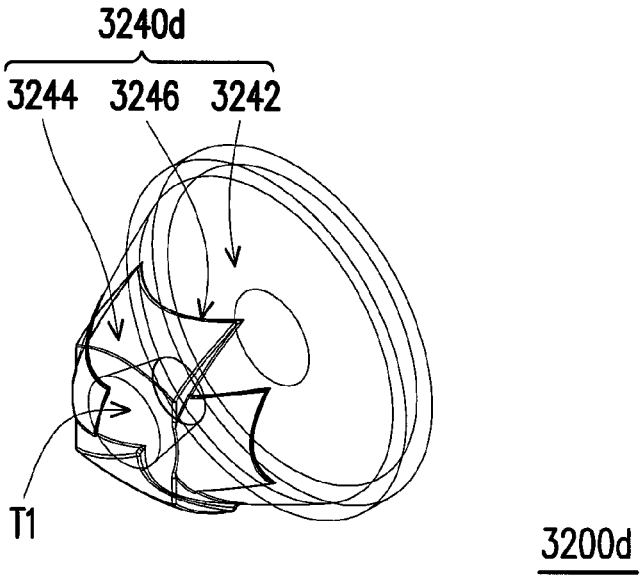
FIG. 31A is a schematic three-dimensional view briefly illustrating a condensing and diverging lens according to yet another embodiment of the invention.
Figure 31B:
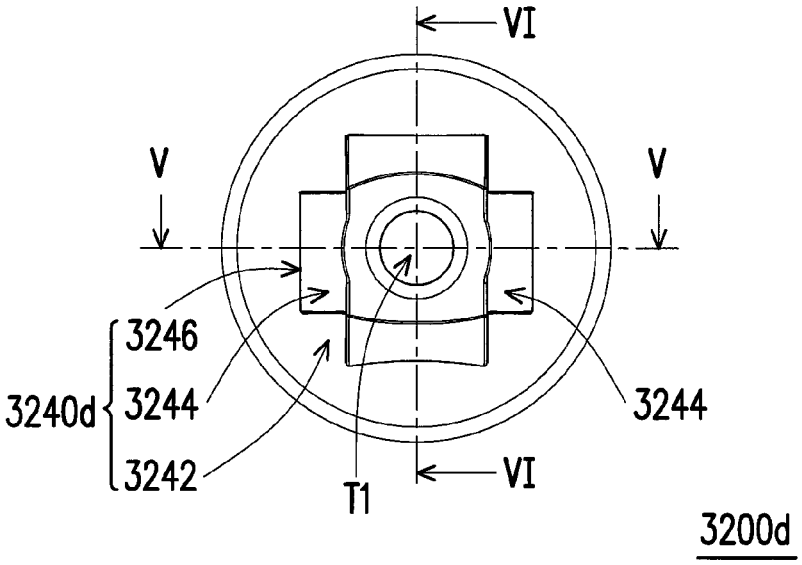
FIG. 31B is a rear view illustrating the condensing and diverging lens depicted in FIG. 31A.
Figure 31C:
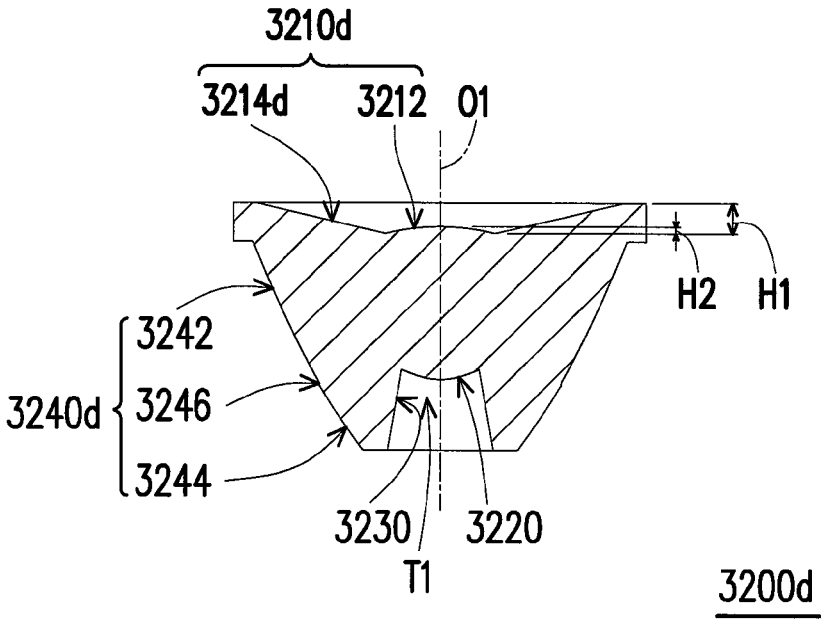
FIG. 31C is a schematic cross-sectional view of the vehicle illumination apparatus depicted in FIG. 31B along a line V-V.
Figure 31D:
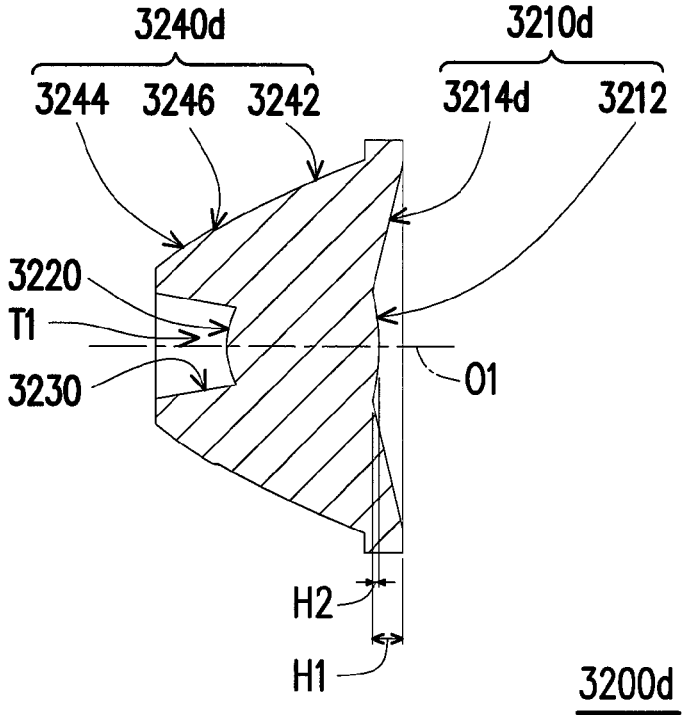
FIG. 31D is a schematic cross-sectional view of the vehicle illumination apparatus depicted in FIG. 31B along a line VI-VI.

FIG. 31A is a schematic three-dimensional view briefly illustrating a condensing and diverging lens according to yet another embodiment of the invention. FIG. 31B is a rear view illustrating the condensing and diverging lens depicted in FIG. 31A. FIG. 31C is a schematic cross-sectional view of the vehicle illumination apparatus depicted in FIG. 31B along a line V-V. FIG. 31D is a schematic cross-sectional view of the vehicle illumination apparatus depicted in FIG. 31B along a line VI-VI. With reference to FIG. 31A to FIG. 31D, in the present embodiment, the condensing and diverging lens 3200 shown in FIG. 1A may be replaced by the condensing and diverging lens 3200*d* described in the present embodiment. The condensing and diverging lens 3200*d* described in the present embodiment is similar to the condensing and diverging lens 3200 depicted in FIG. 1A, and the difference between the two lenses is described below. In the condensing and diverging lens 3200*d* provided in the present embodiment, the first light transmissive surface 3210*d* has a ring-shaped concave surface 3214*d* that surrounds the protruding sub-surface 3212, and a depth H1 of the ring-shaped concave surface 3214*d* in a direction parallel to the optical axis O1 is greater than a height H2 of the protruding sub-surface 3212 in the direction parallel to the optical axis O1. That is, the protruding sub-surface 3212 is located in the concave portion of the ring-shaped concave surface 3214*d*, and the protruding degree of the protruding sub-surface 3212 does not allow the protruding sub-surface 3212 to reach the outer edge of the ring-shaped concave surface 3214*d*.

Besides, in the condensing and diverging lens 3200*d* described herein, the first outer surrounding surface 3240*d* has four light diverging regions 3244.

Figure 32A:
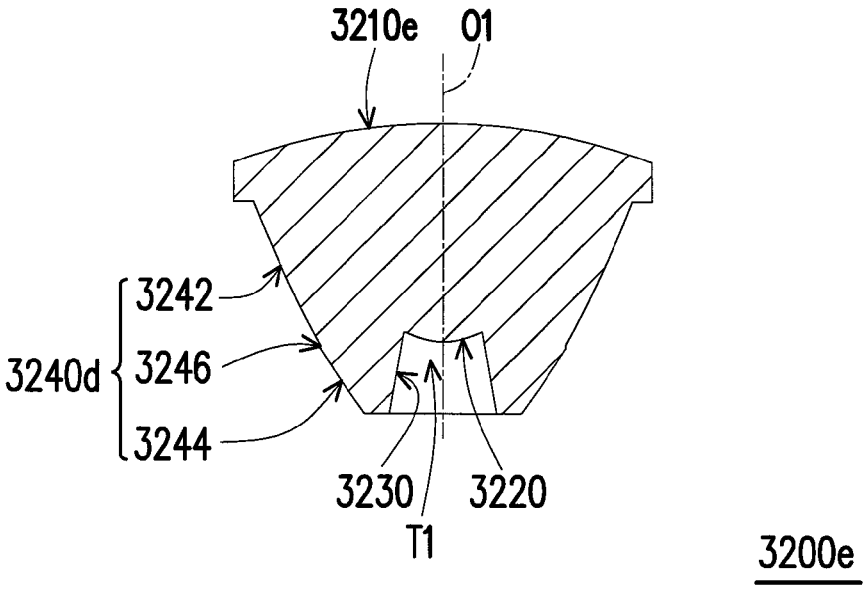
FIG. 32A and FIG. 32B are schematic cross-sectional views illustrating variations in the condensing and diverging lens depicted in FIG. 31A in two different directions.
Figure 32B:
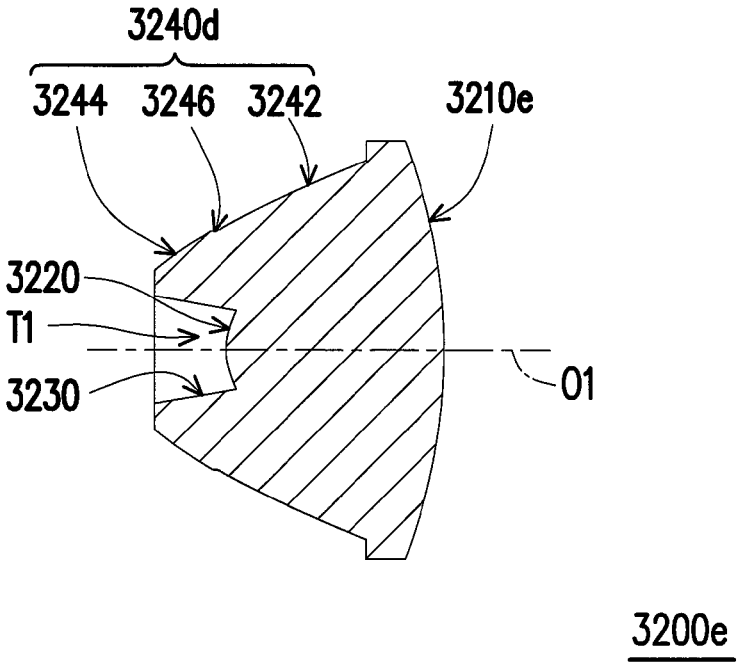

FIG. 32A and FIG. 32B are schematic cross-sectional views illustrating variations in the condensing and diverging lens depicted in FIG. 31A in two different directions. The cross-sectional direction shown in FIG. 32A is the same as that in FIG. 31C, and the cross-sectional direction shown in FIG. 32B is the same as that in FIG. 31D. With reference to FIG. 32A and FIG. 32B, the condensing and diverging lens 3200*e* described in the present embodiment is similar to the condensing and diverging lens 3200*d* depicted in FIG. 31A, while the difference therebetween lies in that the first light transmissive surface 3210*e* of the condensing and diverging lens 3200*e* is a protruding curved surface.

Figure 33A:
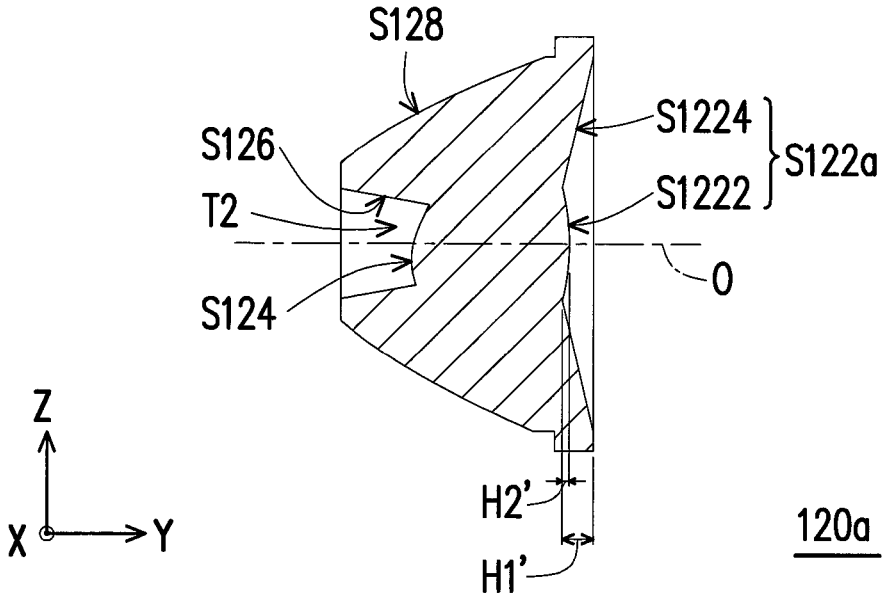
FIG. 33A and FIG. 33B are schematic cross-sectional views illustrating variations in the collimating lens depicted in FIG. 7 in two different directions.
Figure 33B:
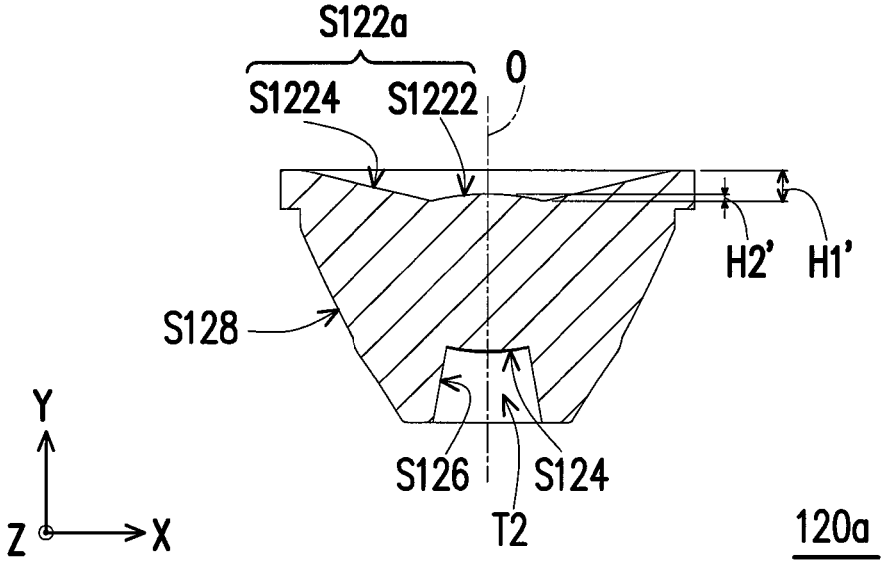

FIG. 33A and FIG. 33B are schematic cross-sectional views illustrating variations in the collimating lens depicted in FIG. 7 in two different directions. The cross-sectional direction shown in FIG. 33A is the same as that in FIG. 8B, and the cross-sectional direction shown in FIG. 33B is the same as that in FIG. 8C. With reference to FIG. 33A and FIG. 33B, the collimating lens 120*a* described in the present embodiment may replace the collimating lens 120 depicted in FIG. 7. Specifically, the collimating lens 120*a* described in the present embodiment is similar to the collimating lens 120 depicted in FIG. 7, and the difference between the two lenses is described below. In the collimating lens 120*a* described in the present embodiment, the first light transmissive surface S122*a* includes a protruding sub-surface S1222 and a ring-shaped concave surface S1224. The protruding sub-surface S1222 is located on the optical axis O of the illumination light source 110 (as shown in FIG. 8B). In the present embodiment, the protruding sub-surface S1222 is a protruding curved surface, for instance. The ring-shaped concave surface S1224 surrounds the protruding sub-surface S1222. Here, a depth H1' of the ring-shaped concave surface S1224 in a direction parallel to the optical axis O is greater than a height H2' of the protruding sub-surface S1222 in the direction parallel to the optical axis O. That is, the protruding sub-surface S1222 is located in the concave portion of the ring-shaped concave surface S1224, and the protruding degree of the protruding sub-surface S1222 does not allow the protruding sub-surface S1222 to reach the outer edge of the ring-shaped concave surface S1224.

Figure 34A:
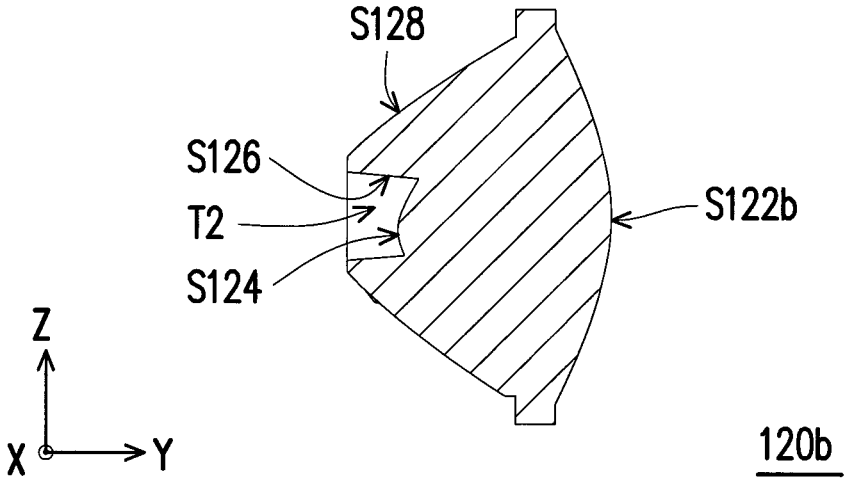
FIG. 34A and FIG. 34B are schematic cross-sectional views illustrating variations in the collimating lens depicted in FIG. 33A in two different directions.
Figure 34B:
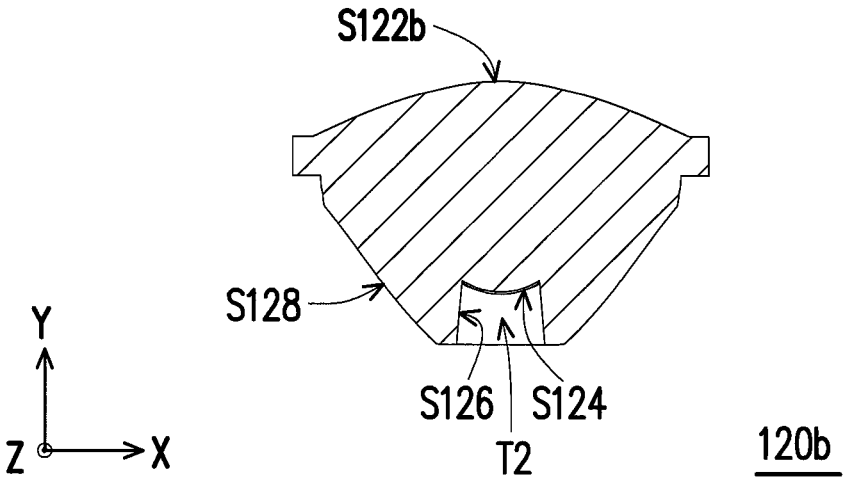

FIG. 34A and FIG. 34B are schematic cross-sectional views illustrating variations in the collimating lens depicted in FIG. 33A in two different directions. The cross-sectional direction shown in FIG. 34A is the same as that in FIG. 33A, and the cross-sectional direction shown in FIG. 34B is the same as that in FIG. 33B. With reference to FIG. 34A and FIG. 34B, the collimating lens 120*b* described in the present embodiment is similar to the collimating lens 120*a* depicted in FIG. 33A, while the difference therebetween lies in that the first light transmissive surface S122*b* of the collimating lens 120*b* is a protruding curved surface.

Figure 35A:
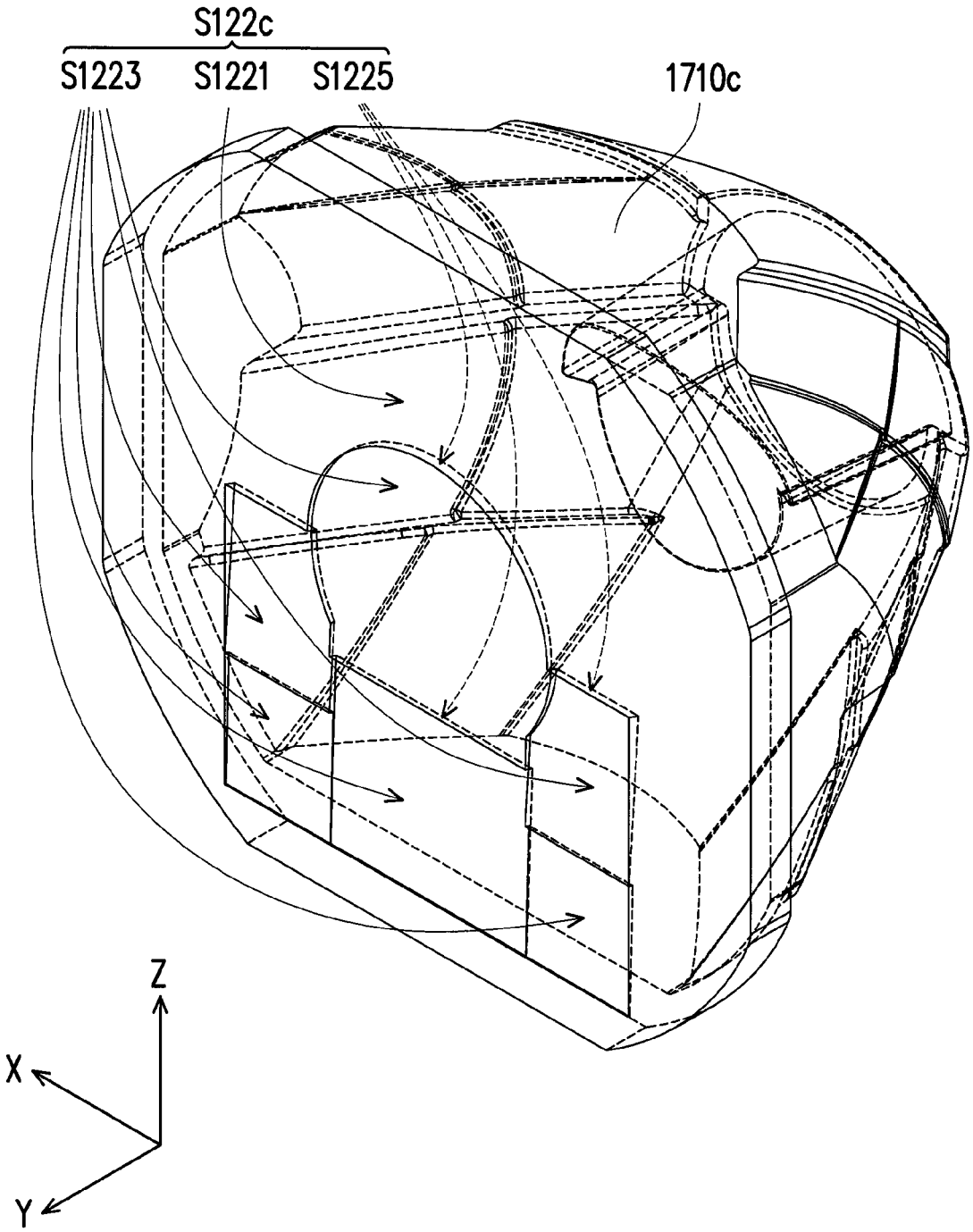
FIG. 35A is a schematic three-dimensional view briefly illustrating variations in the collimating lens depicted in FIG. 23A.
Figure 35B:
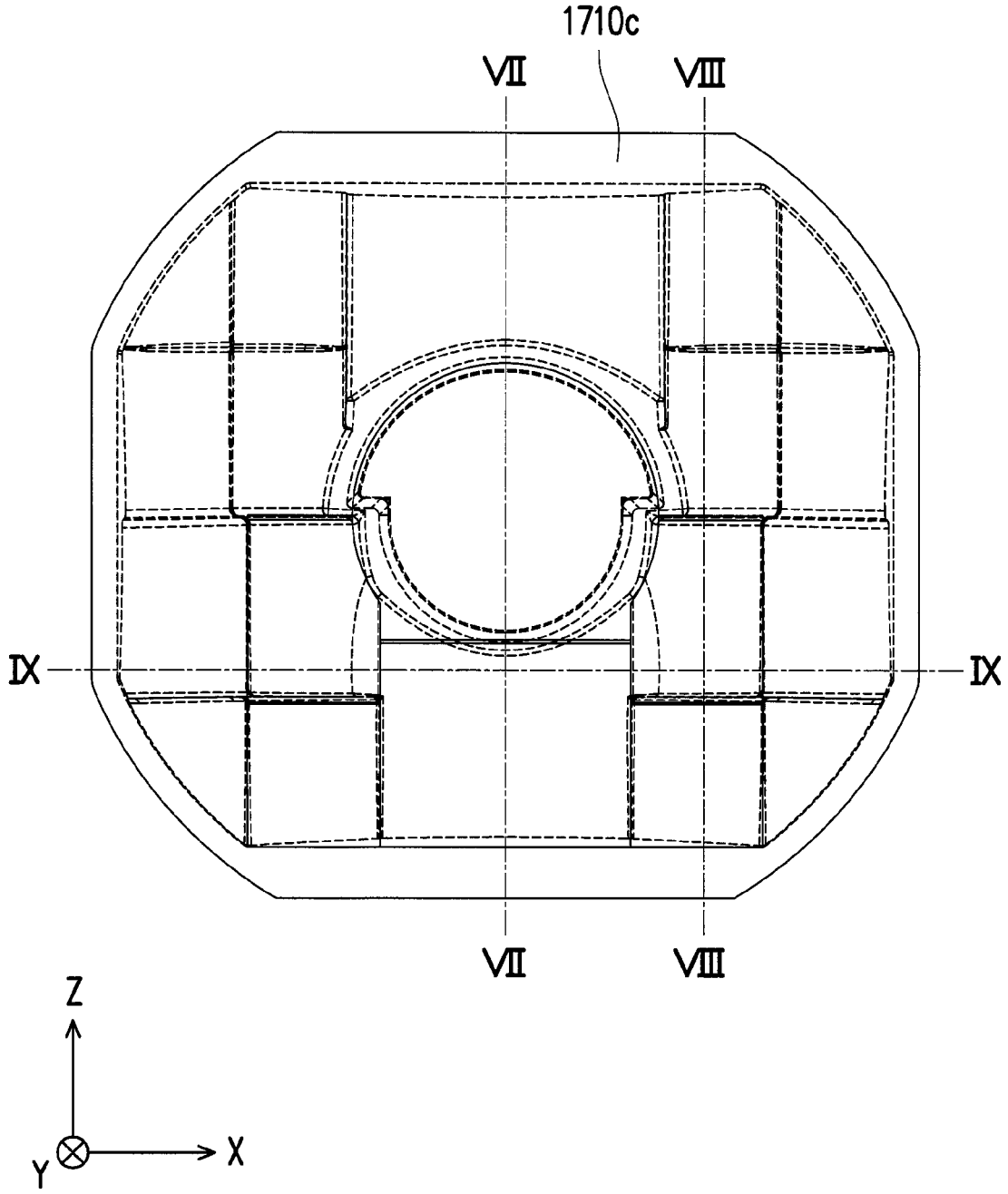
FIG. 35B is a rear view illustrating the collimating lens depicted in FIG. 35A.
Figure 35C:
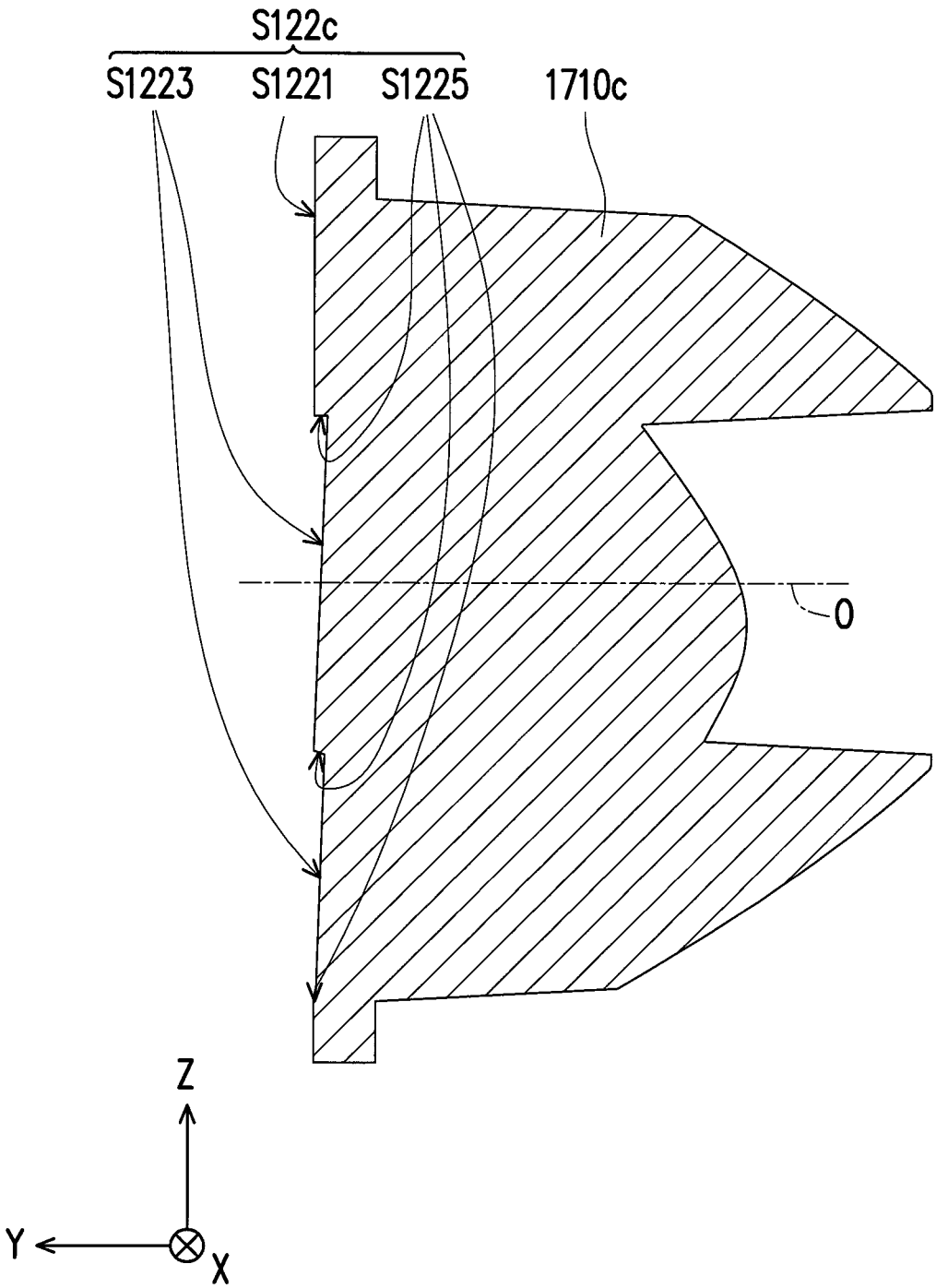
FIG. 35C is a schematic cross-sectional view of the collimating lens depicted in FIG. 35B along a line VII-VII.
Figure 35D:
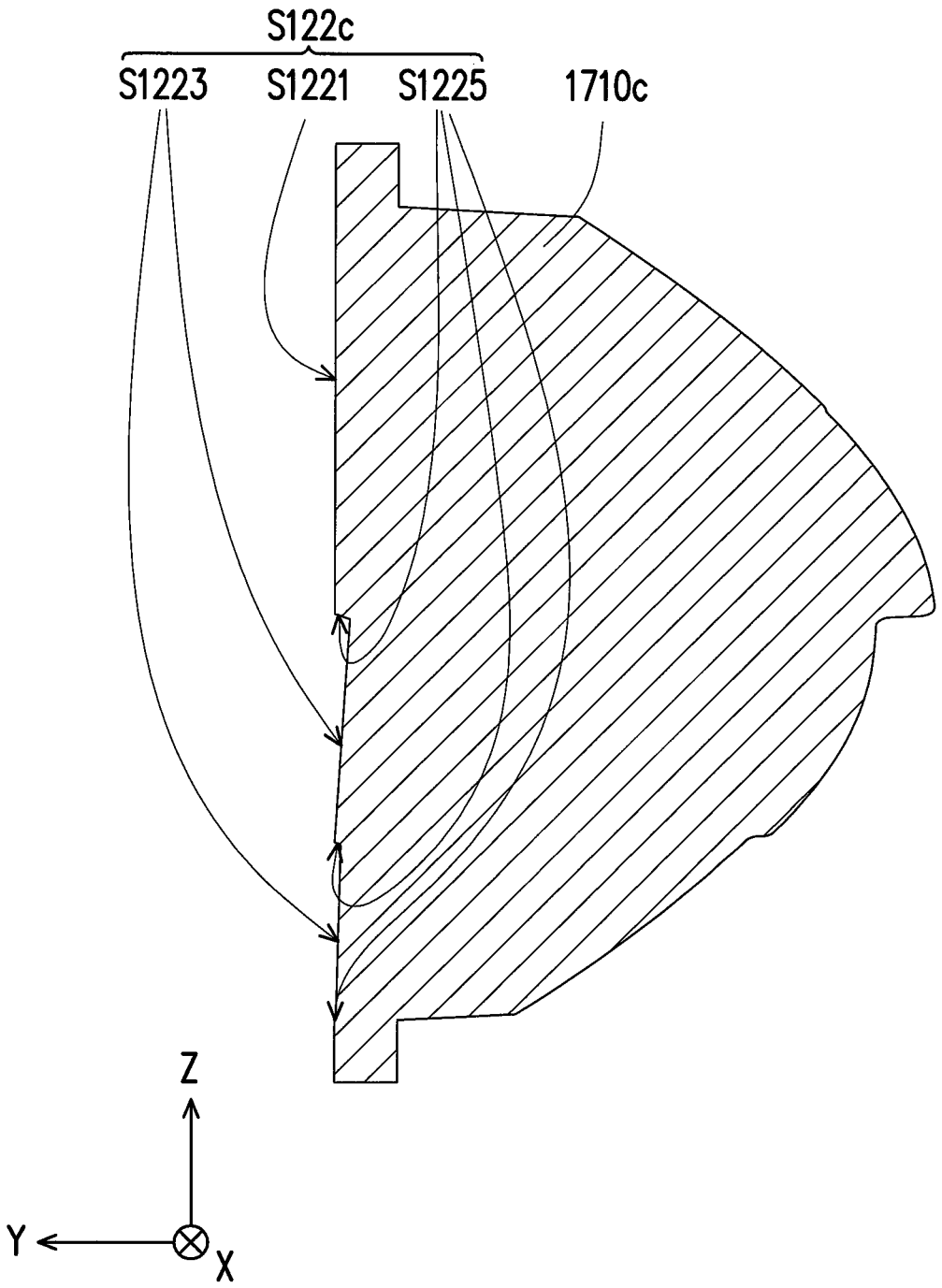
FIG. 35D is a schematic cross-sectional view of the collimating lens depicted in FIG. 35B along a line VIII-VIII.
Figure 35E:
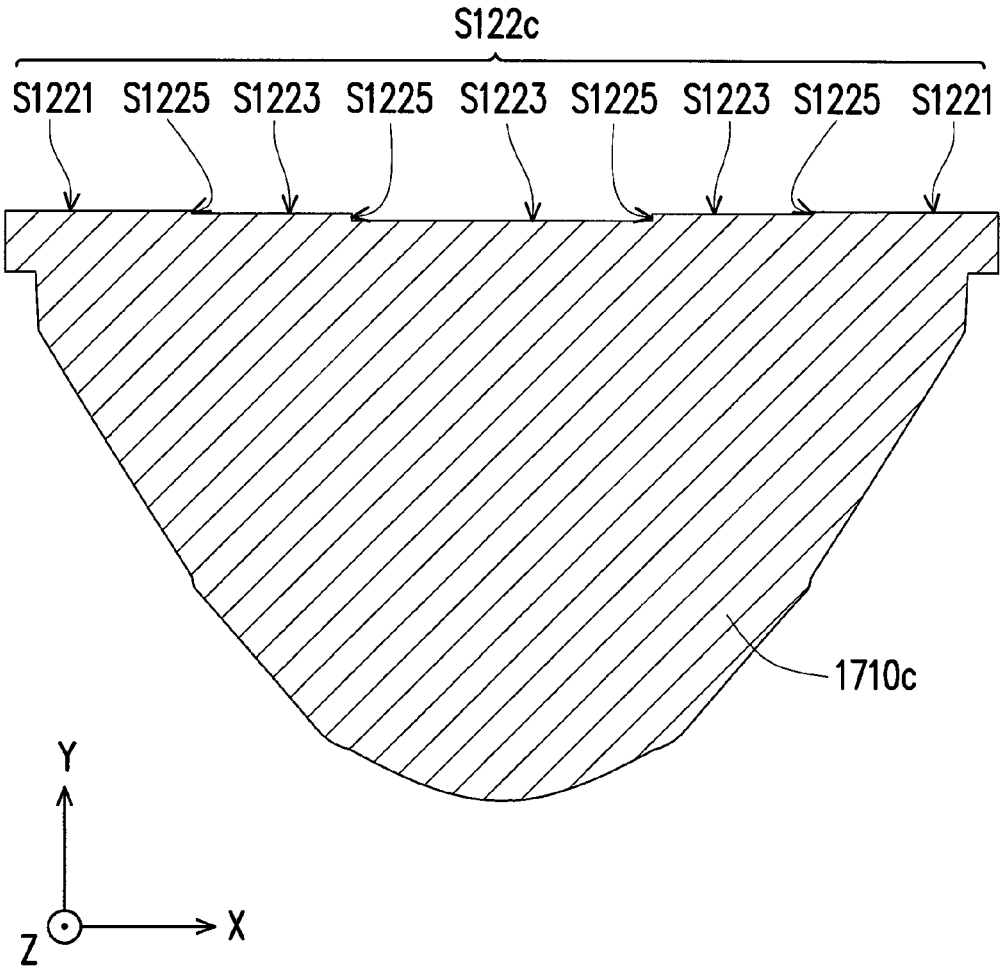
FIG. 35E is a schematic cross-sectional view of the collimating lens depicted in FIG. 35B along a line IX-IX.

FIG. 35A is a schematic three-dimensional view briefly illustrating variations in the collimating lens depicted in FIG. 23A. FIG. 35B is a rear view illustrating the collimating lens depicted in FIG. 35A. FIG. 35C is a schematic cross-sectional view of the collimating lens depicted in FIG. 35B along a line VII-VII. FIG. 35D is a schematic cross-sectional view of the collimating lens depicted in FIG. 35B along a line VIII-VIII. FIG. 35E is a schematic cross-sectional view of the collimating lens depicted in FIG. 35B along a line IX-IX. With reference to FIG. 35A to FIG. 35E, the collimating lens 1710*c* described in the present embodiment is similar to the collimating lens 1710 depicted in FIG. 23A, and the difference between the two lenses is described below. In the collimating lens 1710*c*, the first light transmissive surface S122*c* includes a primary plane S1221 and at least one inclination surface S1223, and plural inclination surfaces S1223 are depicted in FIG. 35A. Here, the inclination surfaces S1223 tilt relative to the primary plane S1221 toward the lower side (where the light pattern OF is located, as shown in FIG. 7) of the reference line RA on the first reference plane r1, as shown in FIG. 7. Namely, the inclination surfaces S1223 tilt upward (i.e., toward the z direction); according to the refraction principles, the light beams emitted from the inclination surfaces S1223 may deflect in a downward direction, and thereby the distribution of the light pattern OF is further moved downward (i.e., toward the −z direction, as shown in FIG. 7). In the present embodiment, the primary plane S1221 is substantially perpendicular to the optical axis O, as shown in FIG. 35C.

The inclination surfaces S1223 are recessed relative to the primary plane S1221 into the collimating lens 1710*c* according to the present embodiment. Besides, in the present embodiment, the inclination surfaces S1223 are not directly connected to an edge of the first light transmissive surface S122*c*. That is, the primary plane S1221 surrounds the inclination surfaces S1223. Moreover, a step S1225 may exist between the primary plane S1221 and the inclination surfaces S1223, or the primary plane S1221 is connected to the inclination surfaces S1223 in a bending manner. In addition, the step S1225 may exist between different inclination surfaces S1223.

Figure 36A:
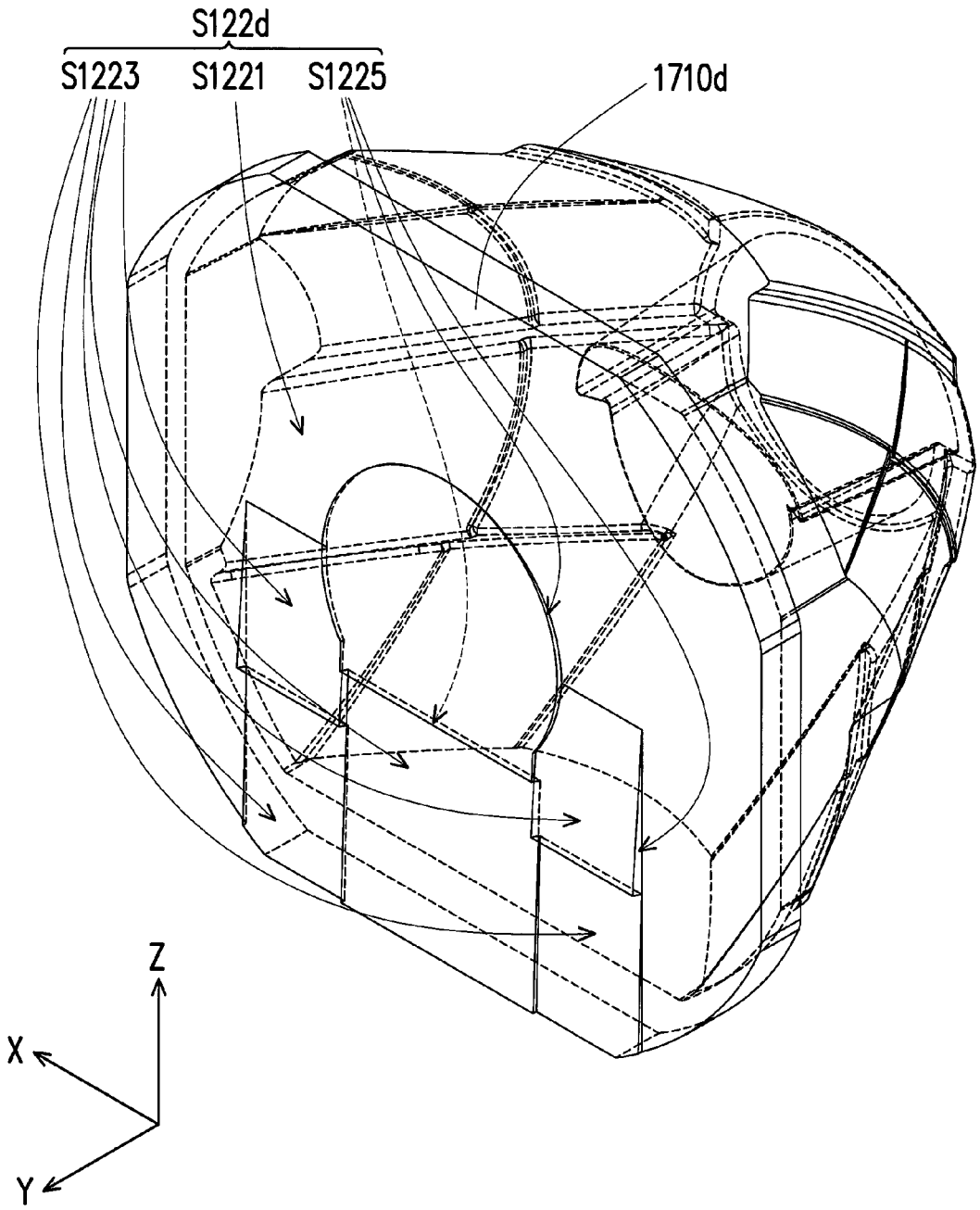
FIG. 36A is a schematic three-dimensional view briefly illustrating variations in the collimating lens depicted in FIG. 35A.
Figure 36B:
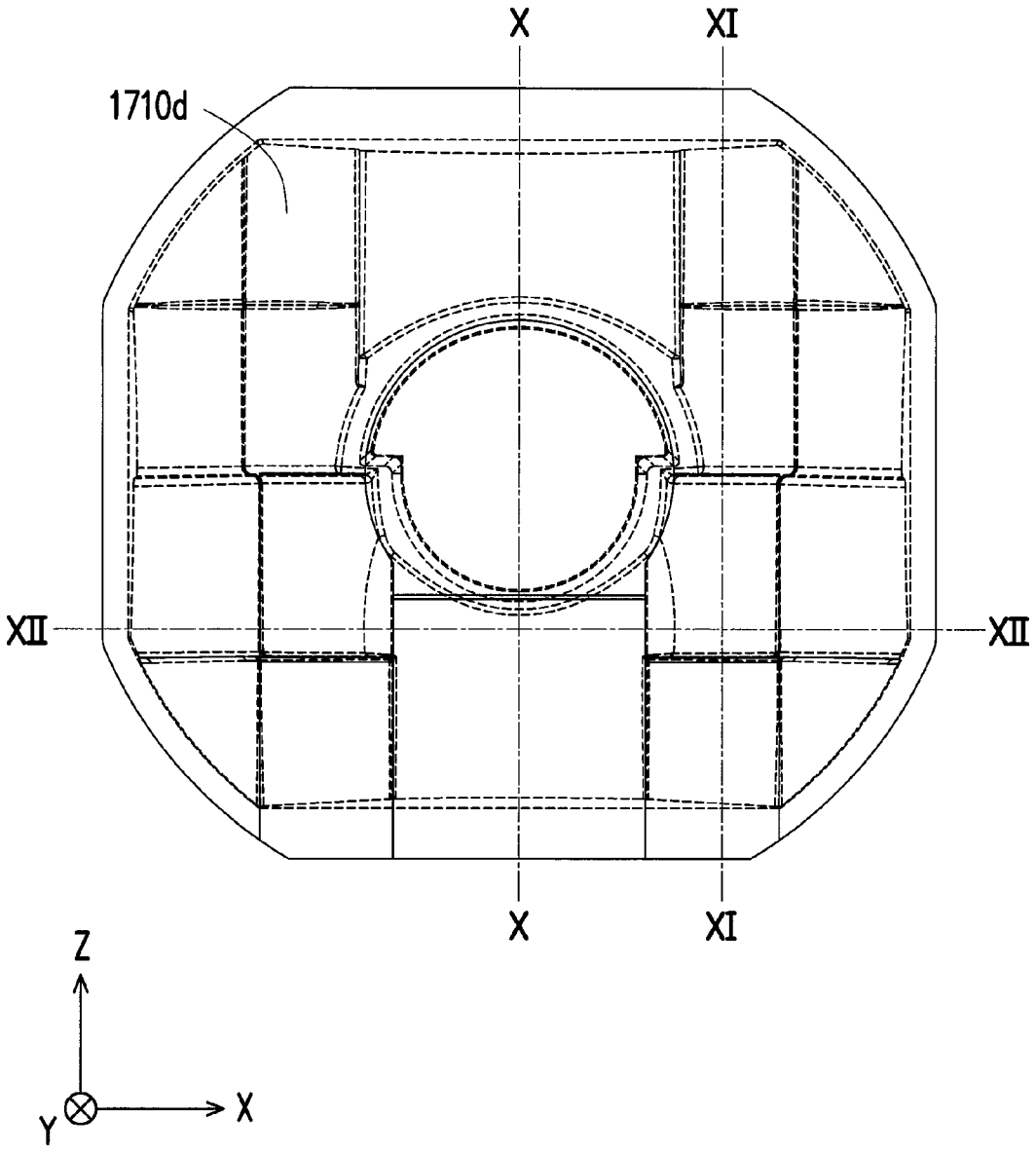
FIG. 36B is a rear view illustrating the collimating lens depicted in FIG. 36A.
Figure 36C:
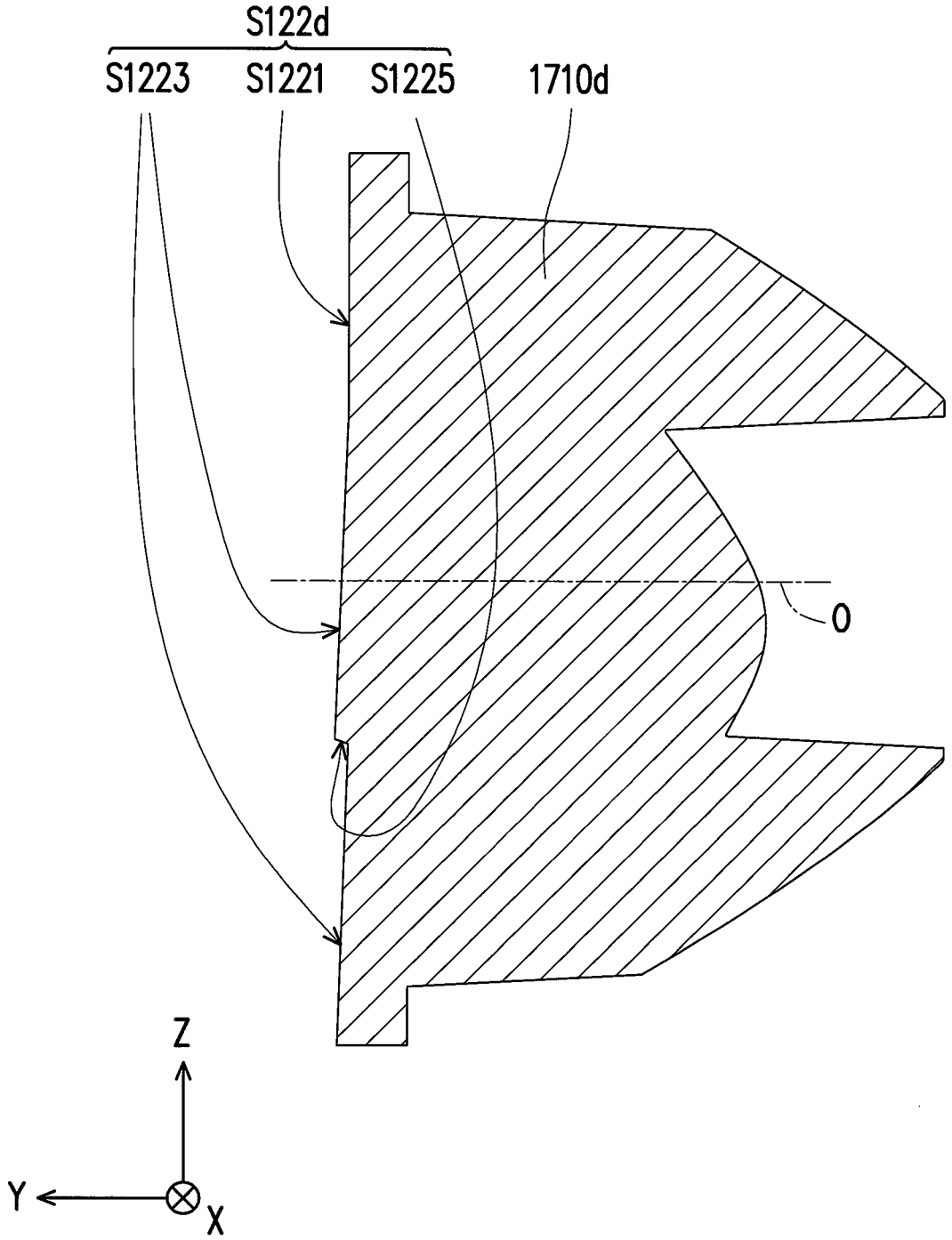
FIG. 36C is a schematic cross-sectional view of the collimating lens depicted in FIG. 36B along a line X-X.
Figure 36D:
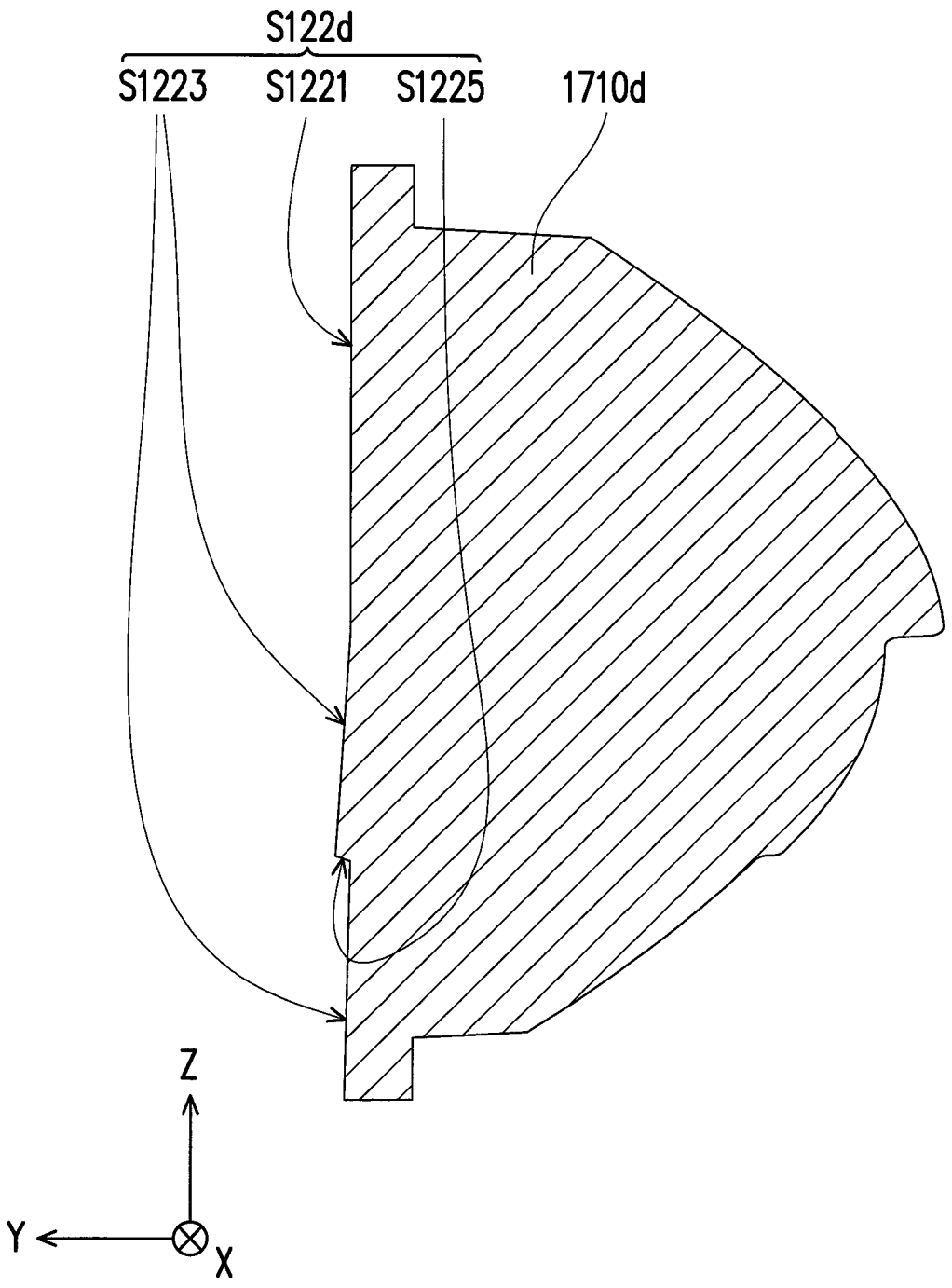
FIG. 36D is a schematic cross-sectional view of the collimating lens depicted in FIG. 36B along a line XI-XI.
Figure 36E:
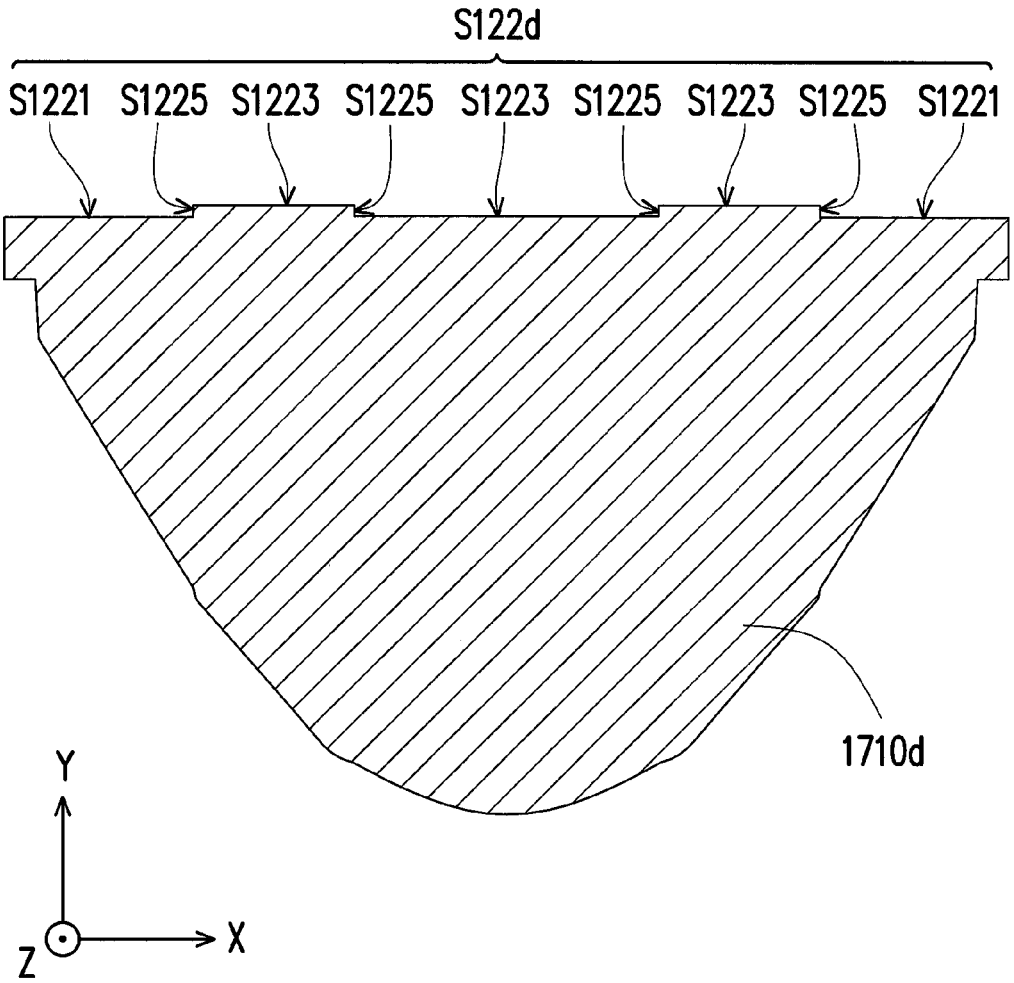
FIG. 36E is a schematic cross-sectional view of the collimating lens depicted in FIG. 36B along a line XII-XII.

FIG. 36A is a schematic three-dimensional view briefly illustrating variations in the collimating lens depicted in FIG. 35A. FIG. 36B is a rear view illustrating the collimating lens depicted in FIG. 36A. FIG. 36C is a schematic cross-sectional view of the collimating lens depicted in FIG. 36B along a line X-X. FIG. 36D is a schematic cross-sectional view of the collimating lens depicted in FIG. 36B along a line XI-XI. FIG. 36E is a schematic cross-sectional view of the collimating lens depicted in FIG. 36B along a line XII-XII. With reference to FIG. 36A to FIG. 36E, the collimating lens 1710*d* described in the present embodiment is similar to the collimating lens 1710*c* depicted in FIG. 35A, and the difference between the two lenses is described below. In the collimating lens 1710*d* described in the present embodiment, the inclination surfaces S1223 of the first light transmissive surface S122*d* protrude from the primary plane S1221. However, in another embodiment of the invention, one portion of the inclination surfaces S1223 is recessed relative to the primary plane S1221 into the collimating lens 1710*c*, and the other portion of the inclination surfaces S1223 protrudes relative to the primary plane S1221 from the collimating lens 1710*c*.

Besides, in the present embodiment, some of the inclination surfaces extend to an edge of the first light transmissive surface S122*d*. In another embodiment, some of the inclination surfaces S1223 depicted in FIG. 35A may also extend to the edge of the first light transmissive surface S122*d*.

Similar to the embodiment depicted in FIG. 35A, in the present embodiment, the step S1225 may also exist between the primary plane S1221 and the inclination surfaces S1223, or the primary plane S1221 is connected to the inclination surfaces S1223 in a bending manner. In addition, the step S1225 may also exist between different inclination surfaces S1223.

To sum up, the vehicle illumination apparatus described herein may serve as the high beam used in vehicle (e.g., automobiles or motorcycles). The condensing and diverging lens has the light condensing region that may condense the first sub-beam (e.g., by allowing the first sub-beam to be collimated), such that the vehicle illumination apparatus is able to provide strong forward light output and comply with the UN ECE regulations issued by the ECE on the high beam used in vehicle. In addition, the condensing and diverging lens also has the light diverging region, and therefore the resultant vehicle illumination apparatus is also capable of providing the wide-range illumination. Moreover, based on total reflection and refraction principles, different regions on the outer surrounding surface of the collimating lens of the vehicle illumination apparatus described herein are designed to have different curved surfaces, and the neighboring regions have steps therebetween, so as to form divergent light patterns at different angles. Thereby, the light pattern of the illumination beam projected out of the collimating lens in the vehicle illumination apparatus has a substantially clear cut-off line, a specific converging region, and a high light utilization rate, and the vehicle illumination apparatus described herein is able to serve as the low beam used in vehicle (e.g., automobiles or motorcycles).

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the present disclosure is intended to be dedicated to the public regardless of whether the element or component is explicitly recited in the following claims. Furthermore, these claims may refer to use "first", "second", etc. following with noun or element. Such terms should be understood as a nomenclature and should not be construed as giving the limitation on the number of the elements modified by such nomenclature unless specific number has been given.

What is claimed is:

1. A vehicle illumination apparatus comprising:

at least one illumination light source providing an illumination beam; and at least one light guiding lens comprising:

a first light transmissive surface projecting the illumination beam out of the at least one light guiding lens;

a second light transmissive surface opposite to and smaller than the first light transmissive surface;

an inner surrounding surface connected to the second light transmissive surface, the inner surrounding surface and the second light transmissive surface collectively defining a containing space configured to accommodate the at least one illumination light source; and an outer surrounding surface connected to the inner surrounding surface and the first light transmissive surface, the outer surrounding surface expanding toward the first light transmissive surface from a location where the inner surrounding surface is connected to the outer surrounding surface, wherein the outer surrounding surface comprises a plurality of reflection regions, each of the reflection regions comprises at least one light condensing region and at least one light diverging region, and at least one step is between the reflection regions, wherein a light pattern of the illumination beam projected out of the at least one light guiding lens is measured on a first reference plane intersecting an optical axis of the at least one illumination light source at a point, and the measured light pattern is substantially distributed over one side of a reference line on the first reference plane.

2. The vehicle illumination apparatus as recited in claim 1, wherein a first sub-beam of the illumination beam sequentially passes the inner surrounding surface, is reflected by the at least one light condensing region, and passes the first light transmissive surface, a second sub-beam of the illumination beam sequentially passes the inner surrounding surface, is reflected by the at least one light diverging region, and passes the first light transmissive surface, and a divergence angle of the second sub-beam passing the first light transmissive surface is greater than a divergence angle of the first sub-beam passing the first light transmissive surface.

3. The vehicle illumination apparatus as recited in claim 2, wherein an irradiation range of the second sub-beam passing the first light transmissive surface covers an irradiation range of the first sub-beam passing the first light transmissive surface.

4. The vehicle illumination apparatus as recited in claim 3, wherein a third sub-beam of the illumination beam sequentially passes the second light transmissive surface and the first light transmissive surface, and the divergence angle of the second sub-beam passing the first light transmissive surface is greater than a divergence angle of the third sub-beam passing the first light transmissive surface.

5. The vehicle illumination apparatus as recited in claim 2, wherein an irradiation range of the first sub-beam passing the first light transmissive surface is substantially located at a center of an irradiation range of the second sub-beam passing the first light transmissive surface.

6. The vehicle illumination apparatus as recited in claim 2, wherein a width of the at least one step is increased progressively along a direction perpendicular to an optical axis of the at least one illumination light source.

7. The vehicle illumination apparatus as recited in claim 2, wherein a curvature of the at least one light diverging region is increased progressively and then decreased progressively along a direction perpendicular to an optical axis of the at least one illumination light source.

8. The vehicle illumination apparatus as recited in claim 1, wherein the second light transmissive surface is mirror-asymmetrical relative to a second reference plane parallel to the optical axis of the at least one illumination light source.

9. The vehicle illumination apparatus as recited in claim 1, wherein the at least one light condensing region refers to a plurality of the light condensing regions, the at least one light diverging region refers to a plurality of the light diverging regions, each of the light condensing regions is a continuous curved surface, and each of the light diverging regions is a continuous curved surface.

10. The vehicle illumination apparatus as recited in claim 1, wherein a light pattern of a portion of the illumination beam functioned by the at least one light diverging region and projected out of the at least one light guiding lens is measured on the first reference plane, the measured light pattern is distributed under the reference line, an angle is included between the optical axis of the at least one illumination light source and a connection line between a center point of the first light transmissive surface and an endpoint of the light pattern at a maximum width in a direction parallel to the reference line, and the included angle is at least greater than a critical angle range.

11. The vehicle illumination apparatus as recited in claim 1, wherein the at least one light diverging region comprises a plurality of sub light diverging regions, a light pattern of a portion of the illumination beam functioned by the sub light diverging regions and projected out of the at least one light guiding lens is measured on the first reference plane, the measured light pattern is distributed under the reference line, an angle is included between the optical axis of the at least one illumination light source and a connection line between a center point of the first light transmissive surface and an endpoint of the light pattern of the portion of the illumination beam functioned by the sub light diverging regions at a maximum width in a direction parallel to the reference line, and the included angle is greater than a critical angle range.

12. The vehicle illumination apparatus as recited in claim 11, wherein each of the sub light diverging regions is a continuous curved surface, and the at least one step is between each of the sub light diverging regions and neighboring reflection regions of the each of the sub light diverging regions.

13. The vehicle illumination apparatus as recited in claim 11, wherein the sub light diverging regions comprise a first sub light diverging region and a second sub light diverging region, a light pattern of a portion of the illumination beam functioned by the first sub light diverging region and projected out of the at least one light guiding lens is measured on the first reference plane, the measured light pattern of the portion of the illumination beam functioned by the first sub light diverging region is distributed under the reference line, an included angle between the optical axis of the at least one illumination light source and the connection line between the center point of the first light transmissive surface and an endpoint of the light pattern of the portion of the illumination beam functioned by the first sub light diverging region at a maximum width in the direction parallel to the reference line is within a first angle range, a light pattern of a portion of the illumination beam functioned by the second sub light diverging region and projected out of the at least one light guiding lens is measured on the first reference plane, the measured light pattern of the portion of the illumination beam functioned by the second sub light diverging region is distributed under the reference line, an included angle between the optical axis of the at least one illumination light source and the connection line between the center point of the first light transmissive surface and an endpoint of the light pattern of the portion of the illumination beam functioned by the second sub light diverging region at a maximum width in the direction parallel to the reference line is within a second angle range, the second angle range is greater than the first angle range, and the first angle range is greater than the critical angle range.

14. The vehicle illumination apparatus as recited in claim 11, wherein a light pattern of a portion of the illumination beam functioned by the second light transmissive surface and projected out of the at least one light guiding lens is measured on the first reference plane, the measured light pattern is distributed under the reference line, an angle is included between the optical axis of the at least one illumination light source and a connection line between a center point of the first light transmissive surface and an endpoint of the light pattern at a maximum width in a direction parallel to the reference line, and the included angle is at least greater than the critical angle range.

15. The vehicle illumination apparatus as recited in claim 14, wherein the included angle between the optical axis of the at least one illumination light source and the connection line between the center point of the first light transmissive surface and the endpoint of the measured light pattern at the maximum width in the direction parallel to the reference line is within a third angle range greater than the critical angle range.

16. The vehicle illumination apparatus as recited in claim 1, wherein a light pattern of a portion of the illumination beam functioned by the at least one light condensing region and projected out of the at least one light guiding lens is measured on the first reference plane, the measured light pattern is distributed under the reference line, an angle is included between the optical axis of the at least one illumination light source and a connection line between a center point of the first light transmissive surface and an endpoint of the light pattern at a maximum width in a direction parallel to the reference line, and the included angle is smaller than or equal to a critical angle range.

17. The vehicle illumination apparatus as recited in claim 16, wherein the at least one light condensing region comprises a plurality of sub light condensing regions, each of the sub light condensing regions is a continuous curved surface, and the at least one step is between each of the sub light condensing regions and neighboring reflection regions of the each of the sub light condensing regions.

18. The vehicle illumination apparatus as recited in claim 17, wherein the sub light condensing regions are arranged on two sides of the at least one light diverging region.

19. The vehicle illumination apparatus as recited in claim 1, wherein the reflection regions further comprise at least one specific angle-forming region, a light pattern of the illumination beam functioned by the at least one specific angle-forming region and projected out of the at least one light guiding lens is measured on the first reference plane, the measured light pattern is distributed under the reference line, the reference line is a polyline and comprises two straight lines, the two straight lines intersect each other, and a specific angle is included between the two straight lines.

20. The vehicle illumination apparatus as recited in claim 19, wherein each of the at least one specific angle-forming region is a continuous curved surface, and the at least one step is between each of the at least one specific angle-forming region and neighboring reflection regions of the specific angle-forming regions.

21. The vehicle illumination apparatus as recited in claim 20, wherein the at least one specific angle-forming region is arranged on two sides of the at least one light diverging region and on two sides of the second reference plane.

22. The vehicle illumination apparatus as recited in claim 1, wherein the second light transmissive surface is mirror-symmetrical relative to a third reference plane parallel to the optical axis of the at least one illumination light source, and the second reference plane is substantially perpendicular to the third reference plane.

23. The vehicle illumination apparatus as recited in claim 1, wherein the first light transmissive surface comprises:

a primary plane; and at least one inclination surface tilting relative to a direction parallel to the primary plane.

24. The vehicle illumination apparatus as recited in claim 23, wherein the at least one inclination surface is recessed relative to the primary plane into the at least one light guiding lens.

25. The vehicle illumination apparatus as recited in claim 23, wherein the at least one inclination surface protrudes relative to the primary plane from the at least one light guiding lens.

26. The vehicle illumination apparatus as recited in claim 23, wherein one portion of the at least one inclination surface is recessed relative to the primary plane into the at least one light guiding lens, and the other portion of the at least one inclination surface protrudes relative to the primary plane from the at least one light guiding lens.

27. The vehicle illumination apparatus as recited in claim 23, wherein the at least one inclination surface refers to a plurality of the inclination surfaces, and part of the inclination surfaces extends to an edge of the first light transmissive surface.

28. The vehicle illumination apparatus as recited in claim 23, wherein the at least one inclination surface is not directly connected to an edge of the first light transmissive surface.

29. The vehicle illumination apparatus as recited in claim 1, wherein the second light transmissive surface is a continuous curved surface.

30. The vehicle illumination apparatus as recited in claim 1, wherein the first light transmissive surface is a plane.

31. The vehicle illumination apparatus as recited in claim 1, wherein the first light transmissive surface is a protruding curved surface.

32. The vehicle illumination apparatus as recited in claim 1, wherein the first light transmissive surface has a protruding sub-surface located on the optical axis of the at least one illumination light source.

33. The vehicle illumination apparatus as recited in claim 32, wherein the first light transmissive surface further has a ring-shaped concave surface surrounding the protruding sub-surface.

34. The vehicle illumination apparatus as recited in claim 33, wherein the ring-shaped concave surface and the protruding sub-surface are smoothly connected to form a continuous curved surface.

35. The vehicle illumination apparatus as recited in claim 33, wherein a depth of the ring-shaped concave surface in a direction parallel to the optical axis of the at least one illumination light source is greater than a height of the protruding sub-surface in the direction parallel to the optical axis of the at least one illumination light source.

36. The vehicle illumination apparatus as recited in claim 33, wherein a depth of the ring-shaped concave surface in a direction parallel to the optical axis of the at least one illumination light source is less than a height of the protruding sub-surface in the direction parallel to the optical axis of the at least one illumination light source.

37. The vehicle illumination apparatus as recited in claim 1, wherein the number of the at least one illumination light source is at least 2, the number of the at least one light guiding lens corresponds to the number of the at least one illumination light source, materials of the light guiding lenses are the same, the light guiding lenses are integrally formed and collectively have a lens structure, and the illumination light sources are correspondingly located in the containing spaces of the light guiding lenses.

38. The vehicle illumination apparatus as recited in claim 37, wherein optical axes of the illumination light sources are substantially parallel to each other or one another.

39. The vehicle illumination apparatus as recited in claim 37, wherein a light pattern of the illumination beam projected out of the at least one light guiding lens is measured on a first reference plane intersecting an optical axis of the at least one illumination light source at a point, and the measured light pattern is substantially distributed over one side of a reference line on the first reference plane.

40. The vehicle illumination apparatus as recited in claim 37, wherein the at least one light guiding lens allows an irradiation range of a second sub-beam passing the first light transmissive surface to cover an irradiation range of a first sub-beam passing the first light transmissive surface.

41. The vehicle illumination apparatus as recited in claim 37, further comprising:

a substrate suitable for accommodating the light guiding lenses.

* * * * *